US011918864B2

(12) United States Patent
Woodward et al.

(10) Patent No.: US 11,918,864 B2
(45) Date of Patent: Mar. 5, 2024

(54) GOLF CLUB HEADS WITH A MULTI-MATERIAL STRIKING SURFACE

(71) Applicant: KARSTEN MANUFACTURING CORPORATION, Phoenix, AZ (US)

(72) Inventors: Alex G. Woodward, Phoenix, AZ (US); Matthew T. Schier, Phoenix, AZ (US); Murphy R. Alexander, Scottsdale, AZ (US); Anthony D. Serrano, Phoenix, AZ (US); James D. Willmott, Loughborough (GB); Erik M. Henrikson, Phoenix, AZ (US); David A. Higdon, Cave Creek, AZ (US); Cole D. Brubaker, Scottsdale, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 30 days.

(21) Appl. No.: 17/816,633

(22) Filed: Aug. 1, 2022

(65) Prior Publication Data

US 2022/0362637 A1 Nov. 17, 2022

Related U.S. Application Data

(63) Continuation-in-part of application No. 17/645,267, filed on Dec. 20, 2021, which is a continuation of (Continued)

(51) Int. Cl.
*A63B 53/04* (2015.01)

(52) U.S. Cl.
CPC ..... *A63B 53/0429* (2020.08); *A63B 53/0412* (2020.08); *A63B 53/0487* (2013.01); *A63B 53/0445* (2020.08)

(58) Field of Classification Search
CPC ..... A63B 53/0425; A63B 53/042; A63B 53/0429
See application file for complete search history.

(56) References Cited

U.S. PATENT DOCUMENTS 873,423 A 12/1907 Govan
1,449,559 A 3/1923 Relle
(Continued)

FOREIGN PATENT DOCUMENTS

EP 963221 12/1999
GB 2293982 4/1996
(Continued)

OTHER PUBLICATIONS

International Search Report and Written Opinion for PCT Application No. PCT/US2018/045443 dated Dec. 11, 2018, filed Jun. 8, 2018.

(Continued)

*Primary Examiner* — Raeann Gorden

(57) ABSTRACT

Embodiments of putter-type golf club head comprising a striking surface capable of achieving consistent ball speeds across the striking surface to account for various ball impact locations are described herein. The striking surface has at least two materials that differ in concentration away from the geometric center of the striking surface to provide this consistency. Consistent (or uniform) ball speed is achieved throughout the striking surface as the portion of the golf ball that contacts the striking surface interacts with at least two materials having a differing material characteristic.

20 Claims, 27 Drawing Sheets

Related U.S. Application Data application No. 16/983,924, filed on Aug. 3, 2020, now Pat. No. 11,207,572.

(60) Provisional application No. 63/203,817, filed on Jul. 30, 2021, provisional application No. 63/046,505, filed on Jun. 30, 2020, provisional application No. 62/881,463, filed on Aug. 1, 2019.

(56) References Cited

U.S. PATENT DOCUMENTS 1,654,257 A 12/1927 Hillerich
1,854,548 A 4/1932 Hunt
3,659,855 A 5/1972 Hardesty
D240,949 S 8/1976 Jones
4,508,349 A 4/1985 Gebauer
4,550,914 A 11/1985 McCallister
4,679,792 A 7/1987 Straza
4,749,197 A 6/1988 Orlowski
4,753,440 A 6/1988 Chorne
4,792,140 A 12/1988 Yamaguchi
4,858,929 A 8/1989 Long
4,884,808 A 12/1989 Retzer
5,090,702 A 2/1992 Viste
5,141,231 A 8/1992 Cox
5,255,918 A 10/1993 Anderson
5,282,624 A 2/1994 Viste
5,354,049 A 10/1994 Matherne
5,358,249 A 10/1994 Mendralla
5,423,535 A 6/1995 Shaw
5,458,332 A 10/1995 Fisher
5,472,201 A 12/1995 Aizawa
5,505,450 A 4/1996 Stuff
5,531,439 A 7/1996 Azzarella
5,591,092 A 1/1997 Gilbert
5,601,501 A 2/1997 Kobayashi
5,611,742 A 3/1997 Kobayashi
5,637,044 A 6/1997 Swash
5,643,099 A 7/1997 Solheim
5,676,605 A 10/1997 Kobayashi
5,688,186 A 11/1997 Michaels
5,690,561 A 11/1997 Rowland
5,709,617 A 1/1998 Nishimura
5,711,722 A 1/1998 Miyajima
5,735,755 A 4/1998 Kobayashi
5,755,626 A 5/1998 Shira
5,762,566 A 6/1998 King
5,766,087 A 6/1998 Kawamatsu
5,766,093 A 6/1998 Rohrer
6,200,229 B1 3/2001 Grace
6,224,497 B1 5/2001 Antonious
6,227,986 B1 5/2001 Fisher
6,257,994 B1 7/2001 Antonious
6,273,831 B1 8/2001 Dewanjee
6,302,807 B1 10/2001 Rohrer
6,322,459 B1 11/2001 Nishimura
6,336,869 B1 1/2002 Hettinger
6,398,665 B1 6/2002 Antonious
6,406,379 B1 6/2002 Christensen
6,431,997 B1 8/2002 Rohrer
6,478,690 B2 11/2002 Helmstetter
6,488,594 B1 12/2002 Card
6,554,721 B1 4/2003 Woodward
6,592,467 B1 7/2003 Gray
D481,432 S 10/2003 Greene
6,699,140 B1 3/2004 Sun
6,710,287 B2 3/2004 Lu
6,719,644 B2 4/2004 Beach
6,719,645 B2 4/2004 Kouno
D490,129 S 5/2004 Greene
6,743,117 B2 6/2004 Gilbert
6,875,124 B2 4/2005 Gilbert
7,018,303 B2 3/2006 Yamamoto
7,056,226 B2 6/2006 Kennedy
7,066,833 B2 6/2006 Yamamoto
7,101,290 B2 9/2006 Tucker, Sr.
7,163,467 B1 1/2007 Chang
7,179,175 B2 2/2007 Kennedy, III
7,192,365 B2 3/2007 Souza
7,261,644 B2 8/2007 Burrows
7,273,420 B2 9/2007 Wright
7,273,422 B2 9/2007 Vokey
7,285,057 B2 10/2007 Mann, Jr.
7,341,527 B1 3/2008 Fisher
7,364,513 B2 4/2008 Krumme
7,413,517 B2 8/2008 Butler, Jr.
7,431,662 B2 10/2008 Tucker, Sr.
7,442,129 B2 10/2008 Bardha
7,455,597 B2 11/2008 Matsunaga
7,473,186 B2 1/2009 Best
D588,922 S 3/2009 Hagleitner
7,500,923 B2 3/2009 Tateno
D596,687 S 7/2009 Bezilla
7,566,276 B2 7/2009 Billings
7,568,983 B2 8/2009 Gilbert
7,588,499 B2 9/2009 Tateno
7,594,863 B2 9/2009 Ban
D603,009 S 10/2009 Bezilla
7,604,550 B1 10/2009 Currie
D605,242 S 12/2009 Franklin
7,662,049 B2 2/2010 Park
7,691,006 B1 4/2010 Burke
D615,140 S 5/2010 Franklin
7,717,801 B2 5/2010 Franklin
7,749,098 B2 7/2010 Johnson
7,749,099 B2 7/2010 Ban
7,758,449 B2 7/2010 Gilbert
7,780,548 B2 8/2010 Solheim
7,794,335 B2 9/2010 Cole
7,806,779 B2 10/2010 Franklin
7,819,756 B2 10/2010 Ban
7,824,278 B2 11/2010 Miyamichi
7,862,450 B2 1/2011 Gilbert
7,905,797 B2 3/2011 Gilbert
7,914,394 B2 3/2011 Cole
7,922,602 B2 4/2011 Johnson
7,942,758 B2 5/2011 Nakamura
D639,879 S 6/2011 Lee
8,012,035 B2 9/2011 Franklin
8,021,245 B2 9/2011 Beach
8,033,931 B2 10/2011 Wahl
8,066,586 B2 11/2011 Solheim
8,066,587 B2 11/2011 Tateno
8,083,605 B2 12/2011 Franklin
8,216,081 B2 7/2012 Snyder
8,282,505 B2 10/2012 Solheim
8,287,401 B2 10/2012 Tateno
8,292,754 B2 10/2012 Snyder
8,353,780 B2 1/2013 Hatton
8,382,604 B2 2/2013 Billings
8,425,342 B2 4/2013 Snyder
8,480,513 B2 7/2013 Kuan
8,545,343 B2 10/2013 Boyd
8,579,717 B2 11/2013 Snyder
8,617,001 B2 12/2013 Sandoval
8,636,607 B2 1/2014 Renna
8,641,549 B2 2/2014 Stites
8,641,556 B2 2/2014 Kuan
8,747,245 B2 6/2014 Franklin
8,764,578 B2 7/2014 Solheim
8,790,193 B2 7/2014 Serrano
8,814,715 B2 8/2014 Franklin
8,834,285 B2 9/2014 Franklin
8,900,064 B2 12/2014 Franklin
8,900,071 B2 12/2014 Kii
8,961,334 B2 2/2015 Franklin
8,979,668 B2 3/2015 Nakamura
9,022,876 B2 5/2015 Snyder
9,108,088 B2 8/2015 Serrano
9,144,717 B2 9/2015 Franklin
9,452,326 B2 9/2016 Serrano
9,545,547 B1 1/2017 Abbott
9,561,407 B2 2/2017 Serrano
9,694,260 B1 * 7/2017 Abbott ..... A63B 60/00

(56) References Cited

U.S. PATENT DOCUMENTS

| | | | | |
|---|---|---|---|---|
| 9,849,351 | B2 | 12/2017 | Serrano | |
| 9,849,358 | B2 | 12/2017 | Franklin | |
| 9,889,353 | B2 | 2/2018 | Philip | |
| 9,943,735 | B2 | 4/2018 | Rife | |
| 9,987,530 | B2 | 6/2018 | Jertson | |
| 10,092,802 | B2 | 10/2018 | Serrano | |
| 10,398,947 | B2 | 9/2019 | Serrano | |
| 10,632,352 | B2 | 4/2020 | Lambeth | |
| 10,653,931 | B2 | 5/2020 | Philip | |
| 10,668,340 | B2 | 6/2020 | Lambeth | |
| 10,737,153 | B2 | 8/2020 | Schweigert | |
| 11,083,938 | B2 | 8/2021 | Wang | |
| 11,090,535 | B1 | 8/2021 | Schweigert | |
| 11,207,572 | B2 * | 12/2021 | Willmott | A63B 53/0429 |
| 2005/0009623 | A1 | 1/2005 | Dickinson | |
| 2005/0020378 | A1 | 1/2005 | Krumme | |
| 2007/0099723 | A1 | 5/2007 | Tateno | |
| 2007/0149311 | A1 | 6/2007 | Wright | |
| 2007/0243949 | A1 | 10/2007 | Solari | |
| 2008/0234066 | A1 | 9/2008 | Jones | |
| 2009/0156328 | A1 | 6/2009 | Reese | |
| 2011/0165963 | A1 | 7/2011 | Cackett | |
| 2012/0071269 | A1 | 3/2012 | Rahrig | |
| 2016/0016050 | A1 | 1/2016 | Rife | |
| 2017/0239534 | A1 | 8/2017 | Rife | |
| 2018/0200588 | A1 | 7/2018 | Rife | |
| 2020/0261777 | A1 | 8/2020 | Yi | |

FOREIGN PATENT DOCUMENTS

| | | |
|---|---|---|
| JP | 09047532 | 2/1997 |
| JP | H0975486 | 3/1997 |
| JP | 2813969 | 10/1998 |
| JP | H10263118 | 10/1998 |
| JP | 11047317 | 2/1999 |
| JP | 2000176058 | 6/2000 |
| JP | 2002153575 | 5/2002 |
| JP | 2002239040 | 8/2002 |
| JP | 2003000776 | 1/2003 |
| JP | 2005287534 | 10/2005 |
| JP | 3901788 | 4/2007 |
| WO | 2008110842 | 9/2008 |

OTHER PUBLICATIONS

International Search Report and Written Opinion for PCT Application No. PCT/US2020/044782 dated Oct. 16, 2020, filed Aug. 3, 2020.

Vintage Rare Lilac Bros. No Scuff Putter Dearborn Mich., https://www.worthpoint.com/worthopedia/vintage-lilac-bros-scuff-putter-46140117, Nov. 19, 2012.

Putter, Laser Light by Clayton, https://www.worthpoint.com/worthopedia/putter-laser-light-clayton-151457342, May 6, 2011.

Never Comprise Milled Series, https://forums.golfwrx.com/discussion/2491/never-compromise-milled-series, Jun. 30, 2005.

International Search Report and Written Opinion dated Jan. 14, 2016 for PCT Application No. PCT/ US2015/058127, filed Oct. 29, 2015.

International Search Report and Written Opinion dated Jun. 5, 2016 for PCT Application No. PCT/US2015/018813, filed Mar. 4, 2015.

Jeffery B. Ellis, The Club Maker's Art, Antique Golf Clubs and Their History, vol. 1, p. 253, C and C Offset Printing Co., Ltd. (Portland, Oregon 2007).

Truth Digest MyGolfSpy, Machine M2A Converter Putter—Part 1, The Story and The Putter, https://forum.mygolfspy.com/topic/4634-machine-m2a-converter-putter-%C3%A2%E2%82%AC%E2%80%9C-part-1-%C3%A2%E2%82%AC%E2%80%9C-the-story-and-the-putter/, Nov. 2011.

Dave Billings' Golf Locker—Tales and Treasure from 25 years in Golf, http://daveysgolflocker.blogspot.com/, Oct. 5, 2012.

Machine Putters Picture Thread, https://forums.golfwrx.com/discussion/171701/machine-putters-picture-thread/p4, Jan. 9, 2007.

Machine Putters Picture Thread, https://forums.golfwrx.com/discussion/171701/machine-putters-picture-thread/p10, Feb. 1, 2007.

Machine Putters Picture Thread, https://forums.golfwrx.com/discussion/171701/machine-putters-picture-thread/p31, Sep. 6, 2009.

International Search Report and Written Opinion for PCT Application No. PCT/US2012/057503 dated Feb. 27, 2013, filed Sep. 27, 2012.

International Search Report and Written Opinion for PCT Application No. PCT/US2016/046866 dated Oct. 28, 2016, filed Aug. 12, 2016.

* cited by examiner

GOLF CLUB HEADS WITH A MULTI-MATERIAL STRIKING SURFACE

RELATED APPLICATION DATA

This is a continuation-in-part of U.S. patent application Ser. No. 17/645,267, filed on Dec. 20, 2021, which is a continuation of U.S. patent application Ser. No. 16/983,924, filed on Oct. 3, 2020, now U.S. Pat. No. 11,207,572, issued on Dec. 28, 2021, which claims the benefit of U.S. Provisional Patent Application No. 62/881,463, filed on Aug. 1, 2019, and U.S. Provisional Patent Application No. 63/046,505, filed on Jun. 30, 2020, the contents of all of which are entirely incorporated herein by reference.

TECHNICAL FIELD

This disclosure relates generally to golf club heads and more particularly to a putter-type golf club head with a multi-material striking surface.

BACKGROUND

As golf clubs are the sole instruments that set golf balls in motion during play, the golf industry has seen improvements in putters and golf club head designs in recent years. However, it is known, that when it comes to designing putter-type club heads, golfers tend to prioritize personal preference characteristics (i.e. club head feel, club head aesthetics, club head sound etc.) over performance.

To putt a golf ball in the hole, a golfer must successfully impact the golf ball (with a golf club head and more particularly a putter-type golf club head) at a proper speed and face angle. This provides a challenge to all golfers, as many struggle to consistently impact the golf ball at the same location putt after putt. Striking the golf ball at various locations on the putter-type club head can alter the amount of energy transferred from the putter head to the golf ball during initial contact, impact feel, impact sound and/or travel direction of the golf ball. Specifically, variation in strike location can cause differences in ball speed across the striking surface, causing putts to travel unpredictable distances. There is a need in the art to create a putter-type golf club head that balances golfers' personal preference characteristics while considering various impact locations.

DESCRIPTION

Figure 1:
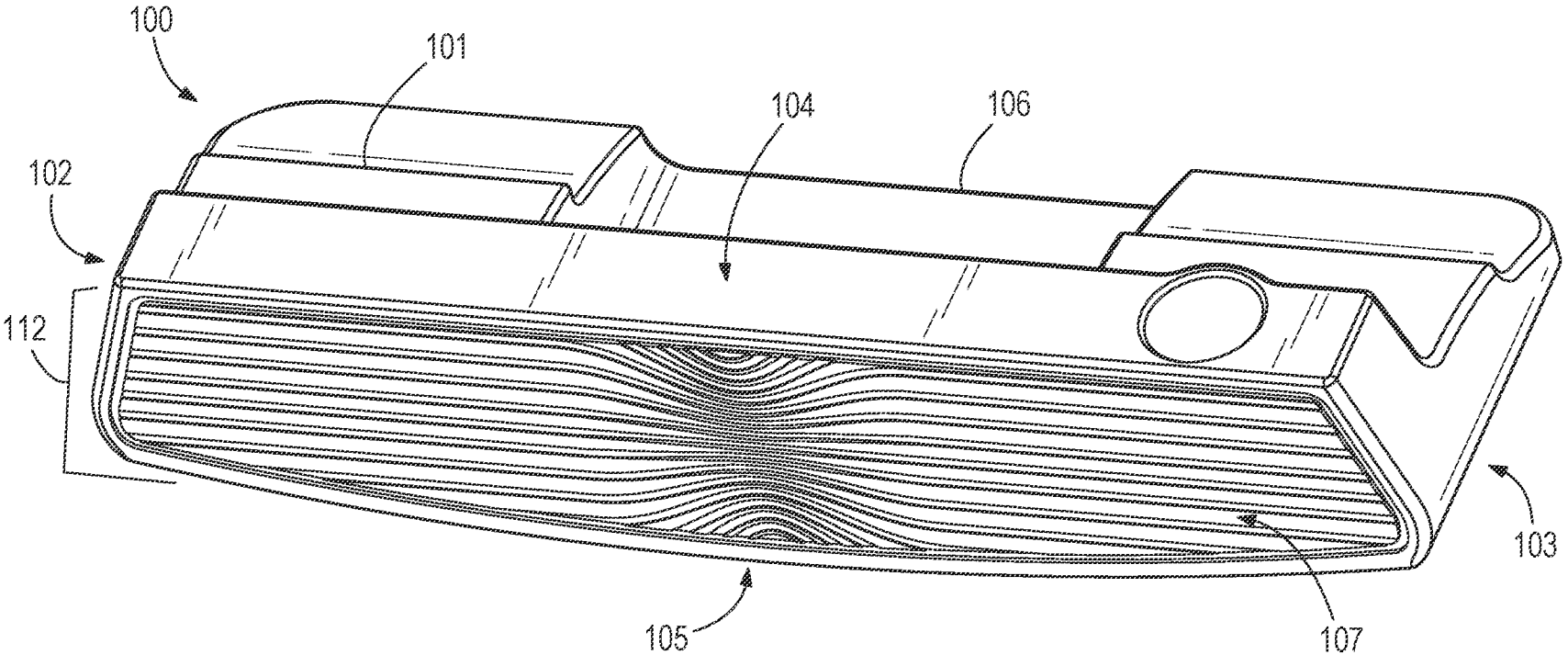
FIG. 1 shows a heel side perspective view of a striking surface having continuous grooves for a non-insert style club head according to one embodiment.

Directed herein are golf club heads, and in particular, a putter-type golf club heads comprising a striking surface capable of achieving consistent ball speeds across the striking surface to account for various ball impact locations. This striking surface has at least two materials that differs in concentration away from the geometric center (or center region) of the striking surface to provide this consistency. Consistent (or uniform) ball speed is achieved throughout the striking surface as the portion of the golf ball that contacts the striking surface interacts with at least two materials having a differing material property (or characteristic).

The differing material property can be (but not an exhaustive list of) tensile strength, flexural modulus, or material hardness. A uniform ball speed is accomplished by the combination of a dual material striking surface and varying the amount of the first material and/or the second material away from the geometric center (or center region) of the striking surface. In many embodiments, the first and second material cooperate to form a softer, more flexible center region and opposing the center region either in a heel or toe direction, the first and second material cooperate to form a harder, stiffer, and less flexible region. This is because contact outside the geometric center of the striking surface (or club head sweet spot) results in less energy transfer from the club head to the golf ball.

Creating a center region that is less responsive than the corresponding heel and toe regions can be accomplished in many ways. For example, in embodiments, where a first soft material dominates a less soft second material, a less responsive center region can be formed. In other embodiments, a less responsive center region can be formed by controlling the void and/or recess patterns to form larger first material land areas at the center region than at adjacent heel and toe regions.

The term or phrase "lie angle" used herein can be defined as being the angle between a golf shaft (not shown) and a playing surface once the sole contacts the playing surface. The lie angle of a golf club head can also be referred to as the angle formed by the intersection of the centerline of the golf shaft and the playing surface when the sole of the golf club head is resting on the playing surface.

The term or phrase "integral" used herein can be defined as two or more elements if they are comprised of the same piece of material. As defined herein, two or more elements are "non-integral" if each element is comprised of a different piece of material.

The term or phrase "couple", "coupled", "couples", and "coupling" used herein can be defined as connecting two or more elements, mechanically or otherwise. Coupling (whether mechanical or otherwise) can be for any length of time, e.g. permanent or semi-permanent or only for an instant. Mechanical coupling and the like should be broadly understood and include mechanical coupling of all types. The absence of the word "removably," "removable," and the like near the word "coupled," and the like does not mean that the coupling, in question is or is not removable.

The term or phrase "head weight" or "head mass" used herein can be defined as the total mass or weight of the putter.

The term or phrase "attach", "attached", "attaches, and "attaching" used herein can be defined as connecting or being joined to something. Attaching can be permanent or semi-permanent. Mechanically attaching and the like should be broadly understood and include all types of mechanical attachment means. Integral attachment means should be broadly understood and include all types of integral attachment means that permanently connects two or more objects together.

The term or phrase "loft angle" used herein can be defined as the angle between the striking surface and the golf shaft. In other embodiments, the loft angle can be defined herein as such: the striking surface comprises a striking surface center point and a loft plane. The striking surface center point is equidistant from (1) the lower edge and upper edge of the strike face, as well as, (2) equidistant from the heel end and toe end of strike face. The loft plane is tangent to the strike surface of the putter type golf club head. The golf shaft comprises a centerline axis that extends the entire length of the golf shaft. The loft angle is between the centerline axis of the golf shaft and the loft plane of the putter. The loft angle of the putter-type golf club head can also be defined herein as the angle between the striking surface and the golf shaft (not shown) when a centerline of the golf shaft is generally vertical (i.e. forms a generally 90° angle with the playing surface).

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The term "center region" can be defined as the region on the striking surface that includes the geometric center. The center region can extend from the upper border of the striking surface to the lower border of the striking surface and have a heel-to-toe span of approximately 0.1 inch, 0.2 inch, 0.3 inch, 0.4 inch, 0.5 inch, 0.6 inch, 0.7 inch, 0.8 inch, 0.9 inch, 1.0 inch, 1.1 inch, 1.2 inch, 1.3 inch, 1.4 inch, 1.5 inch, 1.6 inch, 1.7 inch, 1.8 inch, 1.9 inch, or 2.0 inch.

The term "heel region" can be defined as the region on the striking surface that extends from the heel end of the striking surface (and/or club head) up to the center region heel side border. The term "toe region" can be defined as the region on the striking surface that extends from the toe end of the striking surface (and/or club head) up to the center region toe side border.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or ±10.0% of the related value(s), range(s) of values, relationship(s), parameter(s), or condition(s), as applicable.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Presented herein are putter-type golf club heads comprising a plurality of striking surfaces capable of achieving consistent ball speeds across the striking surface to account for various ball impact locations. In many embodiments, the putter-type golf club head described herein includes a putter body comprising a dual-material striking surface having a first material and a second material. The first and second material varies in concentration away from the geometric center of the striking surface in a heel-to-toe direction to provide consistent ball speeds.

For example, in many embodiments, the proportion (or relationship) between the first material and the second material differs to account for where the ball could impact the striking surface (i.e. towards the toe portion, towards the heel portion, or towards the center portion). Altering the striking surface material relationship directly correlates to the impact efficiency or ball speed produced between the golf club head and the golf ball upon impact.

1. Putter-Type Golf Club Heads

In many of the embodiments described herein, the golf club head is a putter-type golf club head. FIGS. 1-23 illustrates exemplary embodiments of putter-type golf club heads having a multi-material striking surface capable of controlling ball speeds across the striking surface, while accounting for impact feel and impact sound upon ball impact.

2. Loft Angle

In many embodiments, the putter-type golf club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, less than 5 degrees, less than 4 degrees, less than 3 degrees, or less than 2 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

3. Weight

In many embodiments, the putter-type golf club head can have a weight that ranges between 320 and 385 grams. In other embodiments, the putter-type golf club head can range between 320 grams-325 grams, 325 grams-330 grams, 330 grams-335 grams, 335 grams-340 grams, 340 grams-345 grams, 345 grams-350 grams, 350 grams-355 grams, 355 grams-360 grams, 360 grams-365 grams, 365 grams-370 grams, 370 grams-375 grams, 375 grams-380 grams, or 380 grams-385 grams. In some embodiments, the weight of the putter-type golf club head can be 320 grams, 321 grams, 322 grams, 323 grams, 324 grams, 325 grams, 326 grams, 327 grams, 328 grams, 329 grams, 330 grams, 331 grams, 332 grams, 333 grams, 334 grams, 335 grams, 336 grams, 337 grams, 338 grams, 339 grams, 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, 365 grams, 366 grams, 367 grams, 368 grams, 369 grams, 370 grams, 371 grams, 372 grams, 373 grams, 374 grams, 375 grams, 376 grams, 377 grams, 378 grams, 379 grams, 380 grams, 381 grams, 382 grams, 383 grams, 384 grams, or 385 grams.

4. Materials

The material of the putter-type golf club head can be constructed from any material used to construct a conventional club head. For example, the material of the putter-type golf club head can be constructed from any one or combination of the following: 8620 alloy steel, S25C steel, carbon steel, maraging steel, 17-4 stainless steel, 1380 stainless steel, 303 stainless steel, stainless steel alloys, or any metal or combination of metals for creating a golf club head. In other embodiments, the putter-type golf club heads can be constructed from non-metal materials such as a thermoplastic polyurethane material, a thermoplastic elastomer, and/or a thermoplastic composite material.

1. Composition and Setup of Putter-Type Golf Club Head

In many embodiments, the putter-type golf club head comprises a club head body (may also be referred to as "body" or "putter body"). The club head body comprises a toe portion, a heel portion, a top rail portion, a sole portion, a striking surface (or a portion of a striking surface), and a rear portion. The striking surface can provide a surface adapted for impact with a golf ball. The rear portion is rearwardly spaced from the striking surface. The sole portion is defined as being between the striking surface and the rear portion and resting on a ground plane (or playing surface) at an address position. The top rail can be formed opposite the sole portion. The striking surface is defined by the sole portion, the top rail portion, a heel portion and a toe portion, which is opposite the heel portion.

As mentioned above, in many embodiments, the putter-type golf club head can be configured to reside in the "address position". Unless other described or stated, the putter-type golf club head is in an address position for all reference measurements, ratios, and/or descriptive parameters. The address position can be referred to as being in a state where (1) the sole portion of the putter-type golf club head rests on the ground plane which contacts and is parallel to a playing surface and/or ground plane and (2) the striking surface is substantially perpendicular to the ground plane and/or playing surface.

2. Striking Surface

In many embodiments, the striking surface can be defined by at least the toe portion, the heel portion, the top rail portion, and the sole portion of the putter body. Further, as previously described, the striking surface can comprise of a multi-material striking surface. For example, the striking surface can include at least a first material and a second material that cooperate such that when a golf ball impacts the striking surface, the golf ball engages with two or more materials (i.e. a first material, a second material, etc.) having unique material characteristics to normalize ball speed across the club head while improving personal preference characteristics for a wide range of individuals (i.e. impact sound and/or impact feel).

In many embodiments, the first material can be softer, more flexible, and more deformable then the second material. In other embodiments, the second material can be harder, less flexible, and less deformable than the first material. In many embodiments, the second material can surround, border, or envelope the first material.

3. Material Characteristic of the First Material

The first material of the striking surface can vary based upon the selection of the second material, as the second material comprises the majority of the striking surface. In many embodiments, the first material can be defined by a predetermined material characteristic (but not limited to) the hardness, the tensile strength, the flexure modulus, or the specific gravity of the material.

The hardness of the first material is generally softer than the hardness of the second material. In many embodiments, the hardness of the first material can have a Shore A value that varies between 30 A and 95 A. In some embodiments, the hardness of the first material can have a Shore A hardness value between 30 A-40 A, 40 A-50 A, 50 A-60 A, 70 A-80 A, 80 A-90 A, or 90 A-95 A. In alternative embodiments, the hardness of the first material can have a Shore A hardness value between 30 A-35 A, 35 A-40 A, 40 A-45 A, 45 A-50 A, 50 A-55 A, 55 A-60 A, 60 A-65 A, 65 A-70 A, 70 A-75 A, 75 A-80 A, 80 A-85 A, 85 A-90 A, or 90 A-95 A. In additional embodiments, the hardness of the first material can have a Shore A less than 95 A, less than 90 A, less than 85 A, less than 80 A, less than 75 A, less than 70 A, less than 65 A, less than 60 A, less than 55 A, less than 50 A, less than 45 A, less than 40 A, or less than 35 A. In other embodiments, the hardness of the first material can have a Shore A hardness of 30 A, 31 A, 32 A, 33 A, 34 A, 35 A, 36 A, 37 A, 38 A, 39 A, 40 A, 41 A, 42 A, 43 A, 44 A, 45 A, 46 A, 47 A, 48 A, 49 A, 50 A, 51 A, 52 A, 53 A, 54 A, 55 A, 56 A, 57 A, 58 A, 59 A, 60 A, 61 A, 62 A, 63 A, 64 A, 65 A, 66 A, 67 A, 68 A, 69 A, 70 A, 71 A, 72 A, 73 A, 74 A, 75 A, 76 A, 77 A, 78 A, 79 A, 80 A, 81 A, 82 A, 83 A, 84 A, 85 A, 86 A, 87 A, 88 A, 89 A, 90 A, 91 A, 92 A, 93 A, 94 A, or 95 A.

The tensile strength of the first material is generally less than the tensile strength of the second material. The tensile strength of the first material can be between 0.5 MPa and 50 MPa. In many embodiments, the tensile strength of the first material can be between 0.5 MPa to 5.5 MPa, 5.5 MPa to 10.5 MPa, 10.5 MPa to 15.5 MPa, 15.5 MPa to 20.5 MPa, 20.5 MPa to 25.5 MPa, 25.5 MPa to 30.5 MPa, 30.5 MPa to 35.5 MPa, 35.5 MPa to 40 MPa, 40 MPa to 45.5 MPa, or 45.5 MPa to 50 MPa. In alternative embodiments, the tensile strength of the first material can be less than 50 MPa, less than 45 MPa, less than 40 MPa, less than 35 MPa, less than 30 MPa, less than 25 MPa, less than 20 MPa, less than 15 MPa, less than 10 MPa, or less than 5 MPa. In specific embodiments, the tensile strength of the first material can be approximately 0.5 MPa, approximately 5 MPa, approximately 10 MPa, approximately 15 MPa, approximately 20 MPa, approximately 25 MPa, approximately 30 MPa, approximately 35 MPa, approximately 40 MPa, approximately 45 MPa, or approximately 50 MPa.

The flexure modulus of the first material is generally lower than the flexure modulus of the second material. The flexure modulus of the first material can be between 0.5 MPa and 90 MPa. In many embodiments, the flexure modulus of the first material can be between 0.5 MPa and 5.5 MPa, 5.5 MPa and 10.5 MPa, 10.5 MPa to 15.5 MPa, 15.5 MPa to 20.5 MPa, 20.5 MPa to 25.5 MPa, 25.5 MPa to 30.5 MPa, 30.5 MPa to 35.5 MPa, 35.5 MPa to 40 MPa, 40 MPa to 45.5 MPa, 45.5 MPa to 50 MPa, 50 MPa to 55 MPa, 55 MPa to 60 MPa, 60 MPa to 65 MPa, 65 MPa to 70 MPa, 70 MPa to 75 MPa, 75 MPa to 80 MPa, 80 MPa to 85 MPa, or 85 MPa to 90 MPa. In alternative embodiments, the flexure modulus of the first material can be less than 90 MPa, less than 85 MPa, less than 80 MPa, less than 75 MPa, less than 70 MPa, less than 65 MPa, less than 60 MPa, less than 55 MPa, less than 50 MPa, less than 45 MPa, less than 40 MPa, less than 35 MPa, less than 30 MPa, less than 25 MPa, less than 20 MPa, less than 15 MPa, less than 10 MPa, or less than 5 MPa. In specific embodiments, the flexure modulus of the first material can be approximately 0.5 MPa, approximately 5 MPa, approximately 10 MPa, approximately 15 MPa, approximately 20 MPa, approximately 25 MPa, approximately 30 MPa, approximately 35 MPa, approximately 40 MPa, approximately 45 MPa, approximately 50 MPa, approximately 55 MPa, approximately 60 MPa, approximately 65 MPa, approximately 70 MPa, approximately 75 MPa, approximately 80 MPa, approximately 85 MPa, or approximately 90 MPa.

The specific gravity of the first material is generally lower (or can be the same) as the specific gravity of the second material. The specific gravity of the first material can be between 0.5 and 2. In many embodiments, the specific gravity of the first material can be between 0.5-0.75, 0.75-1, 1-1.25, 1.25-1.5, 1.5-1.75, or 1.75-2.0. In alternative embodiments, the specific gravity of the first material can be less than 2, less than 1.5, or less than 1.0.

The first material is generally comprised from a substantially non-metallic material and more preferably a polymeric material. For example, in many embodiments, the first material can be formed from an elastomer, a polyurethane, a thermoplastic elastomer, a thermoset elastomer, a thermoplastic polyurethane, a thermoset polyurethane, a viscoelastic material, a urethane, other polymers, other polymeric materials with doped metal portions, or combinations thereof. In many embodiments, the first material is selected from one of the categories listed above to satisfy one or more of the material characteristics listed above.

4. Material Characterization of the Second Material

The second material of the striking surface can vary based upon the selection of the first material, as the first material provides certain ball impact characteristics. In many embodiments, the second material can be defined by a predetermined material characteristic (but not limited to) the hardness, tensile strength, flexure modulus, and specific gravity of the material.

The hardness of the second material is generally harder than the hardness of the first material. In many embodiments, the hardness of the second material can have a Shore D value that varies between 60 D and 100 D. In some embodiments, the hardness of the second material can have a Shore D hardness value between 60 D-70 D, 70 D-80 D, 80 D-90 D, or 90 D-100 D. In alternative embodiments, the hardness of the second material can have a Shore D hardness between 60 D-65 D, 65 D-70 D, 70 D-75 D, 75 D-80 D, 80 D-85 D, 85 D-90 D, 90 D-95 D, or 95 D-100 D. In additional embodiments, the hardness of the second material can have a Shore D hardness greater than 60 D, greater than 65 D, greater than 70 D, greater than 75 D, greater than 80 D, greater than 85 D, greater than 90 D, greater than 95 D, or greater than 100 D. In other embodiments, the hardness of the second material can have a Shore D hardness of 60 D, 61 D, 62 D, 63 D, 64 D, 65 D, 66 D, 67 D, 68 D, 69 D, 70 D, 71 D, 72 D, 73 D, 74 D, 75 D, 76 D, 77 D, 78 D, 79 D, 80 D, 81 D, 82 D, 83 D, 84 D, 85 D, 86 D, 87 D, 88 D, 89 D, 90 D, 91 D, 92 D, 93 D, 94 D, 95 D, 96 D, 97 D, 98 D, 99 D, or 100 D.

The tensile strength of the second material is generally greater than the tensile strength of the first material. The tensile strength of the second material can be between 40 MPa and 1040 MPa. In many embodiments, the tensile strength of the second material can be between 40 MPa to 140 MPa, 140 MPa to 240 MPa, 240 MPa to 340 MPa, 340 MPa to 440 MPa, 440 MPa to 540 MPa, 540 MPa to 640 MPa, 640 MPa to 740 MPa, 840 MPa to 940 MPa, or 940 MPa to 1040 MPa. In alternative embodiments, the tensile strength of the second material can be greater than 40 MPa, greater than 140 MPa, greater than 240 MPa, greater than 340 MPa, greater than 440 MPa, greater than 540 MPa, greater than 640 MPa, greater than 740 MPa, greater than 840 MPa, greater than 940 MPa, or greater than 1040 MPa. In specific embodiments, the tensile strength of the second material can be approximately 41 MPa, 42 MPa, 43 MPa, 44 MPa, 45 MPa, 46 MPa, 47 MPa, 48 MPa, 49 MPa, 50 MPa, 51 MPa, 52 MPa, 53 MPa, 54 MPa, 55 MPa, 56 MPa, 57 MPa, 58 MPa, 59 MPa, 60 MPa, 61 MPa, 62 MPa, 63 MPa, 64 MPa, 65 MPa, 66 MPa, 67 MPa, 68 MPa, 69 MPa, or 70 MPa. In alternative embodiments, the tensile strength of the second material can be 141 MPa, 241 MPa, 341 MPa, 441 MPa, 541 MPa, 641 MPa, 741 MPa, 841 MPa, or 941 MPa.

The flexure modulus of the second material is generally higher than the flexure modulus of the first material. The flexure modulus of the second material can be between 0.5 MPa and 300 MPa. In many embodiments, the flexure modulus of the second material can be between 0.5 MPa and 5.5 MPa, 5.5 MPa and 10.5 MPa, 10.5 MPa to 15.5 MPa, 15.5 MPa to 20.5 MPa, 20.5 MPa to 25.5 MPa, 25.5 MPa to 30.5 MPa, 30.5 MPa to 35.5 MPa, 35.5 MPa to 40 MPa, 40 MPa to 45.5 MPa, 45.5 MPa to 50 MPa, 50 MPa to 55 MPa, 55 MPa to 60 MPa, 60 MPa to 70 MPa, 70 MPa to 75 MPa, 75 MPa to 80 MPa, 80 MPa to 85 MPa, 85 MPa to 90 MPa, 90 MPa to 100 MPa, 100 MPa to 110 MPa, 110 MPa to 120 MPa, 120 MPa to 130 MPa, 130 MPa to 140 MPa, 140 MPa to 150 MPa, 150 MPa to 160 MPa, 160 MPa to 170 MPa, 170 MPa to 180 MPa, 180 MPa to 190 MPa, 190 MPa to 200 MPa, 200 MPa to 210 MPa, 210 MPa to 220 MPa, 220 MPa to 230 MPa, 240 MPa to 250 MPa, 250 MPa to 260 MPa, 260 MPa to 270 MPa, 270 MPa to 280 MPa, 280 MPa to 290 MPa, or 290 MPa to 300 MPa. In alternative embodiments, the flexure modulus of the second material can be less than 300 MPa, less than 275 MPa, less than 250 MPa, less than 225 MPa, less than 200 MPa, less than 175 MPa, less than 150 MPa, less than 125 MPa, less than 100 MPa, less than 75 MPa, less than 50 MPa, or less than 25 MPa. In specific embodiments, the flexural modulus of the second material be approximately 0.6 MPa, 5.6 MPa, 10.6 MPa, 15.6 MPa, 20.6 MPa, 25.6 MPa, 30.6 MPa, 35.6 MPa, 40.1 MPa, 45.6 MPa, 50.1 MPa, 55.1 MPa, 60.1 MPa, 70.1 MPa, 75.1 MPa, 80.1 MPa, 85.1 MPa, 90.1 MPa, 100.1 MPa, 110.1 MPa, 120.1 MPa, 130.1 MPa, 140.1 MPa, 150.1 MPa, 160.1 MPa, 170.1 MPa, 180.1 MPa, 190.1 MPa, 200.1 MPa, 210.1 MPa, 220.1 MPa, 230.1 MPa, 240.1 MPa, 250.1 MPa, 260.1 MPa, 270.1 MPa, 280.1 MPa, or 290.1 MPa.

The specific gravity of the second material is generally greater (or the same as) than the specific gravity of the first material. The specific gravity of the second material can be between 0.5 and 13.5. In many embodiments, the specific gravity of the second material can be between 0.5-1.5, 1.5-2.5, 2.5-3.5, 3.5-4.5, 4.5-5.5, 5.5-6.5, 6.5-7.5, 7.5-8.5, 8.5-9.5, 9.5-10.5, 10.5-11.5, 11.5-12.5, or 12.5-13.5. In alternative embodiments, the specific gravity of the second material can be approximately 0.5, approximately 1.0, approximately 1.5, approximately 2.5, approximately 3.5, approximately 4.5, approximately 5.5, approximately 6.5, approximately 7.5, approximately 8.5, approximately 9.5, approximately 10.5, approximately 11.5, approximately 12.5, or approximately 13.5

The second material can be generally comprised from a substantially non-metallic material or metallic material. For example, in many embodiments, the second material can be formed from a non-metallic material (i.e. an elastomer, a polyurethane, a thermoplastic elastomer, a thermoset elastomer, a thermoplastic polyurethane, a thermoset polyurethane, a viscoelastic material, a urethane, other polymers, other polymeric materials with doped metal portions, or combinations thereof). In alternative embodiments, the second material can be constructed from a metal material. For example, the second material can be constructed from any one or combination of the following: 8620 alloy steel, S25C steel, carbon steel, maraging steel, 17-4 stainless steel, 1380 stainless steel, 303 stainless steel, stainless steel alloys, tungsten, aluminum, aluminum alloys, ADC-12, titanium, or titanium alloys. In many embodiments, the second material is selected from one of the categories listed above to satisfy one or more of the material characteristics listed above.

5. First and Second Material Arrangement

In many embodiments, the second material can define a plurality of recesses or voids that resemble any shape. The characteristics (i.e. geometry, shape, dimensions, and spacing distance) of the recesses or voids formed by the second material can vary to achieved desired performance, aesthetics, and feel attributes. For example, in many embodiments, the second material can define a plurality of discrete voids or recesses that generally define a pill shape, a hexagonal shape, a split hexagonal shape, a circular shape, a rectangular shape, a triangular shape, a pentagonal shape, an octagonal shape, a curvilinear shape, a diamond shape, and/or a trapezoidal shape. In alternative embodiments, the second material, can form continuous voids or recesses that can generally be defined by one or more continuous curvilinear groove(s), one or more continuous arcuate groove(s), one or more continuous arc like grooves, one or more continuous linear groove(s), or one or more combinations thereof.

The first material can be configured to fill, partially fill, reside, occupy and/or be complimentary with one or more of the plurality of discrete recesses or voids defined by the second material. For example, in many embodiments, the first material can partially or entirely fill one or more of the plurality of voids or recess described above. In alternative embodiments, the first material can fill, partially fill, reside, and/or be complimentary with one or more of the continuous voids or recesses mentioned above. In embodiments, where the first material partially fills the plurality of recesses or voids, air can occupy the remaining unfilled portion.

The first and second materials can be configured to cooperate with each other to create different material characteristic regions. In many embodiments, the center region of the striking surface can be softer than adjacent heel and toe regions. In alternative embodiments, the center region of the striking surface can be more flexible than adjacent heel and toe regions. In other embodiments, the center region of the striking surface can be more deformable than adjacent heel and toe regions. Creating a center region that is more flexible, deformable, softer, and/or less responsive than adjacent heel and/or toe regions creates more uniform ball speed and sensory feedback characteristics (i.e. impact sound, impact feel, impact feedback, etc) across the striking surface.

Creating a center region that is less responsive than the corresponding heel and toe regions can be accomplished in many ways. For example, in embodiments, where a first soft material dominates a less soft second material, a less responsive center region is formed. In other embodiments, a less responsive center region can be formed by controlling the void and/or recess patterns to form larger first material land areas at the center region than at adjacent heel and toe regions.

I. EMBODIMENTS

Continuous Grooves (Non-Insert Style Putter)

Figure 2:
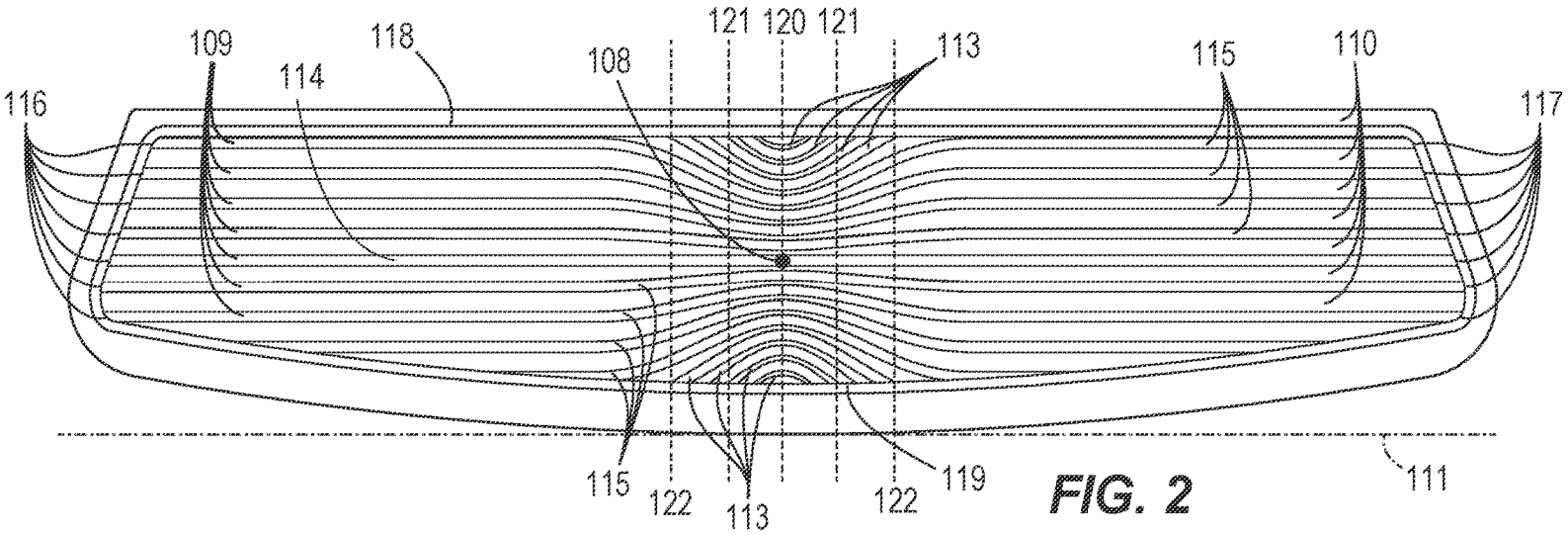
FIG. 2 shows a front view of the striking surface of FIG. 1.
Figure 3:
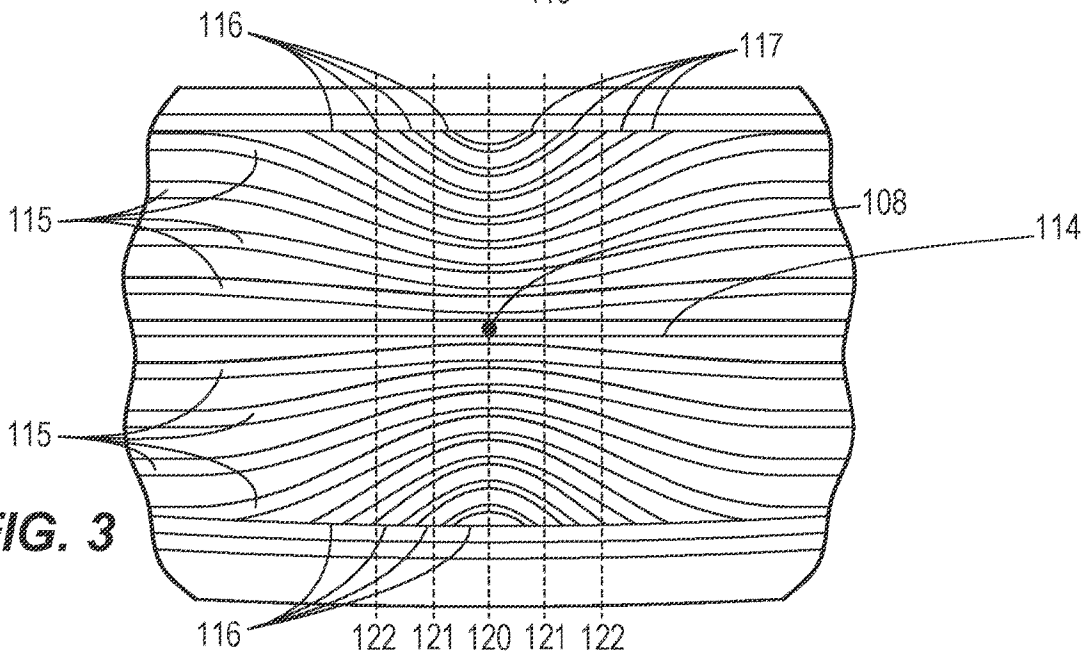
FIG. 3 shows a front detailed view of the striking surface of FIG. 2.

FIGS. 1-5 illustrate an exemplary embodiment. More particularly, FIGS. 1-3 illustrate an example of a putter-type golf club head 100 comprising a dual-material striking surface 107 having a first material 109 and a second material 110. The putter-type golf club head comprises a putter body 101 having a toe portion 102, a heel portion 103 opposite the toe portion 102, a top rail portion 104, a sole portion 105 opposite the top rail portion 104, a portion of a striking surface 107, and a rear portion 106 opposite the striking surface portion 107.

Further, FIGS. 1-3 illustrate the striking surface 107 of the putter body 100 forming a plurality of continuous groove recesses 112. These continuous groove recesses 112 can separate the striking surface 107 into second material land areas that form ball contact surfaces and continuous groove areas that form non-ball contact surfaces (upon golf ball impact). Through a combination of continuous recesses being entirely arcuate or having arcuate portions, the proportion of ball contact surfaces and non-ball contact surfaces can vary across the striking surface 107, yet create a consistent ball speed upon impact across the striking surface.

For example, FIG. 2 illustrates a possible arrangement where the arcuate portions of each the continuous groove recesses 112 are arranged to form a denser, more packed center region. This causes the center region to be less responsive to ball impacts than at areas (or regions) away from the center region (i.e. towards the heel or toe) as more continuous groove areas (non-ball contact surfaces) are present than ball contact surfaces. Additionally, to create a more densely packed center region towards the top rail and sole (at the center of the strike face), are entirely arcuate recesses (also referred to as semi-circle recesses) to increase the amount of continuous recesses (nonball contact surfaces). These semi-circle recesses are not present moving away from the center region and at the heel end and toe end. The arrangement can be progressive, or asymmetrically arranged from the center to the heel end and/or the center to toe end of the striking surface.

Moving away from the center region toward the heel or toe, the spacing distance between adjacent arcuate portions can gradually increase to introduce more ball contact surface. Increasing the amount of ball contact surfaces (in a heel-to-toe direction) creates a more responsive region when compared to the less responsive center region. As the response of the striking surface changes, this aids in creating a consistent ball speed across the striking surface.

Further, as previously mentioned, the golf club head 100 can be configured to reside in an "address position". The address position is the reference orientation of the golf club head for all reference measurements, ratios, and descriptive parameters described below. Specifically, FIG. 1 illustrates the putter-type golf club head 100 comprising a plurality of continuous groove recesses 112 defined by the putter body 101. In other words, the putter-type golf club head 100 is a non-insert style club head.

The plurality of continuous groove recesses 112 can resemble many shapes or geometries. For example, in this exemplary embodiment, the plurality of continuous groove recesses 112 can be defined by one or more continuous curvilinear groove recesses, one or more continuous arcuate groove recesses (may also be referred to as "continuous arc-like groove recesses"), one or more continuous linear groove recesses, and/or combinations thereof. In this specific embodiment, the putter-body 101 defines eight continuous arcuate groove recesses 113 (or arc-like grooves), one continuous linear groove recess 114, and eight continuous groove recesses 115 that define at least one linear portion and an arcuate portion.

In alternative embodiments of putter-type golf club heads having continuous groove recesses 112, the putter body can define one or more continuous arcuate groove recesses 113, two or more continuous arcuate groove recesses 113, three or more continuous arcuate groove recesses 113, four or more continuous arcuate groove recesses 113, five or more continuous arcuate groove recesses 113, six or more continuous arcuate groove recesses 113, seven or more continuous arcuate groove recesses 113, eight or more continuous arcuate groove recesses 113, nine or more continuous arcuate groove recesses 113, ten or more continuous arcuate groove recesses 113, or eleven or more continuous arcuate groove recesses 113.

In the same or alternative embodiments, the putter-type golf club head can define one or more continuous groove recesses that defines at least one linear portion and an arcuate portion 115, two or more continuous groove recesses that defines at least one linear portion and an arcuate portion 115, three or more continuous groove recesses that defines at least one linear portion and an arcuate portion 115, four or more continuous groove recesses that defines at least one linear portion and an arcuate portion 115, five or more continuous groove recesses that defines at least one linear portion and an arcuate portion 115, six or more continuous groove recesses that defines at least one linear portion and an arcuate portion 115, seven or more continuous groove recesses that defines at least one linear portion and an arcuate portion 115, eight or more continuous groove recesses that defines at least one linear portion and an arcuate portion 115, nine or more continuous groove recesses that defines at least one linear portion and an arcuate portion 115, ten or more continuous groove recesses that defines at least one linear portion and an arcuate portion 115, or eleven or more continuous groove recesses that defines at least one linear portion and an arcuate portion 115. In many embodiments, the arcuate portions of the continuous linear groove recesses are positioned between a first linear portion (proximal to the heel portion) and a second linear portion (proximal to the toe portion).

With continued reference to FIG. 2, each continuous groove recess of the plurality of continuous groove recesses 112 (although not required) comprises either (1) a first end 116 and a second end 117 that can be connected to an upper border 118 of the striking surface 107, (2) a first end 116 and a second end 117 that is connected to either the heel 103 or toe portion 102 of the striking surface, or (3) a first end 116 and a second end 117 that can be connected to the lower border 119 of the striking surface 107. This type of groove configuration permits the land area (or second material area) between the groove recesses to be finely adjusted without requiring the continuous recesses to vary in width. This aids in achieving a consistent ball speed across the striking surface 107.

In many embodiments, the plurality of continuous groove recesses can be symmetrical about the centerline axis of the entirely continuous linear groove recess 114 that extends from the heel portion 103 to the toe portion 102. Each of the plurality of continuous groove recesses between the entirely continuous linear groove recess 114 and the upper border 118 (proximal to the top rail 104 of the putter body 101) of the striking surface 107 can comprise arcuate portions and/or continuous arcuate groove recesses 113 that are concave up relative to the upper border 118 of the striking surface 107. Similarly, each of the plurality of continuous groove recesses between the entirely continuous linear groove recess 114 and the lower border 119 (proximal to the sole portion 105 of the putter body 101) of the striking surface 107 can comprise arcuate portions and/or continuous arcuate groove recesses that are concave down relative to the lower border 119 of the striking surface 107.

Each of the continuous groove recesses can have a constant width measured transversely in a top rail 104-to-sole 105 direction. In many embodiments, the width of each continuous groove recess can range between 0.020 inch to 0.040 inch. For example, the width of each continuous groove recess 112 can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, or approximately 0.040 inches.

In many embodiments, each arcuate portion and/or continuous arcuate groove recess 113 of the plurality of continuous groove recesses can have a maximum length (measured in a heel 103-to-toe 102 direction) that is between 1% and 50% of the maximum length of the striking surface 107. For example, each arcuate portion and/or continuous arcuate groove recess of the plurality of continuous groove recesses can have a maximum length that is greater than 1% of the striking surface 107, greater than 5% of the striking surface 107, greater than 10% of the striking surface 107, greater than 15% of the striking surface 107, greater than 20% of the striking surface 107, greater than 25% of the striking surface 107, greater than 30% of the striking surface 107, greater than 35% of the striking surface 107, greater than 40% of the striking surface 107, or greater than 45% of striking surface 107.

In the same or alternative embodiments, each arcuate portion or continuous arcuate groove recess 113 of the plurality of continuous groove recesses can have a maximum length that is less than 50% of the striking surface 107, less than 45% of the striking surface 107, less than 40% of the striking surface, less than 35% of the striking surface 107, less than 30% of the striking surface 107, less than 25% of the striking surface 107, less than 20% of the striking surface 107, less than 15% of the striking surface 107, or less than 10% of the striking surface 107.

In other embodiments, each arcuate portion or continuous arcuate groove recess 113 of the plurality of continuous groove recesses 112 can have a maximum length that is between approximately 1% and approximately 50% of the striking surface 107, between approximately 1% and approximately 45%, between approximately 1% and approximately 40%, between approximately 1% and 35%, between approximately 1% and approximately 30%, between approximately 1% and approximately 25%, or between approximately 1% and 20% of the maximum length of the striking surface 107.

In many embodiments to control the relationship (or ratio) between the first material 109 and the second material 110, the diameter and arc length of each arcuate groove portion and/or each continuous arcuate groove recess 113 increases in a direction from the upper border 118 to the entirely continuous linear groove recess 114. This can reduce the spacing distance (or second material area) between groove recesses in a heel-to-toe direction and/or top rail-to-sole direction. Similarly, in the same embodiment or other embodiments, the diameter and arc length of each arcuate portion and/or continuous arcuate groove recess increases in a direction from the lower border 119 to the entirely continuous linear groove recess 114. This can reduce the spacing distance (or second material area) between groove recesses in a heel-to-toe direction and/or top rail-to-sole direction. The configuration of each groove comprising arcuate portions and/or continuous arcuate grooves increasing in diameter and/or arc length from the upper border 118 to the entirely continuous linear groove 114 and from the lower border 119 to the entirely continuous linear groove 114 enables the groove recess to maintain a constant width while achieving a striking surface 107 that can control the ball speed across the striking surface 107 as the ratio of the first material 109 and second material varies 110.

In many of the continuous groove recess embodiments, when the club head is an address position, the striking surface 107 comprises a striking surface imaginary vertical axis 120 that extends through a geometric center 108 of the striking surface 107 in a top rail-to-sole direction (as shown by FIG. 2). Further, a total of five other vertical axes are shown in FIG. 3 (striking surface imaginary vertical reference axis 120, heel and toe vertical axes 121 at 0.25 inch from the center, and heel and toe vertical axes 122 at 0.5 inch from the center. These vertical axes 121, 122 are offset from the striking surface imaginary vertical axis in both a heel 103 and toe 102 direction at 0.25 inch and 0.50 inch.

As illustrated by FIG. 3, adjacent continuous grooves 112 are closer to one another (i.e. packed more closely, smaller land (or second material area) between groove recesses) along the striking surface imaginary vertical axis 120 than at the vertical reference axis at 0.25 inch 121 and 0.5 inch 122 (heel-to-toe direction) due to the groove recess spacing distance and arcuate portions. Similarly, adjacent continuous groove recess are closer to one another (i.e. packed more closely, small land area between grooves) at the vertical reference axis at 0.25 inch 121 than at the vertical reference axis at 0.5 inch 122.

Continuous Grooves (Insert Style Putter)

FIGS. 6-9 illustrate another exemplary embodiment. More particularly, FIGS. 6-9 illustrate an example of a putter-type golf club head 200 comprising a dual-material striking surface 207 having a first material 209 and a second material 210. The golf club head 200 of FIGS. 6-9 and the golf club head 100 of FIGS. 1-3 are similar in many respects, except for that the golf club head 200 is an insert style putter.

FIGS. 6-9 illustrate a two-piece putter insert 224 comprising a first material 209 (also referred to as "first part") and a second material 210 (also be referred to as "second part"). With specific reference to FIG. 6, the second part forms (or defines) a plurality of continuous groove voids 212 that separate the striking surface 207 into second material land areas. The first part of the putter insert 224 comprises a plurality of protruding geometries that are complimentary to a corresponding continuous groove void 212. By coupling the first part of the insert with the second part of the insert, the plurality of protruding geometries can be flush with the second material land areas (i.e. on the same surface or plane). Thereby, the plurality of protruding geometries can form first material land areas. The first material land areas and the second material land areas engage with at least a portion of the golf ball upon golf ball impact.

This embodiment illustrates a possible arrangement where the arcuate portions of each the continuous groove voids 212 are arranged to form a denser, more packed center region to create more first material land areas than second material land areas. Having a greater amount of first material land areas than second material land area aids in creating a center region that is less responsive to ball impacts than areas toward and at the heel end or toe ends. This arrangement can be progressive, or asymmetrically arranged from the center to heel end or center to toe end of the striking surface.

Moving away from the center region toward the heel or toe, the spacing distance between adjacent arcuate portions can increase thereby introducing more second material land areas. This spacing distance can be symmetrically progressive or asymmetrically progressive. This aids in creating a gradually more responsive region away from the center region towards the heel and toe regions. Creating a striking surface with different responses characteristic aids in controlling ball speeds more consistently across the striking surface.

Additionally, to create a more densely packed center region towards the top rail and sole at the center of the strike face are entirely arcuate recesses (also can be referred to as semi-circle grooves). This further increases the amount (or degree) of first material lands areas that not present moving away from the center and at the heel end and toe end.

The putter-type golf club head of FIGS. 6-9 comprises a putter-body 201 having a toe portion 202, a heel portion 203 opposite the toe portion 202, a top rail portion 204, a sole portion 205 opposite the top rail portion 204, a portion of a striking surface 207, and a rear portion 206 opposite the striking surface portion 207. The striking surface portion 207 further defines a striking surface recess 223 defined by the heel portion 203, the toe portion 202, the top rail portion 204, the sole portion 205, and the rear portion 206 of the putter body 201.

Figure 7:
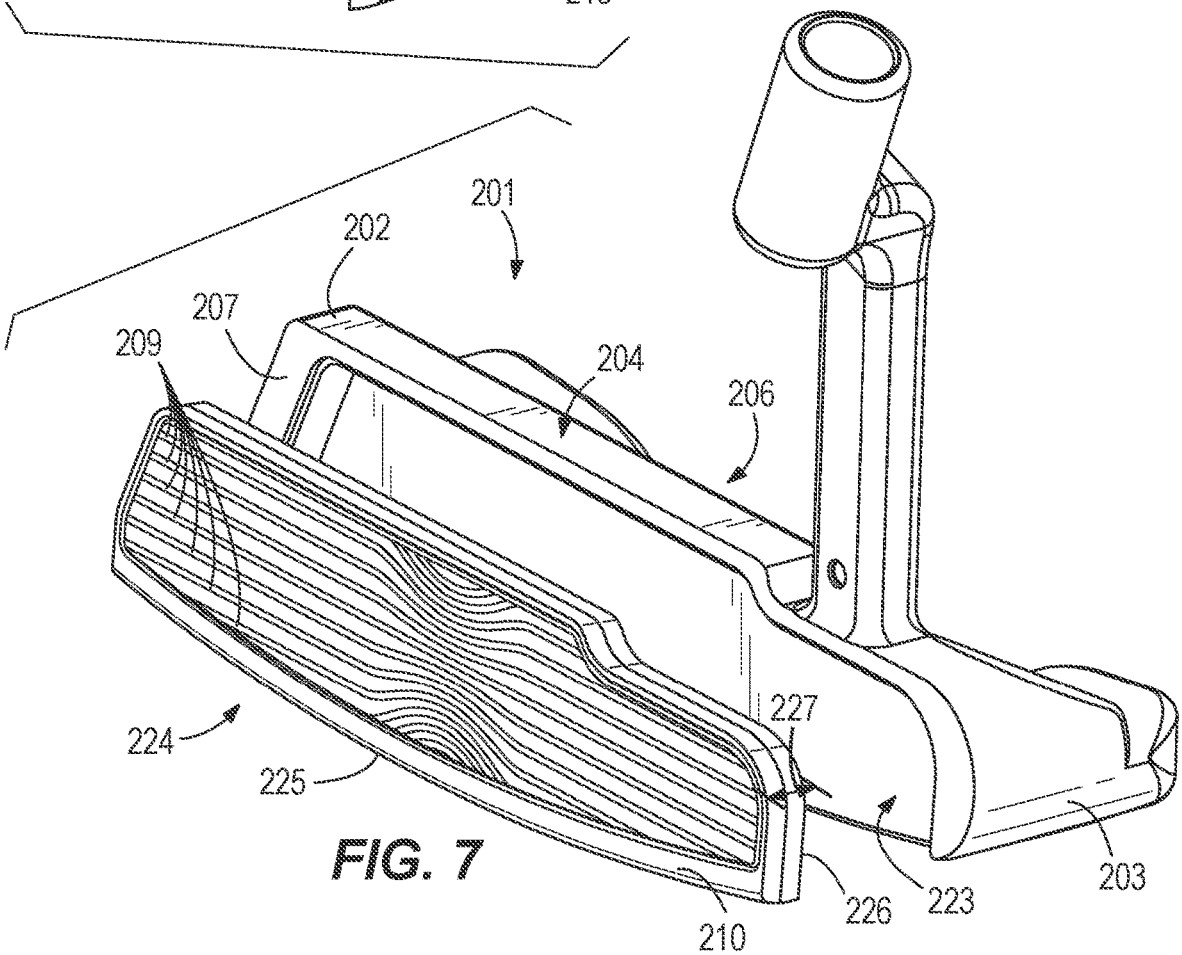
FIG. 7 shows a partially assembled view of a striking surface having continuous grooves of FIG. 6.
Figure 8:
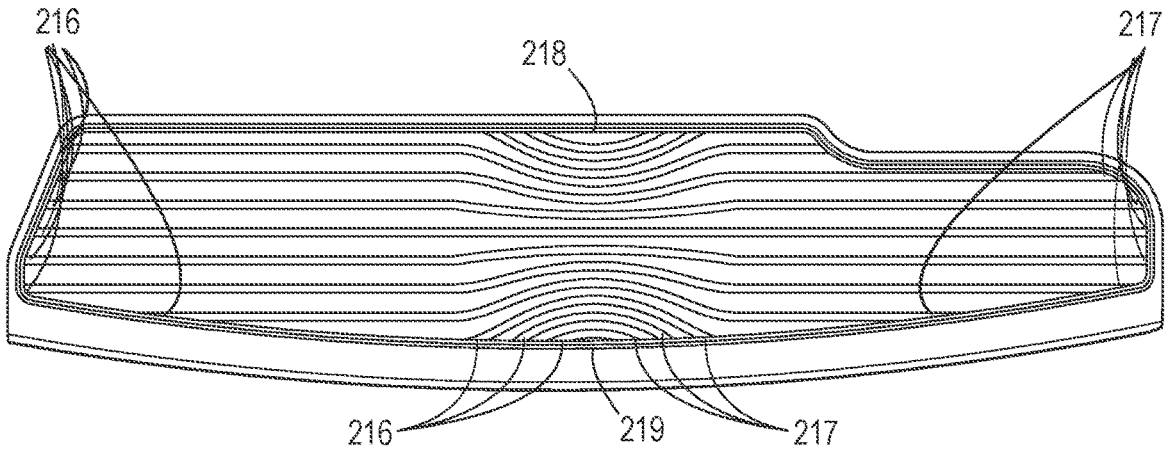
FIG. 8 shows a front view of the striking surface of FIG. 6.

Referencing FIG. 7, FIG. 7 illustrates a perspective view of a putter insert 224. In many embodiments, the putter insert 224 can be received within and complementary with the striking surface recess 223. Unlike the embodiment of FIGS. 1-3, where the putter body 201 defines the second material 210, the second 210 material and the first material 209 are a part of the putter insert 224 (i.e. distinct from the putter body 201).

Figure 6:
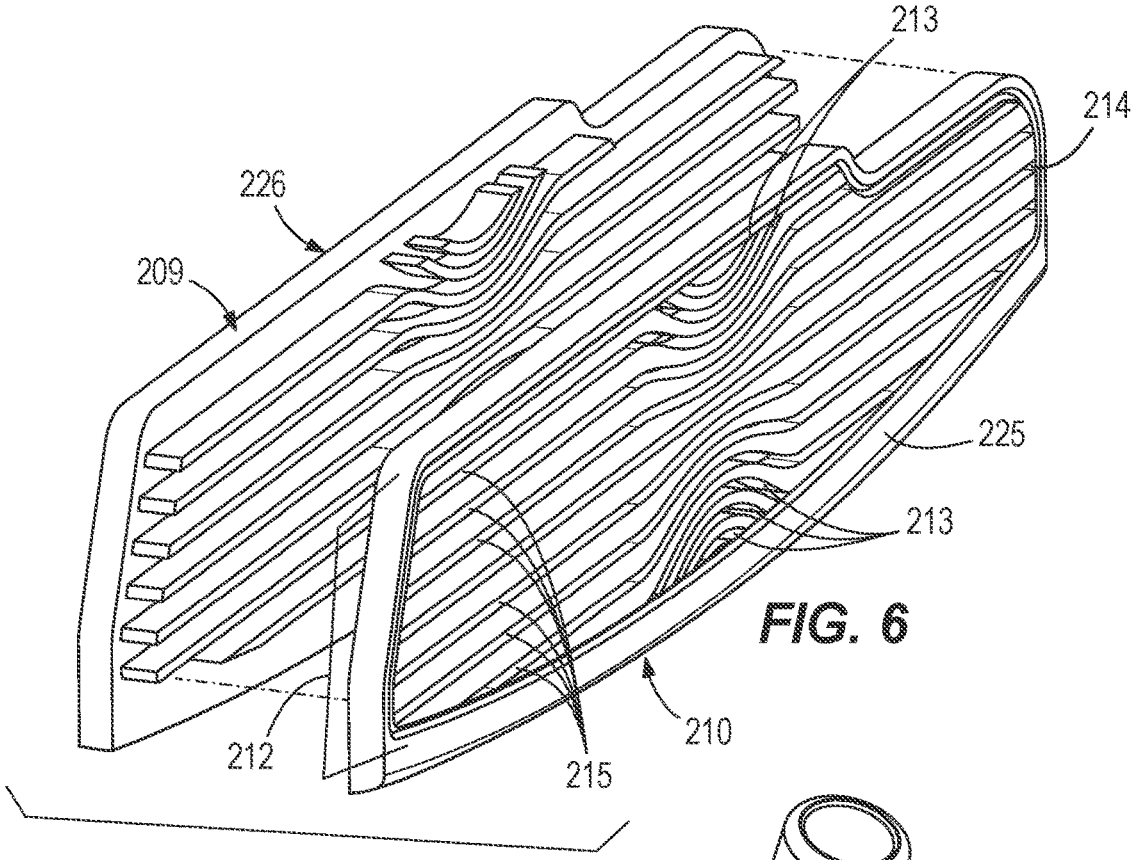
FIG. 6 shows an exploded view of a striking surface having continuous grooves for an insert style club head according to one embodiment.

The insert 224 can comprise of a front surface 225 adapted for impact with a golf ball (not shown) and a rear surface 226 opposite the front portion. A putter insert thickness 227 can be defined as the maximum perpendicular distance between the front surface 225 and the rear surface 226. For example, FIG. 6 illustrates the insert 224 having a plurality of continuous groove voids 212 (defined by the second material) extending entirely through the second material 210 thickness. In many embodiments, the first material, the second material, and/or the combination of the first and second material can be of a constant thickness.

Further, in many embodiments, the first material 209 entirely covers the rear surface 226 of the insert 224. In other words, the rear surface 226 is devoid of the second material 210. In many embodiments, the first material 209 further fully fills each continuous groove void (until flush with the front surface 225 of the insert) of the pluralities of continuous groove voids, so that at the front surface 225 the second material 210 surrounds the first material 209, and upon golf ball impact the first material 209 and the second material 210 are engaged to least a portion of the golf ball.

The plurality of continuous groove voids 212 defined by the putter insert 224 can resemble many shapes or geometries. For example, in this exemplary embodiment, the plurality of continuous groove voids 212 can be defined by one or more continuous curvilinear groove voids, one or more continuous arcuate groove voids (may also be referred to as "continuous arc-like groove voids"), one or more continuous linear groove voids, and/or combinations thereof. In this specific embodiment, the second material 210 defines five continuous arcuate groove voids 213 (or arc-like grooves), one continuous linear groove void 214, and six continuous groove voids 215 that define both a linear portion and an arcuate portion.

In alternative embodiments of putter-type golf club heads having continuous arcuate groove voids 213, the second material 210 can define (or forms) one or more continuous arcuate groove voids 213, two or more continuous arcuate groove voids 213, three or more continuous arcuate groove voids 213, four or more continuous arcuate groove voids 213, five or more continuous arcuate groove voids 213, six or more continuous arcuate groove voids 213, seven or more continuous arcuate groove voids 213, eight or more continuous arcuate groove voids 213, nine or more continuous arcuate groove voids 213, ten or more continuous arcuate groove voids 213, or eleven or more continuous arcuate groove voids 213.

In the same or other embodiments, the second material 210 can define one or more continuous groove voids that defines a linear portion and an arcuate portion 215, two or more continuous groove voids that defines a linear portion and an arcuate portion 215, three or more continuous groove voids that defines a linear portion and an arcuate portion 215, four or more continuous groove voids that defines a linear portion and an arcuate portion 215, five or more continuous groove voids that defines a linear portion and an arcuate portion 215, six or more continuous groove voids that defines a linear portion and an arcuate portion 215, seven or more continuous groove voids that defines a linear portion and an arcuate portion 215, eight or more continuous groove voids that defines a linear portion and an arcuate portion 215, nine or more continuous groove voids that defines a linear portion and an arcuate portion 215, ten or more continuous groove voids that defines a linear portion and an arcuate portion 215, or eleven or more continuous groove voids that defines a linear portion and an arcuate portion 215. In general, the arcuate portions of the continuous linear groove voids 215 are in between a first linear portion (proximal to the heel portion) and a second linear portion (proximal to the toe portion).

In many embodiments, each continuous groove void of the plurality of continuous groove voids (although not required) comprises either (1) a first end 216 and a second end 217 that can be connected to an upper border 218 of the striking surface 207, (2) a first end 216 and a second end 217 that can be connected to either the heel 203 or toe portion 202 of the striking surface, or (3) a first end 216 and a second end 217 that can be connected to the lower border 219 of the striking surface 207. This type of groove void arrangement permits the land area (or second material area 210) between the groove voids to be finely adjusted without requiring the continuous grooves voids to vary in width or thickness. This aids in achieving a consistent ball speed across the striking surface 207.

In some embodiments, the plurality of continuous groove voids are asymmetrical about the centerline axis of the entirely continuous linear groove void 214 that extends from the heel portion 203 to the toe portion 202. Each of the plurality of continuous groove voids between the entirely continuous linear groove 214 and the upper border 218 (proximal to the top rail 204 of the putter body 201) of the striking surface 207 can comprise arcuate portions and/or continuous arcuate groove voids 213 that are concave up relative to the upper border 218 of the striking surface 207. Similarly, each of the plurality of continuous groove voids between the entirely continuous linear groove void 214 and the lower border 219 (proximal to the sole portion 205 of the putter body 201) of the striking surface 207 can comprise arcuate portions and/or continuous arcuate groove voids that are concave down relative to the lower border 219 of the striking surface 207.

Each of the continuous groove voids can have a constant width measured transversely in a top rail 204-to-sole 205 direction. In many embodiments, the width of each continuous groove voids can range be between 0.020 inch to 0.040 inch. For example, the width of the continuous groove voids can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, or approximately 0.040 inches.

In many embodiments, each arcuate portion and/or continuous arcuate groove void 213 of the plurality of continuous groove voids can have a maximum length (measured in a heel 203-to-toe 202 direction) that is between 1% and 50% of the maximum length of the striking surface 207. For example, each arcuate portion and/or continuous arcuate groove void of the plurality of continuous groove voids can have a maximum length that is greater than 1% of the striking surface 207, greater than 5% of the striking surface 207, greater than 10% of the striking surface 207, greater than 15% of the striking surface 207, greater than 20% of the striking surface 207, greater than 25% of the striking surface 207, greater than 30% of the striking surface 207, greater than 35% of the striking surface 207, greater than 40% of the striking surface 207, greater than 45% of striking surface 207.

In the same or alternative embodiments, each arcuate portion or continuous arcuate groove void 213 of the plurality of continuous groove voids can have a maximum length that is less than 50% of the striking surface 207, less than 45% of the striking surface 207, less than 40% of the striking surface, less than 35% of the striking surface 207, less than 30% of the striking surface 207, less than 25% of the striking surface 207, less than 20% of the striking surface 207, less than 15% of the striking surface 207, or less than 10% of the striking surface 207.

In other embodiments, each arcuate portion or continuous arcuate groove void 213 of the plurality of continuous groove voids can have a maximum length that is between approximately 1% and approximately 50% of the striking surface 207, between approximately 1% and approximately 45%, between approximately 1% and approximately 40%, between approximately 1% and 35%, between approximately 1% and approximately 30%, between approximately 1% and approximately 25%, or between approximately 1% and 20% of the maximum length of the striking surface 207.

In many embodiments to control the relationship (or ratio) between the first material 209 and the second material 210, the diameter and arc length of each arcuate groove portion and/or each continuous arcuate groove 213 increases in a direction from the upper border 218 to the entirely continuous linear groove 214. to create less land areas (or second material land areas) between continuous groove voids at the center region. In the same embodiment or other embodiments, the diameter and arc length of each arcuate portion and/or continuous arcuate grooves increases in a direction from the lower border 219 to the entirely continuous linear groove 214 to create less second material land area areas between continuous groove voids at the center region The configuration of each continuous groove voids comprising arcuate portions and/or continuous arcuate groove voids increasing in diameter and/or arc length from the upper border 218 to the entirely continuous linear groove void 214 and from the lower border 219 to the entirely continuous linear groove void 214 enables the groove voids to have a constant width and depth while achieving a striking surface 207 that can control the ball speed across the striking surface 207.

Figure 9:
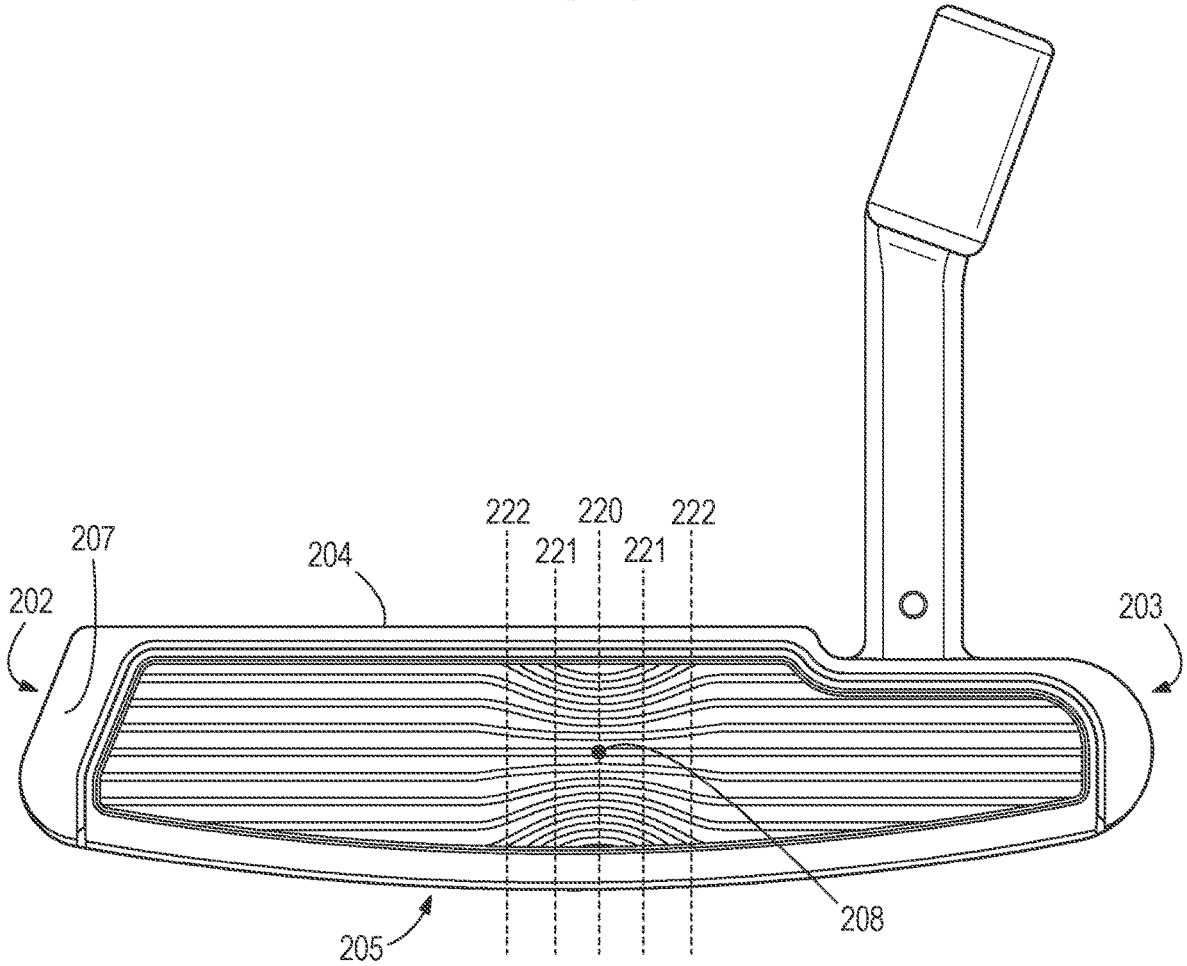
FIG. 9 shows a front view of the striking surface of FIG. 7.

In many of the continuous groove void embodiments, when the club head is an address position the striking surface comprises a striking surface imaginary vertical axis 220 that extends through a geometric center 208 of the striking surface 207 in a top rail-to-sole direction (as shown by FIG. 9). Further, offset from the striking surface imaginary vertical axis in both a heel 203 and toe 202 direction at 0.25 inch and 0.50 inch are corresponding vertical reference axes.

As further illustrated in FIG. 9, adjacent continuous groove voids are closer to one another (i.e. packed more closely, creating small land areas (or smaller second material land areas) between continuous grooves voids) along the striking surface imaginary vertical axis 220 than at the vertical reference axis of 0.25 inch 221 and 0.5 inch 222. Similarly, adjacent continuous groove voids are closer to one another (i.e. packed more closely, smaller land (or second material) area between groove voids) at the vertical reference axis of 0.25 inch 221 than at the vertical reference axis of 0.5 inch 222.

In many of the continuous groove void embodiments, the percentage of the first material (or first material land area) along the 0.5-inch vertical reference axis 222 can between approximately 20% and 40%. For example, the percentage of the first material land area along the 0.5 inch vertical reference axis 222 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material land area along the 0.5 inch vertical reference axis 222 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material land area along the 0.5 inch vertical reference axis 222 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the continuous groove embodiments, the percentage of the first material (or first material land area) along the 0.25-inch vertical reference axis 221 can be between approximately 30% and 50%. For example, the percentage of the first material along the 0.25 inch vertical reference axis 221 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material land area along the 0.25 inch vertical reference axis 221 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material land area along the 0.25 inch vertical reference axis 221 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the continuous groove embodiments, the percentage of the first material (or the first material land area) along the striking surface imaginary axis 220 can between approximately 40% and 60%. For example, the percentage of the first material along the striking surface imaginary axis 220 can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material along the striking surface imaginary axis 220 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material along the striking surface imaginary axis 220 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area to the surface area of the second material land area (measured in a top rail-to-sole direction) decreases from the striking surface imaginary vertical axis 220 to the 0.5-inch vertical reference axis 222. This type of arrangement of the first material and the second material aid in providing consistent ball speeds across the striking surface as the average ratio along the striking surface imaginary vertical axis is greater (i.e. softer) than the average ratio along the 0.5 inch vertical reference axis (i.e. harder). This counteracts the loss of energy transfer on heel and toe mishits.

Discrete Voids (Pill Shape)

FIGS. 10-13 illustrate another exemplary embodiment. More particularly, FIGS. 10-13 illustrate an example of a putter-type golf club head 300 comprising a dual-material striking surface 307 comprising a first material 309 and a second material 310. The golf club head 300 of FIGS. 10-13 and the golf club head 200 of FIGS. 6-9 are similar in many respects, except for that the golf club head 300 comprises discrete voids that extend in a heel-to-toe direction rather than continuous voids and/or recesses. The discrete voids generally have a greater length proximate the center region of the striking surface 307 than towards the heel and/or toe. In many embodiments, the discrete voids are substantially the same width.

Figure 10:
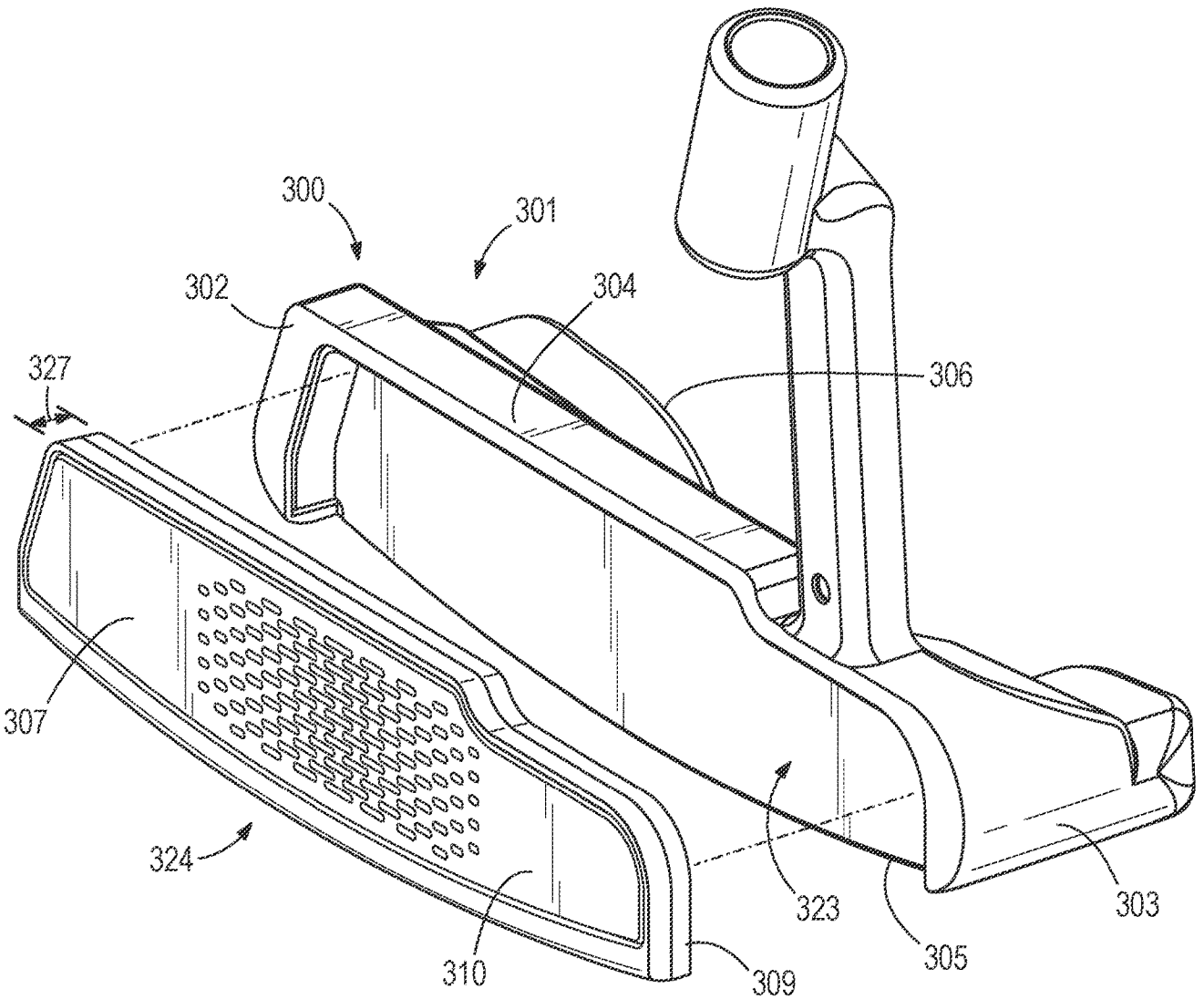
FIG. 10 shows a partially assembled view of a striking surface having discrete pill shaped voids for an insert style club head according to one embodiment.

FIG. 10 illustrates a putter-type golf club head 300 comprising a putter-body 301 having a toe portion 302, a heel portion 303 opposite the toe portion 302, a top rail portion 304, a sole portion 305 opposite the top rail portion 304, a portion of a striking surface 307, and a rear portion 306 opposite the striking surface portion 307. The striking surface portion 307 can further define a striking surface recess 323 defined by the heel portion 303, the toe portion 302, the top rail portion 304, the sole portion 305, and the rear portion 306 of the putter body 301.

FIGS. 10-13 illustrate a two-part putter insert 324 comprising a first material 309 (also referred to as "first part") and a second material 310 (also referred to as "second part"). With specific reference to FIG. 10, the second part forms (or defines) a plurality of discrete pill shaped voids 312. These discrete pill shaped voids are arranged in rows and columns and do not connect or touch another pill shaped void.

The second part surrounds the pill shaped voids to form second material land areas. The first part of the putter insert 324 comprises a plurality of protruding pill shaped geometries that are complimentary to a corresponding discrete pill shaped void 212. By coupling the first part and the second part together, the plurality of protruding discrete pill shaped voids can be flush with the second material land areas. Thereby, the plurality of protruding discrete pill shaped voids can form first material land areas. The first material land areas and the second material land engage with at least a portion of the golf ball upon golf ball impact. The first material has a hardness less than the second material.

This embodiment illustrates a possible arrangement where variable length pill shaped voids are arranged to form a denser, more packed center region creating more first material land areas than second material land areas. Referencing FIG. 12, it can be seen that in any given row the pill shaped voids having the greatest lengths are proximate to the center region and the pill shaped voids having the smallest lengths are proximate the heel and toe ends. This arrangement creates a center region having a greater amount of first material land areas than second material land area (which creates a center region that is less responsive to ball impacts than areas toward and at the heel end or toe ends). In a top rail to sole direction, the first material land areas and the second material land areas are substantially the same or constant. Therefore, the first material land area only varies in a heel to toe direction and not a top rail to sole direction.

Moving away from the center region toward the heel or toe along a given row, the spacing distance between adjacent discrete pill shaped voids increases (i.e. the length of the discrete pills shaped voids decrease. This creates more second material land areas, which aids in gradually creating a more responsive region away from the center region towards the heel and toe regions to consistently control ball speeds across the striking surface.

Figure 11:
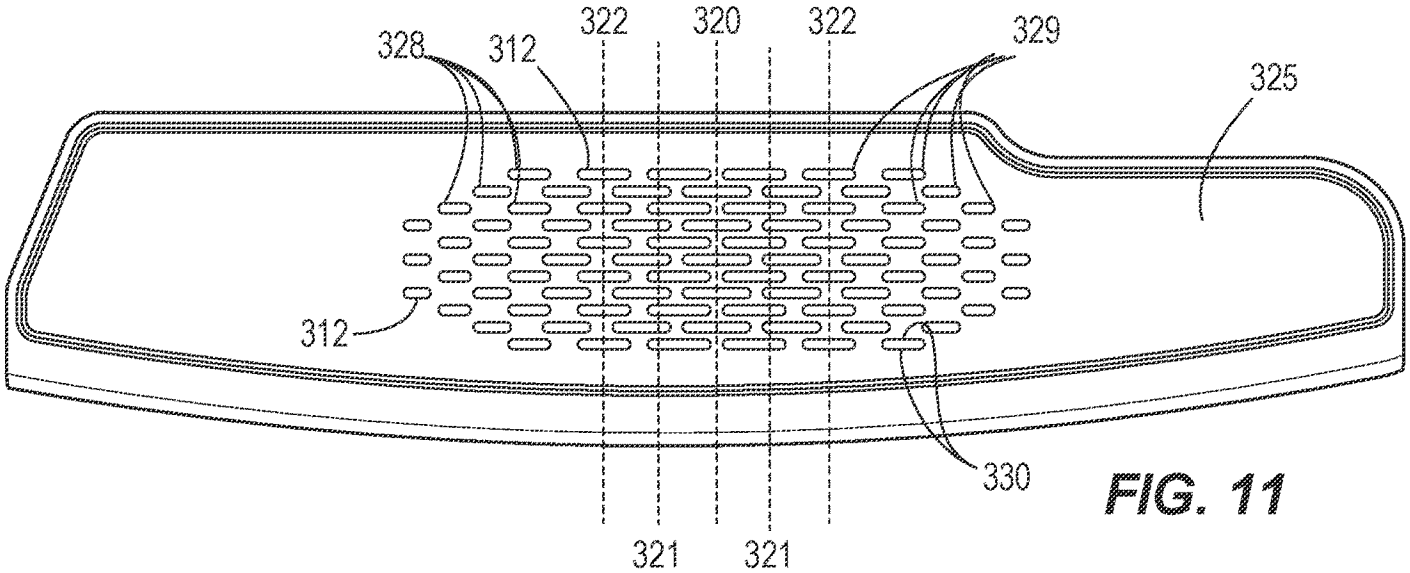
FIG. 11 shows a front view of the striking surface of FIG. 10.
Figure 12:
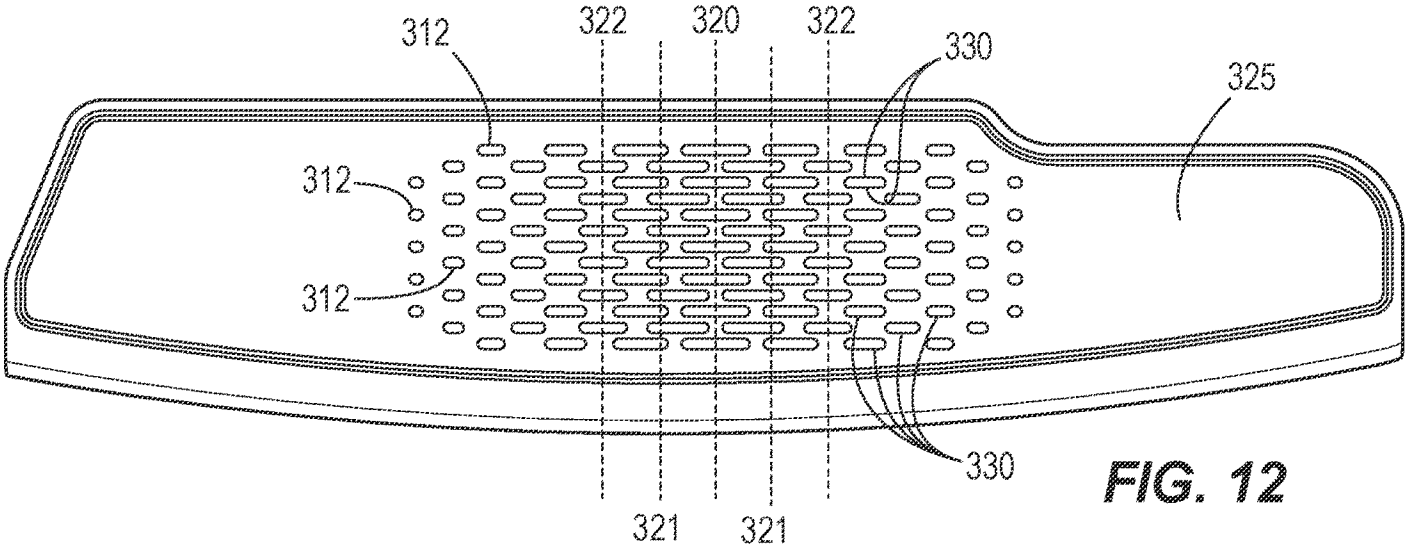
FIG. 12 shows a front view of a striking surface having discrete pill shaped voids for an insert style club head according to one embodiment.
Figure 13:
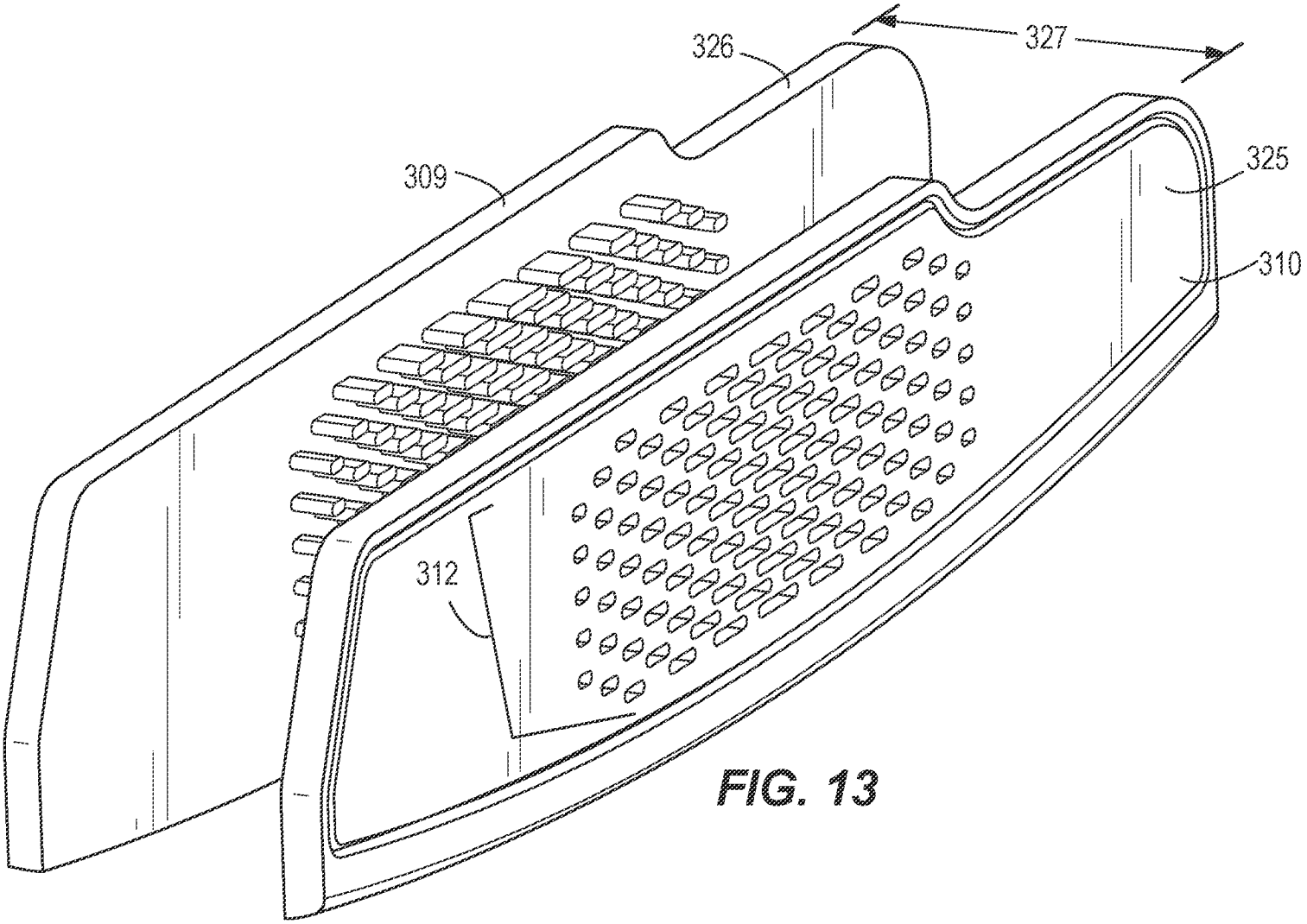
FIG. 13 shows an exploded view of the striking surface of FIG. 12.

FIGS. 11-13 illustrates various putter inserts 324 comprising discrete pill shaped voids. In many embodiments, the putter insert 324 can be received within and complementary with the striking surface recess 323. However, it should be noted in alternative embodiments, the putter-type golf club head 300 need not to be an insert style putter.

FIG. 13 illustrates an exploded view of the putter insert 324 comprising discrete pill shaped voids. The insert 324 can comprise of a front surface 325 adapted for impact with a golf ball (not shown) and a rear surface 326 opposite the front portion. A putter insert thickness (or depth) 327 can be defined as the maximum perpendicular distance between the front surface 325 and the rear surface 326. For example, FIG. 13 illustrates the insert 324 having a plurality of discrete pill shaped voids 312 (defined by the second material) extending entirely through the second material 310 thickness (or depth).

Further, in many embodiments, the first material 309 can entirely cover the rear surface 326 of the insert 324. In other words, the rear surface 326 is devoid of the second material 310. In many embodiments, the first material 309 further fills each of the discrete pill shaped voids 312 (until flush with the front surface 325 of the insert) of the pluralities of discrete pill shaped voids, so that at the front surface 325 the second material 310 surrounds the first material 309 and upon golf ball impact the first material 309 and the second material 310 can engage to least a portion of the golf ball.

Each discrete pill shaped void can have a first end 328 (proximal to the toe) forming an arcuate geometry and a second end 329 (proximal to the heel) forming an arcuate geometry. In many embodiments, the first 328 and second end 329 geometry can be curvilinear, circular, semicircular, crescent like, bow shape, curved, or rounded. The first end 328 and second end 329 can be connected by parallel horizontal segments 330 that extend substantially in a heel-to-toe direction.

The maximum length of each discrete pill shaped void 312 (measured in a heel-to-toe direction) can vary in a heel-to-toe direction. In many embodiments, the maximum length of each discrete pill shaped 312 void can be between 0.02 inches and 0.36 inches. For example, the maximum length of each of the plurality of discrete pill shaped voids 312 can be between 0.02 inches-0.36 inches, 0.04 inches-0.36 inches, 0.06 inches-0.36 inches, 0.08 inches-0.36 inches, 0.10 inches-0.36 inches, 0.12 inches-0.36 inches, 0.14 inches-0.36 inches, 0.16 inches-0.36 inches, 0.18 inches-0.36 inches, 0.20 inches-0.36 inches, 0.22 inches-0.36 inches, 0.24 inches-0.36 inches, 0.26 inches-0.36 inches, or 0.28 inches-0.36 inches. In other embodiments, the maximum length of each discrete pill shaped void 312 can vary between 0.06 inch and 0.180 inch.

The maximum width of each discrete pill shaped void 312 of the plurality of pill shaped voids (measured in a top rail-to-sole direction) can remain the same or substantially constant. In many embodiments, the maximum width of each discrete pill shaped void 312 can be between 0.01 inches and 0.3 inches. For example, the maximum width of each discrete pill shaped void 312 can be greater than 0.01 inches, greater than 0.02 inches, greater than 0.03 inches, greater than 0.04 inches, greater than 0.05 inches, greater than 0.06 inches, greater than 0.07 inches, greater than 0.08 inches, greater than 0.09 inches, greater than 0.10 inches, greater than 0.11 inches, greater than 0.12 inches, greater than 0.13 inches, greater than 0.14 inches, greater than 0.15 inches, greater than 0.16 inches, greater than 0.17 inches, greater than 0.18 inches, greater than 0.19 inches, greater than 0.20 inches, greater than 0.21 inches, greater than 0.22 inches, greater than 0.23 inches, greater than 0.24 inches, greater than 0.25 inches, greater than 0.26 inches, greater than 0.27 inches, greater than 0.28 inches, or greater than 0.29 inches.

In other embodiments, the maximum width of each discrete pill shaped void 312 can be less than 0.30 inches, less than 0.29 inches, less than 0.28 inches, less than 0.27 inches, less than 0.26 inches, less than 0.25 inches, less than 0.24 inches, less than 0.23 inches, less than 0.22 inches, less than 0.21 inches, less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, less than 0.10 inches, less than 0.09 inches, less than 0.08 inches, less than 0.07 inches, less than 0.06 inches, less than 0.05 inches, less than 0.04 inches, less than 0.03 inches, or less than 0.02 inches.

In the same or other discrete pill shaped void 312 embodiments, the plurality of discrete pill shaped voids 312 can be positioned in substantially horizontal rows and/or substantially vertical columns. In the exemplary embodiment of FIG. 11, the plurality of discrete pill shaped voids are arranged to form eleven rows and seventeen columns. In the embodiment of FIG. 12, the plurality of discrete pill shaped voids are arranged to form thirteen rows and seventeen columns. In alternative embodiments, the plurality of discrete pill shaped voids can be arranged to form two or more rows, three or more rows, four or more rows, five or more rows, six or more rows, seven or more rows, eight or more rows, nine or more rows, ten or more rows, eleven or more rows, twelve or more rows, thirteen or more rows, fourteen or more rows, fifteen or more rows, sixteen or more rows, seventeen or more rows, eighteen or more rows, nineteen or more rows, or twenty or more rows. In the same or alternative embodiments, the plurality of discrete pill shaped voids can be arranged to form two or more columns, three or more columns, four or more columns, five or more columns, six or more columns, seven or more columns, eight or more columns, nine or more columns, ten or more columns, eleven or more columns, twelve or more columns, thirteen or more columns, fourteen or more columns, fifteen or more columns, sixteen or more columns, seventeen or more columns, eighteen or more columns, nineteen or more columns, or twenty or more columns. As will be further described below, aligning the pill shaped voids 312 in rows and columns permits the appropriate ratio between the first and second material along a vertical reference axis.

As can be seen in the exemplary embodiment of FIGS. 10-13, each of the plurality of discrete pill shaped voids 312 are spaced from one another in both a heel-to-toe direction and a top rail-to-sole direction. This is dissimilar from the continuous groove or recesses embodiments of FIGS. 1-9 which are continuously connected in the heel-to-toe direction. Each row or column can have two or more discrete pill shaped voids, three or more discrete pill shaped voids, four or more discrete pill shaped voids, five or more discrete pill shaped voids, six or more discrete pill shaped voids, seven or more discrete pill shaped voids, eight or more discrete pill shaped voids, nine or more discrete pill shaped voids, ten or more discrete pill shaped voids, eleven or more discrete pill shaped voids, twelve or more discrete pill shaped voids, thirteen or more discrete pill shaped voids, fourteen or more discrete pill shaped voids, fifteen or more discrete pill shaped voids, sixteen or more discrete pill shaped voids, seventeen or more discrete pill shaped voids, eighteen or more discrete pill shaped voids, nineteen or more discrete pill shaped voids, or twenty or more discrete pill shaped voids.

The volume of the first material 309 that fills each discrete pill shaped void 312 can vary in a heel-to-toe direction. In many embodiments, first material 309 can fill a volume between 0.0000803 $in^3$-0.00104122 $in^3$. In some embodiments, the first material 309 can fill a volume between 0.0000803 $in^3$-0.00104122 $in^3$, 0.000176 $in^3$-0.00104122 $in^3$, 0.000272 $in^3$-0.00104122 $in^3$, 0.000368 $in^3$-0.00104122 $in^3$, 0.000464 $in^3$-0.00104122 $in^3$, 0.00056 $in^3$-0.00104122 $in^3$, 0.00065 $in^3$-0.00104122 $in^3$, 0.0075 $in^3$-0.0010422 $in^3$, 0.000849 $in^3$-0.0010422 $in^3$, or 0.000945 $in^3$-0.00104 $in^3$. In other embodiments, the first material 309 can fill a volume between 0.000160 $in^3$-0.00052061 $in^3$. Having the first material 309 fill discrete voids of this size more accurately controls the adjustment resolution between the first material and the second material to create a consistent ball speed across the striking surface and enhanced impact feel and sound.

In many of the discrete pill shaped void embodiments, when the club head is in an address position the striking surface comprises a striking surface imaginary vertical axis 320 that extends through a geometric center 308 of the striking surface 307 in a top rail-to-sole direction (as shown by FIGS. 11 and 12). Further, offset from the striking surface imaginary vertical axis in both a heel 303 and toe 302 direction at 0.25 inch and 0.50 inch are corresponding vertical reference axes 321, 322.

As further illustrated in FIGS. 11 and 12, adjacent discrete pill shaped voids 312 are closer to one another (i.e. packed more closely, small (second material) land area between discrete voids) along the striking surface imaginary vertical axis 320 in both a horizontal and vertical direction than at the vertical reference axis of 0.25 inch 321 and 0.5 inch 322. Similarly, adjacent discrete pill shaped voids 312 are closer to one another (i.e. packed more closely, smaller land (or second material) area in both a horizontal and vertical direction between discrete pill shaped voids 312) at the vertical reference axis of 0.25 inch 321 than at the vertical reference axis of 0.5 inch 322.

In many of the discrete pill shaped voids embodiments, the percentage of the first material 309 (or first material land area) along the 0.5-inch vertical reference axis 322 can be between approximately 20% and 40%. For example, the percentage of the first material 309 along the 0.5 inch vertical reference axis 322 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis 322 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 309 along the 0.5 inch vertical reference axis 322 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the discrete pill shaped voids embodiments, the percentage of the first material 309 along the 0.25-inch vertical reference axis 321 can be between approximately 30% and 50%. For example, the percentage of the first material 309 along the 0.25 inch vertical reference axis 321 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material 309 along the 0.25 inch vertical reference axis 321 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 309 along the 0.25 inch vertical reference axis 321 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete pill shaped voids embodiments, the percentage of the first material 309 along the striking surface imaginary axis 320 can between approximately 40% and 60%. For example, the percentage of the first material 309 along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 309 along the striking surface imaginary axis 320 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material 309 along the striking surface imaginary axis 320 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage 309 to the surface area of the second material land area percentage 310 (measured along a respective vertical references axis) decreases from the striking surface imaginary vertical axis 320 to the 0.5-inch vertical reference axis 322. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Additionally, in this exemplary embodiment, variable width, variable thickness, and/or even variable depth discrete voids are not needed to create consistent ball speeds across the striking surface. Consistent ball speeds are achieved as the discrete pill shaped voids vary in length (in a heel-to-toe direction) creating differing first and second material ratios measured along in a top rail-to-sole direction.

Discrete Voids (Hexagonal Shape)

Figure 14:
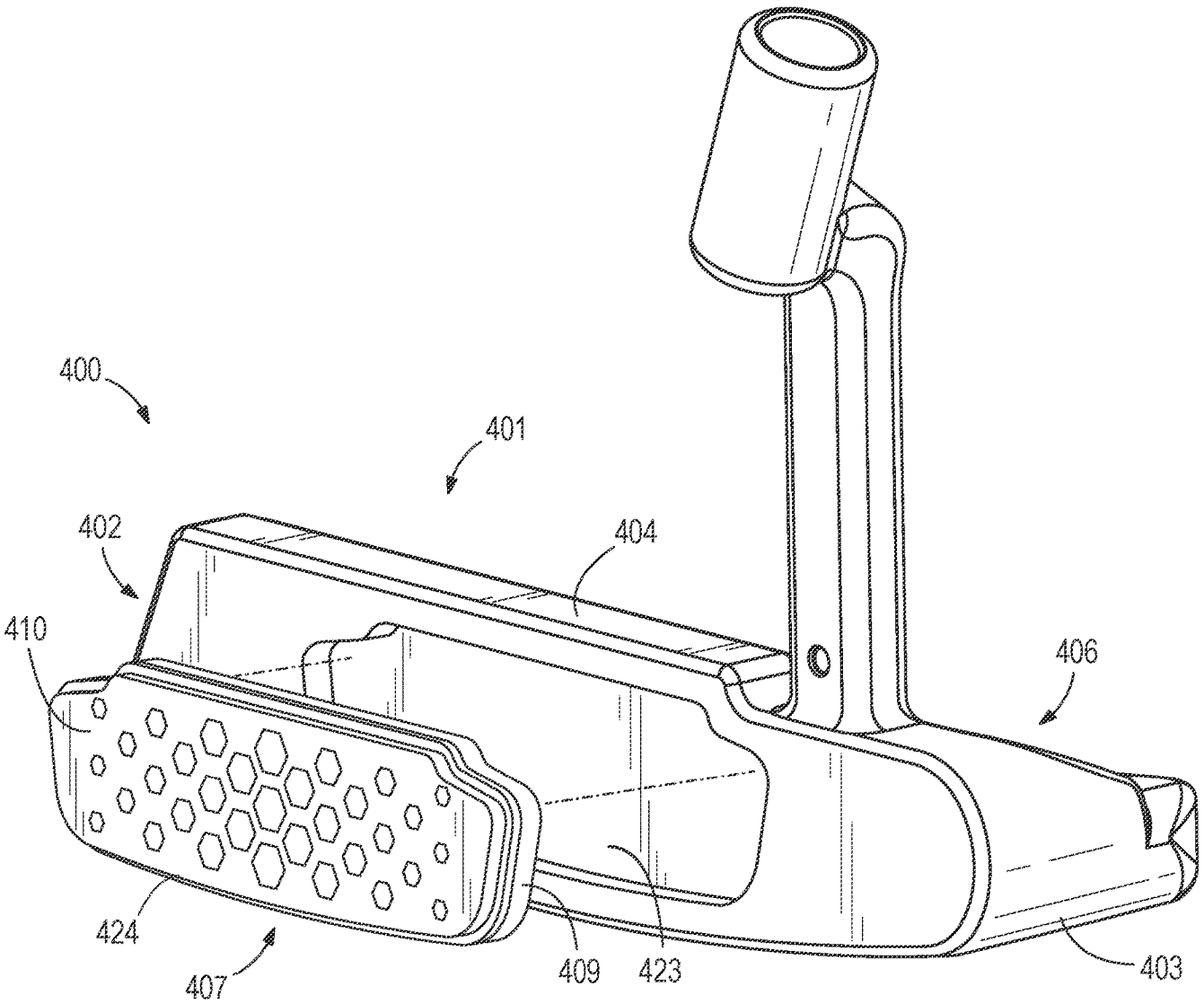
FIG. 14 shows a partially assembled view of a striking surface having discrete hexagonal shaped voids for an insert style club head according to one embodiment.
Figure 15:
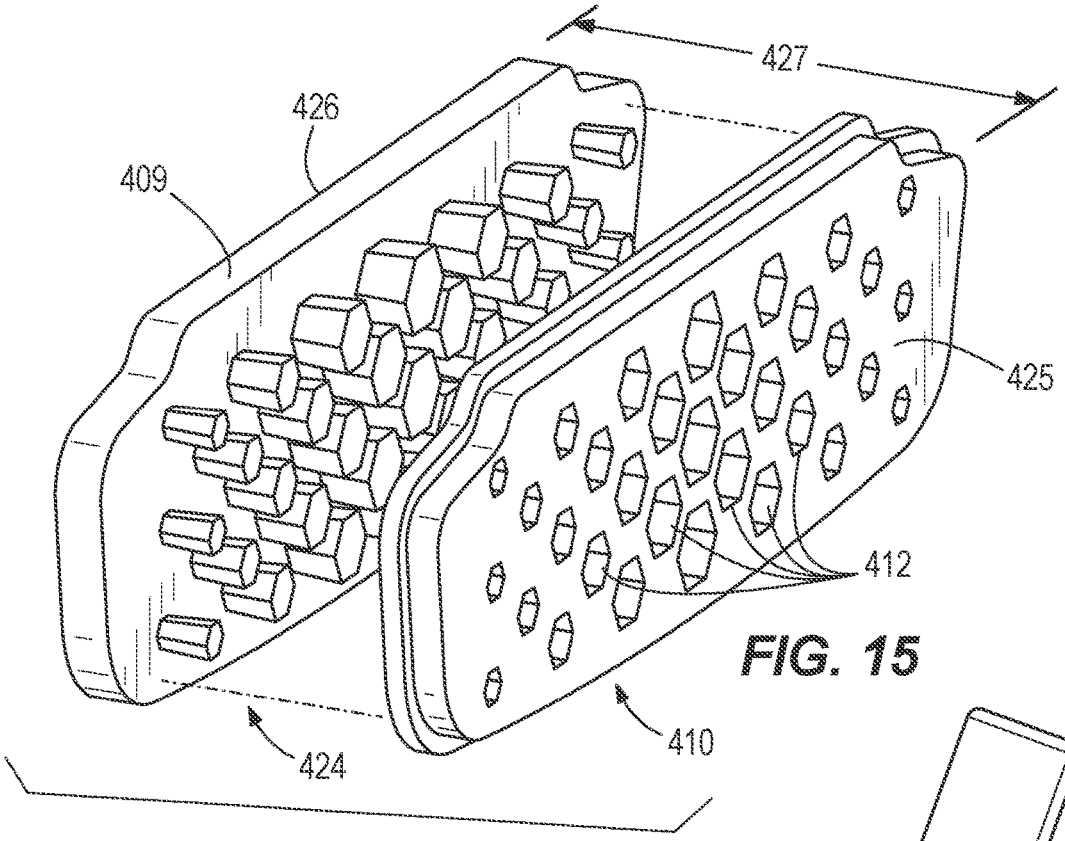
FIG. 15 shows an exploded view of the insert having discrete hexagonal voids of FIG. 14.
Figure 16:
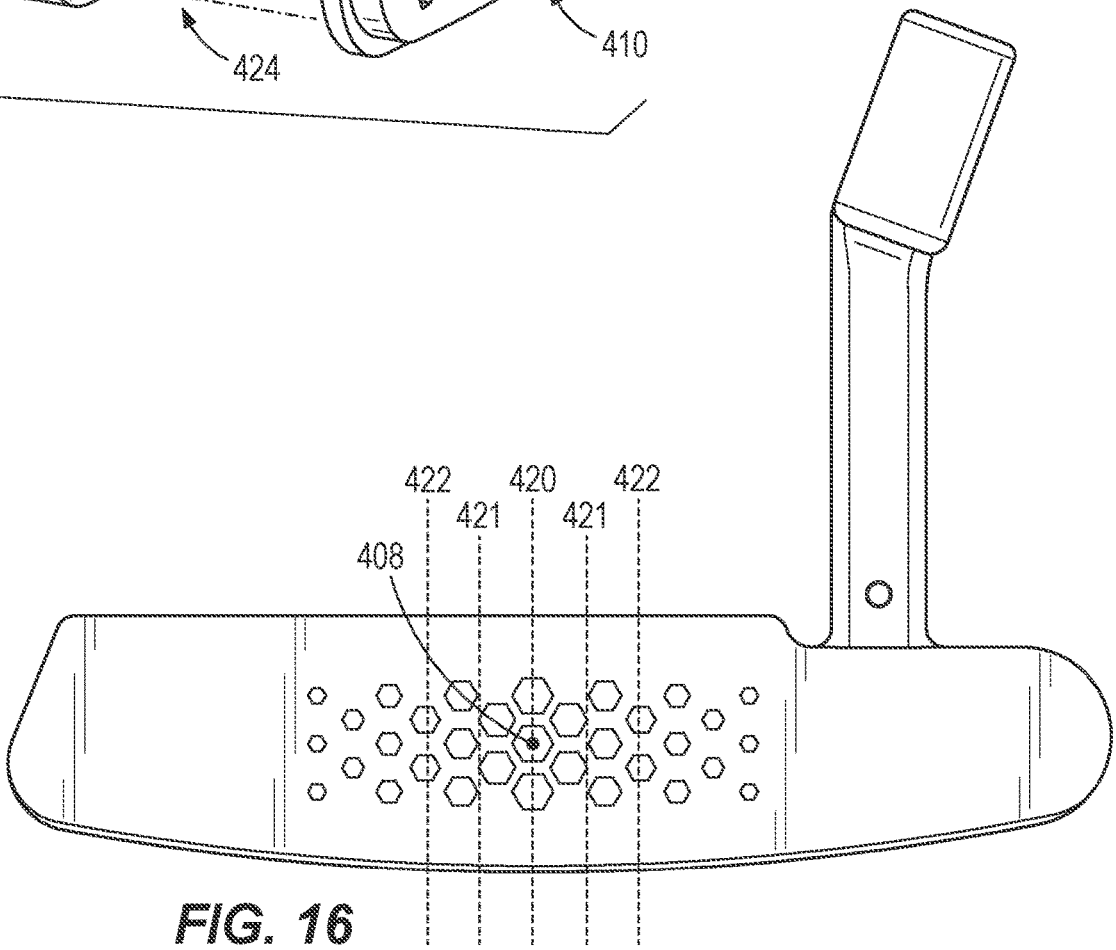
FIG. 16 shows an assembled front view of the insert of FIG. 14.

FIGS. 14-16 illustrate another exemplary embodiment according to the invention described herein. More particularly, FIGS. 14-16 illustrate an example of a putter-type golf club head 400 comprising a dual-material striking surface 407 comprising a first material 409 and a second material 410. The golf club head 400 of FIGS. 14-16 and the golf club head 300 of FIGS. 10-13 are similar in many respects, except for that the golf club head 400 comprises discrete voids that are hexagonal in shape rather than pill shaped.

FIG. 14 illustrates a putter-type golf club head 400 comprising a putter-body 401 having a toe portion 402, a heel portion 403 opposite the toe portion 402, a top rail portion 404, a sole portion 405 opposite the top rail portion 404, a portion of a striking surface 407, and a rear portion 406 opposite the striking surface portion 407. The striking surface portion 407 can further define a striking surface recess 423 defined by the heel portion 403, the toe portion 402, the top rail portion 404, the sole portion 405, and the rear portion 406 of the putter body 401.

FIG. 15 illustrates a two-part putter insert 424 comprising discrete hexagonal voids. In many embodiments, the putter insert 424 can be received within and complementary with the striking surface recess 423. However, it should be noted in alternative embodiments, the putter-type golf club head 400 need not to be an insert style putter.

FIGS. 14-16 illustrate the putter insert 424 comprising a first material 409 (also can be referred to as "first part") and a second material 410 (also can be referred to as "second part"). With specific reference to FIG. 15, the second part forms (or defines) a plurality of discrete hexagonal shaped voids 412. These discrete hexagonal shaped voids are arranged in rows and columns and do not connect (or touch) another hexagonal shaped void. The first material has a hardness less than the second material.

The second material surrounds the hexagonal shaped void to form second material land areas. The first part of the putter insert 424 comprises a plurality of protruding hexagonal shaped geometries that are complimentary to a corresponding hexagonal pill shaped void 412. Upon coupling, the first part and the second part together, the plurality of protruding hexagonal shaped voids can be flush with the second material land areas. Thereby, permitting the plurality of protruding discrete hexagonal shaped voids to form first material land areas. The first material land areas and the second material land engage with at least a portion of the golf ball upon golf ball impact.

This embodiment illustrates one possible arrangement where hexagonal voids are arranged to form a denser, more packed center region creating more first material land areas than second material land areas. Referencing FIG. 16, it can be seen that in any given row the hexagonal shaped voids having the greatest widths are proximate to the center region and the hexagonal shaped voids having the smallest widths are distal from the center region. This arrangement creates a center region having a greater amount of first material land areas than second material land area. This creates a center region that is less responsive to ball impacts relative to heel end or toe regions. In a top rail to sole direction, the widths of the first material land are substantially the same or constant. Therefore, as the widths of the discrete hexagonal voids decreases away from the center region, the ratio between the first material and the second material varies too.

Moving away from the center region toward the heel or toe along a given row, the spacing distance between adjacent discrete hexagonal shaped voids increases (i.e. the length of the discrete hexagonal shaped voids decrease. This creates more second material land areas, which aids in gradually creating a more responsive region away from the center region towards the heel and toe regions to consistently control ball speeds across the striking surface.

With continued reference FIG. 15, FIG. 15 illustrates an exploded view of the putter insert 424 comprising discrete hexagonal shaped voids. The insert 424 can comprise of a front surface 425 adapted for impact with a golf ball (not shown) and a rear surface 426 opposite the front portion. A putter insert thickness (i.e. depth) 427 can be defined as the maximum perpendicular distance between the front surface 425 and the rear surface 426. For example, FIG. 15 illustrates the insert 424 having a plurality of discrete hexagonal voids 412 (defined by the second material) extending entirely through the second material 410 thickness (i.e. depth).

Further, in many embodiments, the first material 409 can entirely cover the rear surface 426 of the insert 424. In other words, the rear surface 426 is devoid of the second material 410. In many embodiments, the first material 409 further fills each of the discrete hexagonal voids 412 (until flush with the front surface 425 of the insert) of the pluralities of discrete hexagonal shaped voids, so that at the front surface 425 the second material 410 surrounds the first material 409, so that upon golf ball impact the first material 409 and the second material 410 can engage to least a portion of the golf ball.

Each discrete hexagonal shape void can be defined as a six-sided polygon with six internal angles and six vertices. Each internal angle 431 of the six internal angles can be approximately 120 degrees. The internal angles add up to approximately 720 degrees. Each side of the six-sided polygon can be equal or substantially equal in length.

The maximum length of each discrete hexagonal shaped void 412 (measured in a heel-to-toe direction) can vary in a heel-to-toe direction. In many embodiments, the maximum length of each discrete hexagonal shape 412 void can be between 0.03 inches and 0.40 inches. For example, the maximum length of each of the plurality of discrete hexagonal shaped voids 412 can be between 0.03 inches-0.40 inches, 0.04 inches-0.40 inches, 0.05 inches-0.40 inches, 0.06 inches-0.40 inches, 0.07 inches-0.40 inches, 0.08 inches-0.40 inches, 0.09 inches-0.40 inches, 0.10 inches-0.40 inches, 0.11 inches-0.40 inches, 0.12 inches-0.40 inches, 0.13 inches-0.40 inches, 0.14 inches-0.40 inches, or 0.15 inches-0.40 inches. In other embodiments, the maximum length of each discrete hexagonal void 412 can vary between 0.074 inches and 0.17 inches.

In other embodiments, the maximum length of each discrete hexagonal shaped void 412 can be less than 0.30 inches, less than 0.29 inches, less than 0.28 inches, less than 0.27 inches, less than 0.26 inches, less than 0.25 inches, less than 0.24 inches, less than 0.23 inches, less than 0.22 inches, less than 0.21 inches, less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, less than 0.10 inches, less than 0.09 inches, less than 0.08 inches, less than 0.07 inches, less than 0.06 inches, less than 0.05 inches, or less than 0.04 inches.

The maximum width of each discrete hexagonal shaped void 412 of the plurality of hexagonal shaped voids (measured in a top rail-to-sole direction) can vary. In many embodiments, the maximum width of each discrete hexagonal shaped void 412 can be between 0.03 inches and 0.40 inches. For example, the maximum width of each discrete hexagonal void 412 can be greater than 0.03 inches, greater than 0.04 inches, greater than 0.05 inches, greater than 0.06 inches, greater than 0.07 inches, greater than 0.08 inches, greater than 0.09 inches, greater than 0.10 inches, greater than 0.11 inches, greater than 0.12 inches, greater than 0.13 inches, greater than 0.14 inches, greater than 0.15 inches, greater than 0.16 inches, greater than 0.17 inches, greater than 0.18 inches, greater than 0.19 inches, or greater than 0.20 inches. In other embodiments, the maximum width of each discrete hexagonal shaped void 412 can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In the same or other of discrete hexagonal shaped void 412 embodiments, the plurality of discrete hexagonal shaped voids 412 can be positioned in substantially horizontal rows and/or substantially vertical columns. In the exemplary embodiment of FIG. 16, the plurality of discrete hexagonal shaped voids are arranged to form five rows and thirteen columns. In alternative embodiments, the plurality of discrete hexagonal shaped voids can be arranged to form two or more rows, three or more rows, four or more rows, five or more rows, six or more rows, seven or more rows, eight or more rows, nine or more rows, ten or more rows, eleven or more rows, twelve or more rows, thirteen or more rows, fourteen or more rows, fifteen or more rows, sixteen or more rows, seventeen or more rows, eighteen or more rows, nineteen or more rows, or twenty or more rows. In the same or alternative embodiments, the plurality of discrete hexagonal shaped voids can be arranged to form two or more columns, three or more columns, four or more columns, five or more columns, six or more columns, seven or more columns, eight or more columns, nine or more columns, ten or more columns, eleven or more columns, twelve or more columns, thirteen or more columns, fourteen or more columns, fifteen or more columns, sixteen or more columns, seventeen or more columns, eighteen or more columns, nineteen or more columns, or twenty or more columns. As will be further described below, aligning the hexagonal shaped voids 412 in rows and columns permits an appropriate ratio between the first and second material along a vertical reference axis.

As can be seen in the exemplary embodiment of FIGS. 14-16, each of the plurality of discrete hexagonal shaped voids 412 are spaced from one another in both a heel-to-toe direction and a top rail-to-sole direction. This is dissimilar from the continuous groove or recesses embodiments of FIGS. 1-9 which are continuously connected in the heel-to-toe direction. Each row or column can have two or more discrete hexagonal shaped voids, three or more discrete hexagonal shaped voids, four or more discrete hexagonal shaped voids, five or more discrete hexagonal shaped voids, six or more discrete hexagonal shaped voids, seven or more discrete hexagonal shaped voids, eight or more discrete hexagonal shaped voids, nine or more discrete hexagonal shaped voids, ten or more discrete hexagonal shaped voids, eleven or more discrete hexagonal shaped voids, twelve or more discrete hexagonal shaped voids, thirteen or more discrete hexagonal shaped voids, fourteen or more discrete hexagonal shaped voids, fifteen or more discrete hexagonal shaped voids, sixteen or more discrete hexagonal shaped voids, seventeen or more discrete hexagonal shaped voids, eighteen or more discrete hexagonal shaped voids, nineteen or more discrete hexagonal shaped voids, or twenty or more discrete hexagonal shaped voids.

The volume of the first material 409 that fills each discrete hexagonal shaped void 412 can vary in a heel-to-toe direction. In many embodiments, first material 409 can fill a volume between 0.0000803 $in^3$-0.004 $in^3$. In some embodiments, the first material 409 can fill a volume between 0.0000803 $in^3$-0.004 $in^3$, 0.000176 $in^3$-0.004 $in^3$, 0.000272 $in^3$-0.004 $in^3$, 0.000368 $in^3$-0.004 $in^3$, 0.000464 $in^3$-0.004 $in^3$, 0.00056 $in^3$-0.004 $in^3$, 0.00065 $in^3$-0.004 $in^3$, 0.0075 $in^3$-0.004 $in^3$, 0.000849 $in^3$-0.004 $in^3$, or 0.000945 $in^3$-0.004 $in^3$. In other embodiments, the first material 409 can fill a volume between 0.00035 $in^3$-0.00187 $in^3$. Having the first material 409 fill discrete voids of this size more accurately controls the adjustment resolution between the first material and the second material to create a consistent ball speed across the striking surface and enhanced impact feel and sound.

In many of the discrete hexagonal void embodiments, when the club head is an address position the striking surface comprises a striking surface imaginary vertical axis 420 that extends through a geometric center 408 of the striking surface 407 in a top rail-to-sole direction (as shown by FIG. 16). Further, offset from the striking surface imaginary vertical axis in both a heel 403 and toe 402 direction at 0.25 inch and 0.50 inch are corresponding vertical reference axes.

As further illustrated in FIG. 16, adjacent discrete hexagonal shaped voids 412 are closer to one another (i.e. packed more closely, small (second material) land area between discrete voids) along the striking surface imaginary vertical axis 420 in both a horizontal and vertical direction than at the vertical reference axis of 0.25 inch 421 and 0.5 inch 422. Similarly, adjacent discrete hexagonal shaped voids 412 are closer to one another (i.e. packed more closely, smaller land (or second material) area in both a horizontal and vertical direction between discrete hexagonal shaped voids 412) at the vertical reference axis of 0.25 inch 421 than at the vertical reference axis of 0.5 inch 422.

In many of the discrete hexagonal shaped voids embodiments, the percentage of the first material 409 along the 0.5-inch vertical reference axis 422 can between approximately 20% and 40%. For example, the percentage of the first material 409 along the 0.5 inch vertical reference axis 422 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis 422 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 409 along the 0.5 inch vertical reference axis 422 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the discrete hexagonal shaped voids embodiments, the percentage of the first material 409 (or first material land area) along the 0.25-inch vertical reference axis 421 can be between approximately 30% and 50%. For example, the percentage of the first material 409 along the 0.25 inch vertical reference axis 421 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material 409 along the 0.25 inch vertical reference axis 421 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 409 along the 0.25 inch vertical reference axis 421 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete hexagonal shaped voids embodiments, the percentage of the first material 409 (or first material land area) along the striking surface imaginary axis 420 can between approximately 40% and 60%. For example, the percentage of the first material 409 along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 409 along the striking surface imaginary axis 420 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material 409 along the striking surface imaginary axis 420 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage 409 to the surface area of the second material land area percentage 410 (measured along a respective vertical references axis) decreases from the striking surface imaginary vertical axis 420 to the 0.5-inch vertical reference axis 422. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Additionally, in this exemplary embodiment, variable width (in a top rail-to-sole direction along columns) and/or even variable thickness (or depth) discrete voids are not needed to create consistent ball speeds across the striking surface. Consistent ball speeds are achieved as the discrete hexagonal shaped voids vary in length (in a heel-to-toe direction) creating differing first and second material ratios along a vertical direction.

Continuous Grooves (Insert Style Putter)

Figure 17:
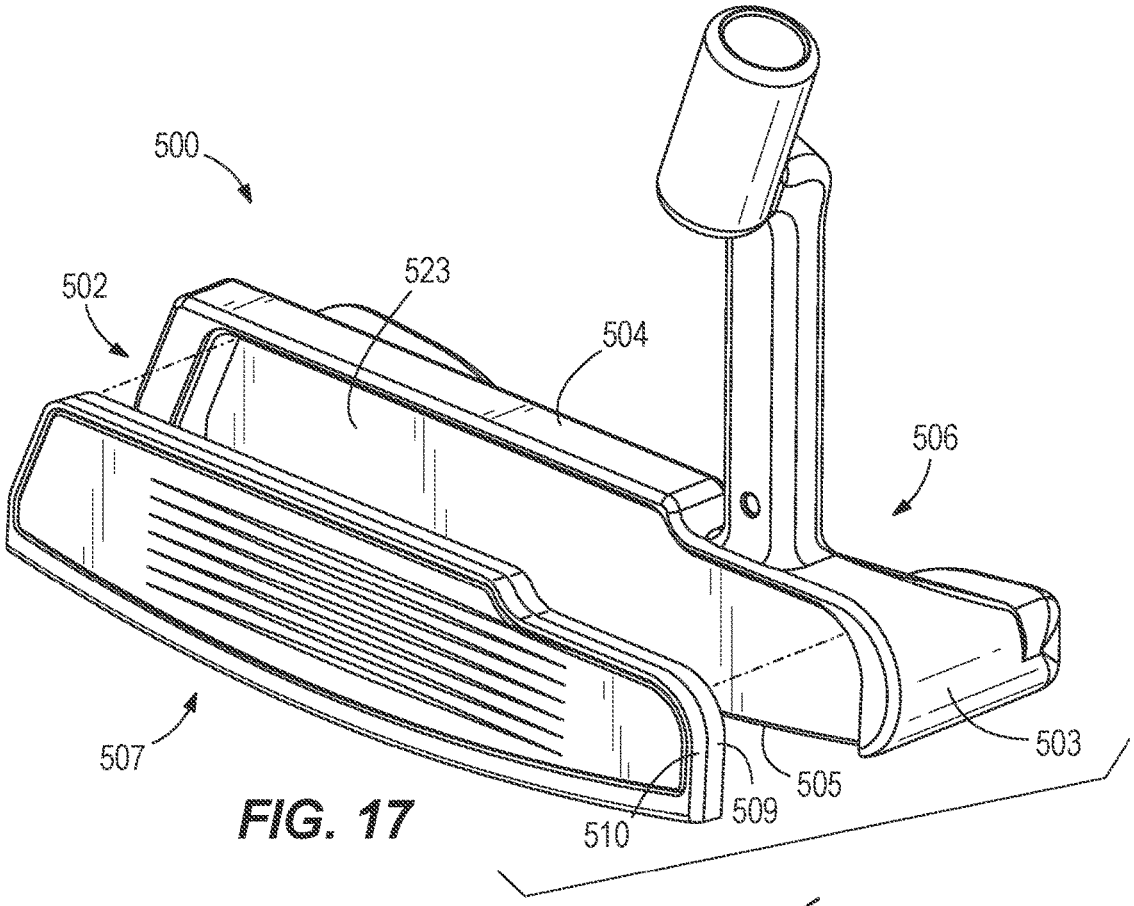
FIG. 17 shows a heel side perspective view of a striking surface having continuous grooves for an insert style club head according to one embodiment.
Figure 18:
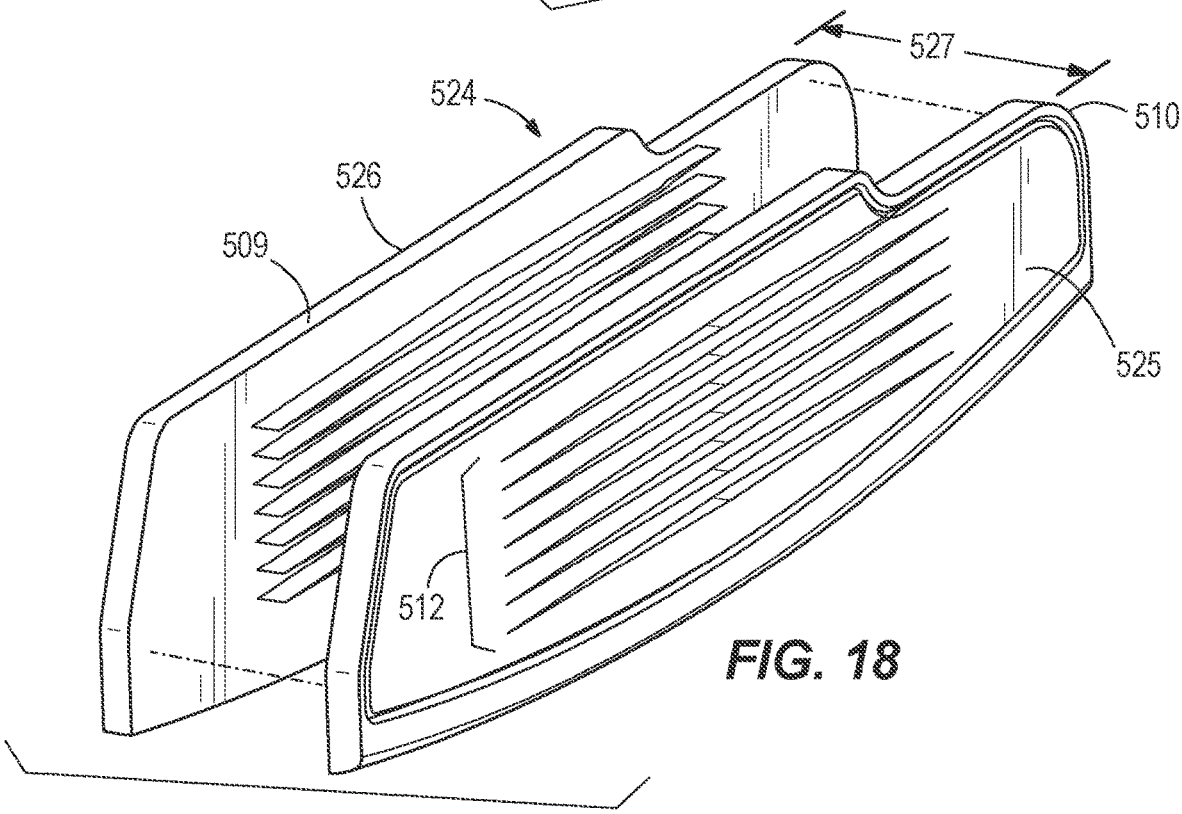
FIG. 18 shows an exploded view of the insert of FIG. 17.
Figure 19:
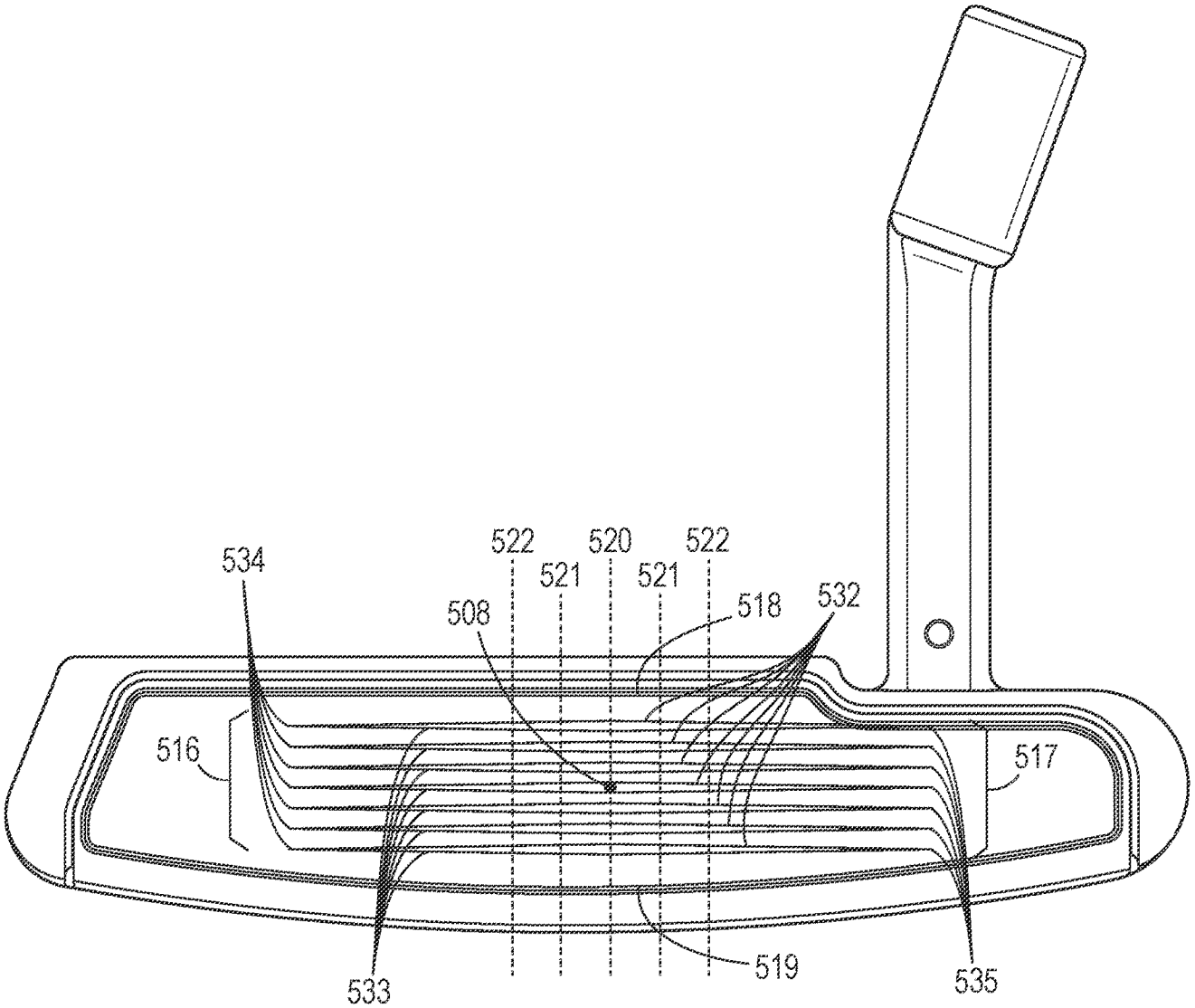
FIG. 19 shows an assembled front view of FIG. 17.

FIGS. 17-19 illustrate another exemplary embodiment. More particularly, FIGS. 17-19 illustrate an example of a putter-type golf club head 500 comprising a dual-material striking surface 507 comprising a first material 509 and a second material 510. The golf club head 500 of FIGS. 17-19 are similar in many respects to the above described embodiments.

The putter-type golf club head of FIGS. 17-19 comprises a putter-body 501 having a toe portion 502, a heel portion 503 opposite the toe portion 502, a top rail portion 504, a sole portion 505 opposite the top rail portion 504, a portion of a striking surface 507, and a rear portion 506 opposite the striking surface portion 507. The striking surface portion 507 further defines a striking surface recess 523 defined by the heel portion 503, the toe portion 502, the top rail portion 504, the sole portion 505, and the rear portion 506 of the putter body 501.

FIGS. 17-19 illustrate a putter insert 524 comprising a first material 509 (can also be referred to as "first part") and a second material 510 (can also be referred to as "second part"). With specific reference to FIG. 18, the second part forms (or defines) a plurality of continuous groove voids 512 and the second material 510 surrounding the plurality of continuous groove voids can be defined as second material land areas. The first part of the putter insert 524 comprises a plurality of protruding geometries that are complimentary to a corresponding continuous groove void 512. Upon coupling, the first part and the second part of the insert 524 together, the plurality of protruding geometries can be flush with the second material land areas. Therefore, the plurality of protruding geometries can also form first material land areas. The first material land areas and the second material land can engage with at least a portion of the golf ball upon golf ball impact.

This embodiment illustrates one possible arrangement where each continuous groove voids 412 defines an upper inflection point and lower inflection point. The upper and lower inflection point are centrally positioned on the striking surface. This allows the maximum width of each of the continuous groove void to be centrally located on the striking surface in a top rail-to-sole direction and a heel-to-toe direction. The first material has a hardness less than the second material. This creates a denser, more packed center region having more first material land areas than second material land areas. Having a greater amount of first material land areas than second material land area aids in creating a center region that is less responsive to ball impacts than areas toward and at the heel end or toe ends.

Moving away from the center region in a heel and/or toe direction, the spacing distance between adjacent arcuate portions increases to introduce more second material land areas. This creates a gradually more responsive region from the center region towards the heel and toe regions to control ball speeds more consistently across the striking surface.

Referencing FIG. 18, FIG. 18 illustrates a perspective view of a putter insert 524. In many embodiments, the putter insert 524 can be received within and complementary with the striking surface recess 523. The putter insert 524 can comprise of a front surface 525 adapted for impact with a golf ball (not shown) and a rear surface 526 opposite the front portion.

A putter insert thickness 527 can be defined as the maximum perpendicular distance between the front surface 525 and the rear surface 526. For example, FIG. 18 illustrates the insert 524 having a plurality of continuous groove voids 512 (defined by the second material) extending entirely through the second material 510 thickness. In many embodiments, the first material, the second material, and/or the combination of the first and second material can be of a constant thickness.

Further, in many embodiments and as illustrated herein, the first material 509 entirely covers the rear surface 526 of the insert 524. In other words, the rear surface 526 is devoid of the second material 510. In many embodiments, the first material 509 further fully fills (or fully occupies) each continuous groove void (until flush with the front surface 525 of the insert) of the pluralities of continuous groove voids, so that at the front surface 525 the second material 510 surrounds the first material 509, so that upon golf ball impact the first material 509 and the second material 510 are engaged to least a portion of the golf ball.

The plurality of continuous groove voids 512 defined by the putter insert 524 can resemble many shapes or geometries. For example, in this exemplary embodiment illustrated herein the continuous groove voids 512 extend substantially horizontal in a heel-to-toe direction. Each groove continuous groove 512 of the plurality of continuous grooves 512 defines an upper continuous groove wall 532 proximal to the upper border of the striking surface 518, a lower continuous groove wall proximal 533 to the lower border 519 of the striking surface, a first continuous groove vertex 534 proximal to the toe portion, and a second continuous groove vertex 535 proximal to the heel portion.

In many embodiments, the upper continuous groove wall 532 continuously decreases from the striking surface imaginary vertical axis 520 to a first continuous groove vertex 534 and a second continuous vertex 535. Stated another way, the upper continuous groove wall 532 defines an upper inflection point along the upper continuous groove wall at the striking surface imaginary vertical axis 520 and a lower inflection point along the lower continuous groove wall 533 at the striking surface imaginary axis 520. At the first end 516 and the second end 517 of the continuous groove voids 512, the upper continuous groove wall 532 and the lower continuous groove wall 533 meet to define a first continuous groove vertex 534 and a second continuous groove vertex 535.

In alternative embodiments of putter-type golf club heads having continuous groove voids 512, the second material 510 can define one or more continuous groove voids 512, two or more continuous groove voids 512, three or more continuous groove voids 512, four or more continuous groove voids 512, five or more continuous groove voids 512, six or more continuous groove voids 512, seven or more continuous groove voids 512, eight or more continuous groove voids 512, nine or more continuous groove voids 512, ten or more continuous groove voids 512, or eleven or more continuous groove voids 512.

Each of the continuous groove voids can have a maximum width measured at the striking surface imaginary vertical axis 520 in a top rail 504-to-sole 505 direction. In many embodiments, the maximum width of each continuous groove void 520 can range between 0.020 inch to 0.060 inch. For example, the maximum width of the continuous groove voids 520 can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, approximately 0.040 inches, approximately 0.041 inches, approximately 0.042 inches, approximately 0.043 inches, approximately 0.044 inches, approximately 0.045 inches, approximately 0.046 inches, approximately 0.047 inches, approximately 0.048 inches, approximately 0.049 inches, approximately 0.050 inches, approximately 0.051 inches, approximately 0.052 inches, approximately 0.053 inches, approximately 0.054 inches, approximately 0.055 inches, approximately 0.056 inches, approximately 0.057 inches, approximately 0.058 inches, approximately 0.059 inches, or approximately 0.060 inches. The width of the continuous groove voids 512 at the first continuous groove vertex and a second continuous groove are less than 0.0001 inch and preferably 0 inch.

In many embodiments, each continuous groove void 512 of the plurality of continuous groove voids can have a maximum length (measured in a heel 503-to-toe 502 direction) that is between 30% and 100% of the maximum length of the striking surface 507. For example, each continuous groove void of the plurality of continuous groove voids 512 can have a maximum length that is greater than 30% of the striking surface 507, greater than 35% of the striking surface 507, greater than 40% of the striking surface 507, greater than 45% of the striking surface 507, greater than 50% of the striking surface 507, greater than 55% of the striking surface 507, greater than 60% of the striking surface 507, greater than 65% of the striking surface 507, greater than 70% of the striking surface 507, greater than 75% of striking surface 507, greater than 80% of the striking surface 507, greater than 85% of the striking surface 507, greater than 90% of the striking surface 507, or greater than 95% of the striking surface 507.

In many embodiments to control the relationship (or ratio) between the first material 509 and the second material 510, the width of the continuous groove voids decreases from the striking surface imaginary vertical axis 520 to a virtually zero width at the first continuous groove vertex and/or from the striking surface imaginary vertical axis to a virtually zero width at the second continuous groove vertex. This type of void geometry accurately controls the amount of land areas (or second material area) between adjacent continuous groove voids in a vertical direction to reached predetermined first material-to-second material thresholds.

In many of the continuous groove void embodiments and as described above when the club head is an address position the striking surface comprises a striking surface imaginary vertical axis 520 that extends through a geometric center 508 of the striking surface 507 in a top rail-to-sole direction (as shown by FIG. 19). Further, offset from the striking surface imaginary vertical axis in both a heel 503 and toe 502 direction at 0.25 inch and 0.50 inch are corresponding vertical reference axes.

As further illustrated in FIG. 19, adjacent continuous groove voids are closer to one another (i.e. packed more closely, small land area between grooves) along the striking surface imaginary vertical axis 520 than at the vertical reference axis of 0.25 inch 521 and 0.5 inch 522. Similarly, adjacent continuous grooves are closer to one another (i.e. packed more closely, smaller land (or second material) area between groove voids) at the vertical reference axis of 0.25 inch 521 than at the vertical reference axis of 0.5 inch 522.

In many of the continuous groove void embodiments, the percentage of the first material (or first material land area) along the 0.5-inch vertical reference axis can between approximately 20% and 40%. For example, the percentage of the first material along the 0.5 inch vertical reference axis can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material along the 0.5 inch vertical reference axis can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the continuous groove embodiments, the percentage of the first material (or first material land area) along the 0.25-inch vertical reference axis can be between approximately 30% and 50%. For example, the percentage of the first material along the 0.25 inch vertical reference axis can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material along the 0.25 inch vertical reference axis can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material along the 0.25 inch vertical reference axis can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the continuous groove embodiments, the percentage of the first material (or first material land area) along the striking surface imaginary axis can between approximately 40% and 60%. For example, the percentage of the first material along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material along the striking surface imaginary axis can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material along the striking surface imaginary axis can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage to the surface area of the second material land area percentage (measured along a respective vertical references axis) decreases from the striking surface imaginary vertical axis to the 0.5-inch vertical reference axis. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Discrete Voids (Vertical Radiating Pattern)

FIGS. 20-23 illustrate another exemplary embodiment. More particularly, FIGS. 20-23 illustrate an example of a putter-type golf club head 600 comprising a dual-material striking surface 607 comprising a first material 609 and a second material 610. The golf club head 600 of FIGS. 20-23 and the above described golf club heads 100, 200, 300, 400, 500 are similar in many respects, except for that the golf club head 600 comprises discrete voids that extend substantially in a top rail-to-sole direction.

The putter-type golf club head of FIGS. 20-23 can comprises a putter-body (similar to the above mentioned putter bodies) having a toe portion, a heel portion opposite the toe portion, a top rail portion, a sole portion opposite the top rail portion, a portion of a striking surface, and a rear portion opposite the striking surface portion. The striking surface portion further defines a striking surface recess defined by the heel portion, the toe portion, the top rail portion, the sole portion, and the rear portion of the putter body.

FIGS. 20-23 illustrate a putter insert 624 comprising a first material 609 (also can be referred to as "first part") and a second material 610 (also can be referred to as "second part"). With specific reference to FIG. 20, the second part forms (or defines) a plurality of discrete concentric radiating voids 612. Each of the discrete concentric radiating voids have a common center at the striking surface geometric center 608.

The second material substantially surrounds the discrete concentric radiating voids to form second material land areas. The first part of the putter insert 624 comprises a plurality of discrete concentric radiating protrusions that are complimentary to a corresponding discrete concentric radiating void 612. By coupling, the first part and the second part together, the plurality of protruding discrete concentric radiating voids can be flush with the second material land areas (i.e. same planar surface). This allows the plurality of protruding discrete concentric radiating voids to form first material land areas. The first material has a hardness less than the second material. The first material land areas and the second material land engage with at least a portion of the golf ball upon golf ball impact.

This embodiment illustrates a possible arrangement where the discrete concentric radiating voids are arranged to increase in diameter outwardly and away from the striking surface geometric center 608. This forms a denser, more packed center region creating more first material land areas than second material land areas. This arrangement creates a center region having a greater amount of first material land areas than second material land area. Thereby, creating a center region that is less responsive to ball impacts relative to heel or toe regions. In a top rail to sole direction and in a heel to toe direction, the widths of the first material land areas are substantially the same or constant.

Moving away from the center region toward the heel or toe direction, the spacing distance between adjacent discrete concentric radiating voids increases. This creates more second material land areas, which aids in gradually creating a more responsive region away from the center region towards the heel and toe regions to consistently control ball speeds across the striking surface.

Figure 20:
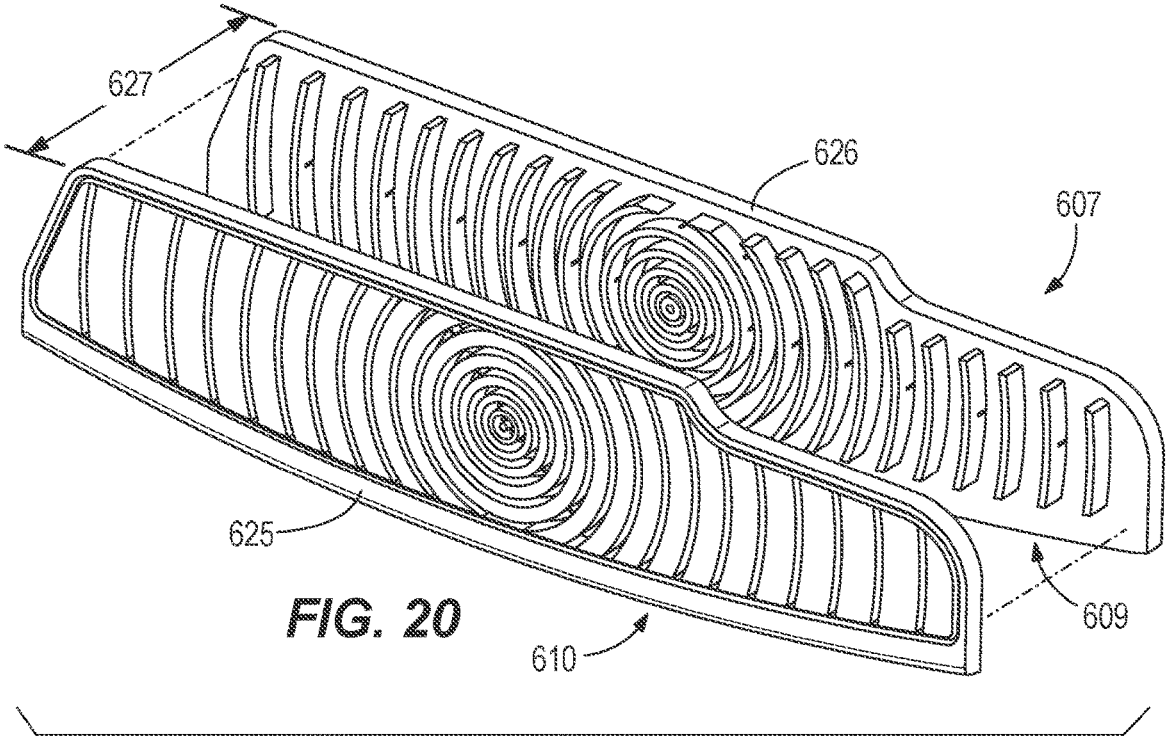
FIG. 20 shows an exploded view of an insert having discrete concentric radiating voids.

Referring to FIG. 20, FIG. 20 illustrates a perspective view of a putter insert 624. In many embodiments, the putter insert 624 can be received within and complementary with the striking surface recess. The putter insert 624 can comprise of a front surface 625 adapted for impact with a golf ball (not shown) and a rear surface 626 opposite the front portion.

A putter insert thickness 627 can be defined as the maximum perpendicular distance between the front surface 625 and the rear surface 626. For example, FIG. 20 illustrates the insert 624 having a plurality of discrete concentric radiating voids 612 (defined by the second material) extending entirely through the second material 610 thickness. In many embodiments, the first material, the second material, and/or the combination of the first and second material can be of a constant thickness.

Further, in many embodiments and as illustrated herein, the first material 609 entirely covers the rear surface 626 of the insert 624. In other words, the rear surface 626 is devoid of the second material 610. In many embodiments, the first material 609 further fully fills (or fully occupies) each discrete concentric radiating void (until flush with the front surface 625 of the insert) of the pluralities of discrete concentric radiating voids, so that at the front surface 625 the second material 610 surrounds the first material 609, so that upon golf ball impact the first material 609 and the second material 610 are engaged to least a portion of the golf ball.

In many embodiments, a majority of the discrete concentric radiating voids 612 vertically extend in a top rail-to-sole direction and connect to both an upper border 618 of the striking surface 607 and a lower border 619 of the striking surface 607. In many embodiments, where a discrete concentric radiating void 612 does not connect to the upper or lower border of the striking surface, a strut 636 or a string of struts 636 are needed to connect it directly or indirectly to a discrete concentric radiating void that is connected to an upper and lower border of the striking surface.

In many embodiments, the discrete concentric radiating voids 612 are concentric about the geometric center of the striking surface and can be either circular or arc-like. In a direction from the geometric center of the striking surface to the toe portion and from the geometric center of the striking surface to the heel portion, the diameter of the discrete concentric radiating voids increases. Stated another way, and in many embodiments, in a direction from the geometric center of the striking surface to the upper border of the striking surface and in a direction the geometric center of the striking surface to the lower border of the striking surface the diameter of the discrete concentric radiating voids increases.

As can be seen by FIGS. 20-23, not all the discrete concentric voids directly connect to the upper and lower border of the striking surface. To ensure that the first material fills the discrete concentric voids in the course of a manufacturing process (i.e. molding), the discrete concentric voids that do not directly connect to the upper and lower border of the striking surface, one or more struts 636 are needed. As can be seen by a combination of FIGS. 22 and 23, a plurality of struts are recessed inwardly from the front surface 625 of the striking surface 607. These struts enable the discrete concentric voids that are not connected to the upper and lower border of the striking surface to be indirectly connected to one or more discrete concentric voids connected to the upper and lower border of the striking surface.

In alternative embodiments of putter-type golf club heads having discrete concentric radiating voids 612, the second material 610 can define one or more discrete concentric radiating voids 612, two or more discrete concentric radiating voids 612, three or more discrete concentric radiating voids 612, four or more discrete concentric radiating voids 612, five or more discrete concentric radiating voids 612, six or more discrete concentric radiating voids 612, seven or more discrete concentric radiating voids 612, eight or more discrete concentric radiating voids 612, nine or more discrete concentric radiating voids 612, ten or more discrete concentric radiating voids 612, or eleven or more discrete concentric radiating voids 612, twelve or more discrete concentric radiating voids 612, thirteen or more discrete concentric radiating voids 612, fourteen or more discrete concentric radiating voids 612, fifteen or more discrete concentric radiating voids 612, sixteen or more discrete concentric radiating voids 612, seventeen or more discrete concentric radiating voids 612, eighteen or more discrete concentric radiating voids 612, nineteen or more discrete concentric radiating voids 612, twenty or more discrete concentric radiating voids 612, twenty-one or more discrete concentric radiating voids 612, twenty-two or more discrete concentric radiating voids 612, twenty-three or more discrete concentric radiating voids 612, twenty-four or more discrete concentric radiating voids 612, twenty-five or discrete concentric radiating voids 612, twenty-six or more discrete concentric radiating voids 612, twenty-seven or more discrete concentric radiating voids 612, twenty-eight or more discrete concentric radiating voids 612, twenty-nine or more discrete concentric radiating voids 612, or thirty or more discrete concentric radiating voids 612.

Each of the discrete concentric radiating voids 612 can have a constant width measured transversely in a heel-to-toe direction. In many embodiments, the width of the plurality of discrete concentric radiating voids can range between 0.020 inch to 0.060 inch. For example, the width of the plurality of discrete concentric radiating voids 612 can be approximately 0.020 inches, approximately, 0.021 inches, approximately 0.022 inches, approximately 0.023 inches, approximately 0.024 inches, approximately 0.025 inches, approximately 0.026 inches, approximately 0.027 inches, approximately 0.028 inches, approximately 0.029 inches, approximately 0.030 inches, approximately 0.031 inches, approximately 0.032 inches, approximately 0.033 inches, approximately 0.034 inches, approximately 0.035 inches, approximately 0.036 inches, approximately 0.037 inches, approximately 0.038 inches, approximately 0.039 inches, approximately 0.040 inches, approximately 0.041 inches, approximately 0.042 inches, approximately 0.043 inches, approximately 0.044 inches, approximately 0.045 inches, approximately 0.046 inches, approximately 0.047 inches, approximately 0.048 inches, approximately 0.049 inches, approximately 0.050 inches, approximately 0.051 inches, approximately 0.052 inches, approximately 0.053 inches, approximately 0.054 inches, approximately 0.055 inches, approximately 0.056 inches, approximately 0.057 inches, approximately 0.058 inches, approximately 0.059 inches, or approximately 0.060 inches. As will be further seen in the Examples section, variable width, variable depth, and or variable thickness voids are not required to achieve a consistent ball speed across the striking surface 607.

Figure 21:
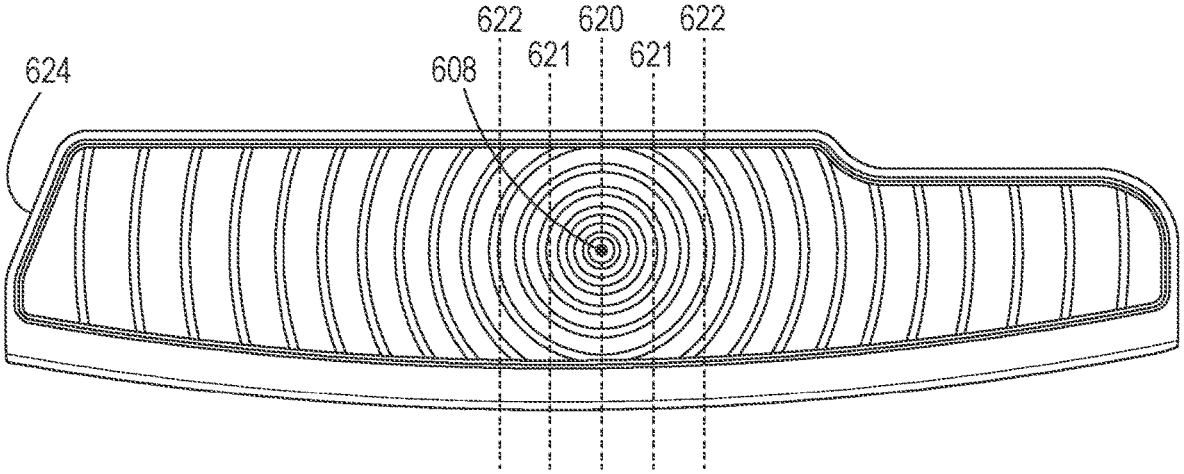
FIG. 21 shows an assembled front view of the insert of FIG. 20.
Figure 22:
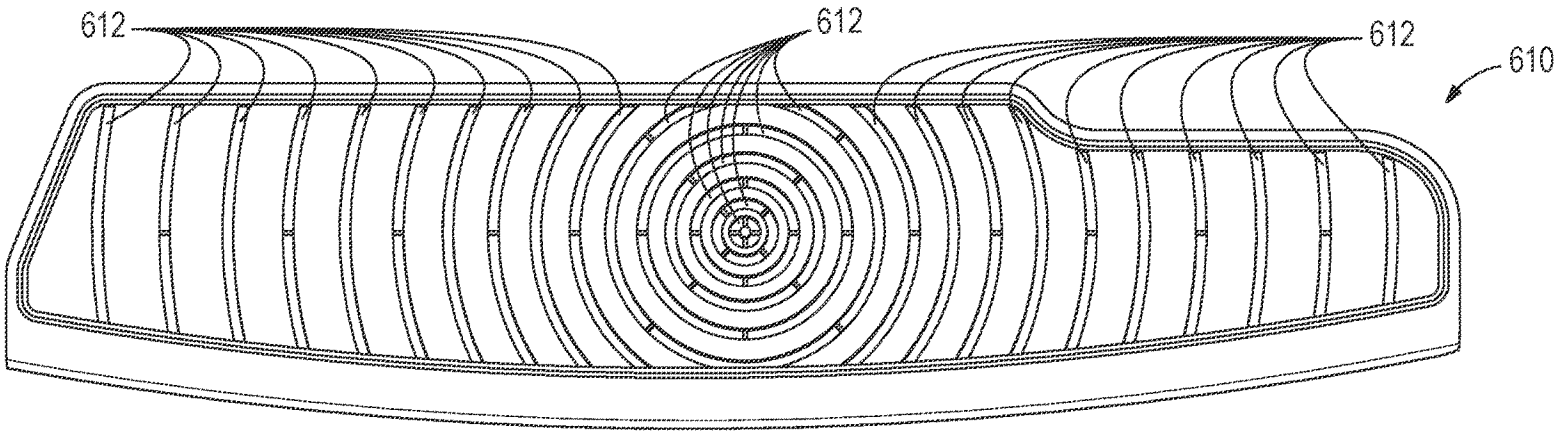
FIG. 22 shows a non-assembled front view of the second material of FIG. 20.
Figure 23:
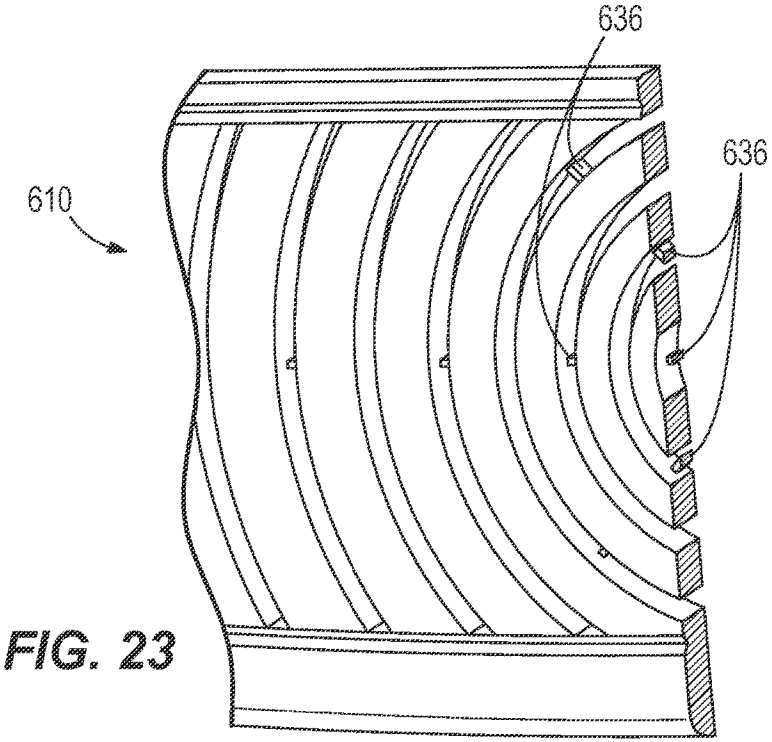
FIG. 23 shows a cross sectional view of FIG. 22.

In many of the discrete concentric radiating void embodiments and as described above when the club head is an address position the striking surface comprises a striking surface imaginary vertical axis 620 that extends through a geometric center 608 of the striking surface 607 in a top rail-to-sole direction (as shown by FIG. 21). Further, offset from the striking surface imaginary vertical axis in both a heel 603 and toe 602 direction at 0.25 inch and 0.50 inch are corresponding vertical reference axes.

As further illustrated in FIG. 21, adjacent discrete concentric radiating voids are closer to one another (i.e. packed more closely, small land area (or second material) area between voids) along the striking surface imaginary vertical axis 620 than at the vertical reference axis of 0.25 inch 621 and 0.5 inch 622. Similarly, adjacent discrete concentric radiating voids are closer to one another (i.e. packed more closely, smaller land (or second material) area between voids) at the vertical reference axis of 0.25 inch 621 than at the vertical reference axis of 0.5 inch 622.

In many of the discrete concentric radiating voids embodiments, the percentage of the first material (or first material land area) along the 0.5-inch vertical reference axis can between approximately 20% and 40%. For example, the percentage of the first material along the 0.5 inch vertical reference axis can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material along the 0.5 inch vertical reference axis can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the discrete concentric radiating voids, the percentage of the first material (or first material land area) along the 0.25-inch vertical reference axis can be between approximately 30% and 50%. For example, the percentage of the first material along the 0.25 inch vertical reference axis can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material along the 0.25 inch vertical reference axis can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material along the 0.25 inch vertical reference axis can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete concentric radiating voids embodiments, the percentage of the first material (or first material land area) along the striking surface imaginary axis can between approximately 40% and 60%. For example, the percentage of the first material along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material along the striking surface imaginary axis can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material along the striking surface imaginary axis can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material land area percentage to the surface area of the second material land area percentage (measured along a respective vertical references axis) decreases from the striking surface imaginary vertical axis to the 0.5-inch vertical reference axis. This type of arrangement of the first material and the second material aid in providing consistent ball speeds across the striking surface as the average ratio along the striking surface imaginary vertical axis is greater (i.e. softer) than the average ratio along the 0.5 inch vertical reference axis. This counteracts the loss of energy transfer on heel and toe mishits.

Discrete Voids (Circular Pattern)

FIGS. 27-30 illustrate another exemplary embodiment according to the invention described herein. More particularly, FIGS. 27-30 illustrate an example of a putter-type golf club head 700 comprising a dual-material striking surface 707 comprising a first material 709 and a second material 710 arranged in a manner that normalizes ball speeds across the entire surface area of the striking surface 707. As mentioned above, the first material 709 is a softer material while the second material 710 is a harder material. The softer first material 709 will absorb more energy on impact, reducing the speed of the golf ball. By strategically varying the ratio of first material 709 to second material 710 across the striking surface 707, the responsiveness of the striking surface 707 at different locations can be controlled. Providing a varying ratio of first material 709 to second material 710 counteracts the variations in energy transfer caused by off-center strikes. The golf club head 700 of FIGS. 27-30 and the golf club head 300 of FIGS. 10-13 are similar in many respects, except for the differences described below.

Figure 27:
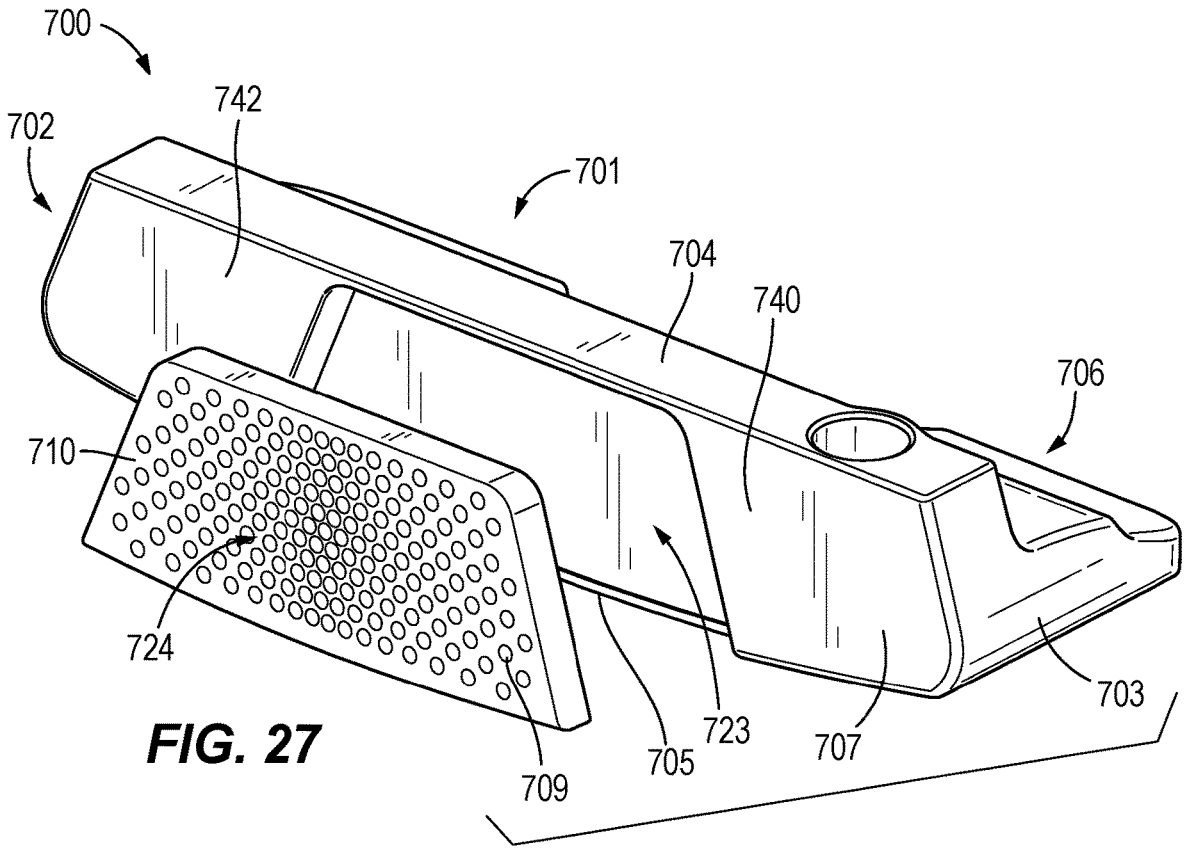
FIG. 27 shows a partially assembled view of a striking surface having discrete circular shaped voids for an insert style club head according to one embodiment.

FIG. 27 illustrates a putter-type golf club head 700 comprising a putter-body 701 having a toe portion 702, a heel portion 703 opposite the toe portion 702, a top rail portion 704, a sole portion 705 opposite the top rail portion 704, a portion of a striking surface 707, and a rear portion 706 opposite the striking surface portion 707. The striking surface 707 can further define a striking surface recess 723 defined by the heel portion 703, the toe portion 702, the top rail portion 704, the sole portion 705, and the rear portion 706 of the putter body 701. The striking surface recess 723 is configured to receive a face insert 724.

In many embodiments, as illustrated by FIG. 27, the striking surface recess 723 may be provided in only a portion of the striking surface 707. In the embodiment of FIG. 27, the striking surface recess 723 does not extend all the way to the heel portion 703 or the toe portion 704. As such, the striking surface 707 forms a striking surface heel portion 740 and a striking surface toe portion 742 that are located outside of the striking surface recess 723 and are formed by the putter body 701. In other embodiments, the striking surface recess 723 can substantially cover the entire striking surface 707, similar to the striking surface recess 323 of club head 300.

Figure 28:
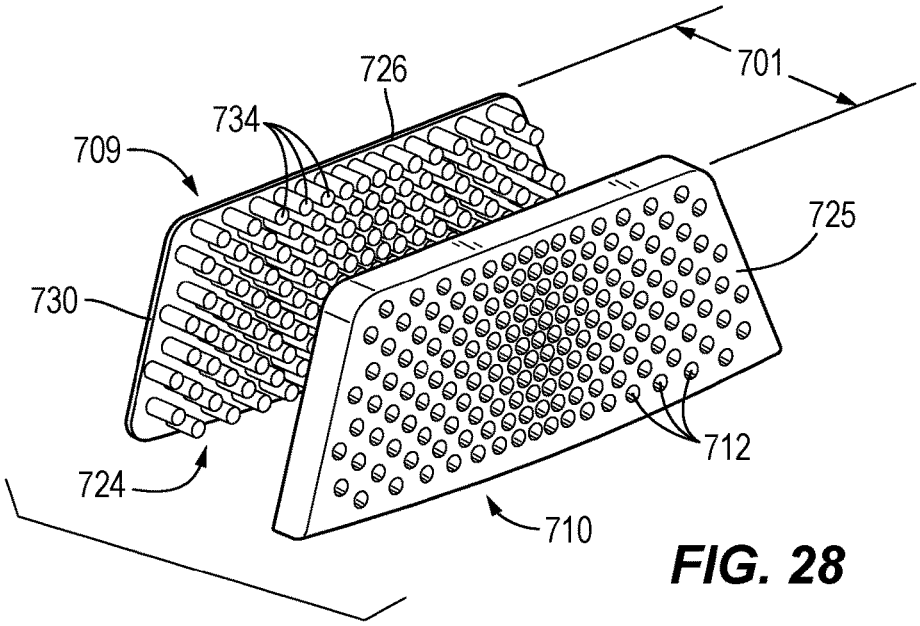
FIG. 28 shows an exploded view of the insert of FIG. 27.

FIG. 28 illustrates a two-part face insert 724 comprising discrete circular voids 712. In many embodiments, the putter insert 724 can be received within the striking surface recess 723. The putter insert 724 can comprise a shape complementary to the shape of the striking surface recess 723. It should be that noted in alternative embodiments, the putter-type golf club head 700 need not be an insert style putter. In such embodiments, the discrete circular voids 712 can be formed directly into the striking surface 707.

In the illustrated embodiment, the striking surface recess 723 and the corresponding putter insert 724 each form a substantially trapezoidal shape. In other embodiments, the striking surface recess 723 and the putter insert 724 can each form a different shape such as a rectangle, a square, or any other suitable shape.

FIGS. 27-30 illustrate the putter insert 724 comprising a first material 709 (also can be referred to as "first part") and a second material 710 (also can be referred to as "second part"). The first material 709 and second material 710 can be the same and/or similar to the first materials and second materials described in relation to previous embodiments. With specific reference to FIG. 28, the second part 710 forms (or defines) a plurality of discrete, circular shaped voids 712. The discrete circular voids 712 can extend through the entire thickness of the second part 710. These discrete, circular shaped voids 712 are arranged in a plurality of rows extending in a heel-to-toe direction and plurality of columns extending in a top rail-to-sole direction and do not connect (or touch) one another. The first material 709 has a hardness less than the second material 710. As such, the first material 709 will reduce the ball speed more than the second material 710 due to the softness of the first material 709. The first material 709 and second material 710 can be arranged on the striking surface 707 to normalize ball speed across the entire striking surface 707.

The second material 710 surrounds the circular shaped voids 712 to form second material land areas. The first part 709 of the putter insert 724 comprises a retention layer 730 forming a rearmost portion of the first part 709 and a plurality of cylindrical protrusions 734 extending from the retention layer 730 towards the striking surface 707. The plurality of cylindrical protrusions 734 can each be shaped complimentarily to a corresponding circular shaped void 712. Upon coupling the first part and the second part together, the plurality of circular protrusions 734 can each fill one of the circular shaped voids 712. The plurality of circular protrusions 734 can be flush with the second material land areas. Thereby, the first material 709 forms first material land areas substantially flush with the second material land areas. The first material land areas and the second material land areas engage with at least a portion of the golf ball upon golf ball impact. The first material land areas and the second material land areas combine to form a single, continuous striking surface 707 comprised of separate materials. The multi-material striking surface 707 can be configured to provide consistent ball speeds across the face.

In many cases, providing a continuous, multi-material striking surface 707 wherein the first material 709 land areas and the second material 710 land areas are flush with one another can provide an advantage over a groove system configured to normalize ball speed across the striking surface. The flat, smooth striking surface 707 formed by the multi-material insert 724 minimizes any unpredictable launch conditions that may be caused by the ball striking a groove irregularly (for example, striking the edge or corner of a groove). Further, the continuous striking surface 707 eliminates the possibility of dirt or other debris becoming trapped in a groove and compromising the ball speed normalization effect of the multi-material insert 724.

The embodiment of FIGS. 27-30 illustrates one possible arrangement where the circular voids 712 are arranged to form a denser, more packed center region creating more first material land areas than second material land areas. Because the surface area of impact between the striking surface 707 and the golf ball is very small (approximately 0.05 $in^2$ for a 25-foot putt), it can be advantageous for the circular voids 712 to be small and substantially tightly packed near the center region. This arrangement assures that regardless impact location, the golf ball will contact both a first material land area and a second material land area. If the discrete circular voids 712 are too large such that the second material land areas between adjacent voids are larger, or if the discrete circular voids 712 are not packed sufficiently tightly, the golf ball may contact only a first material land area or a second material land area for certain strikes. If the golf ball contacts only a first material land area or a second material land area, the ball speed will be lesser or greater, respectively, than intended.

Figure 29:
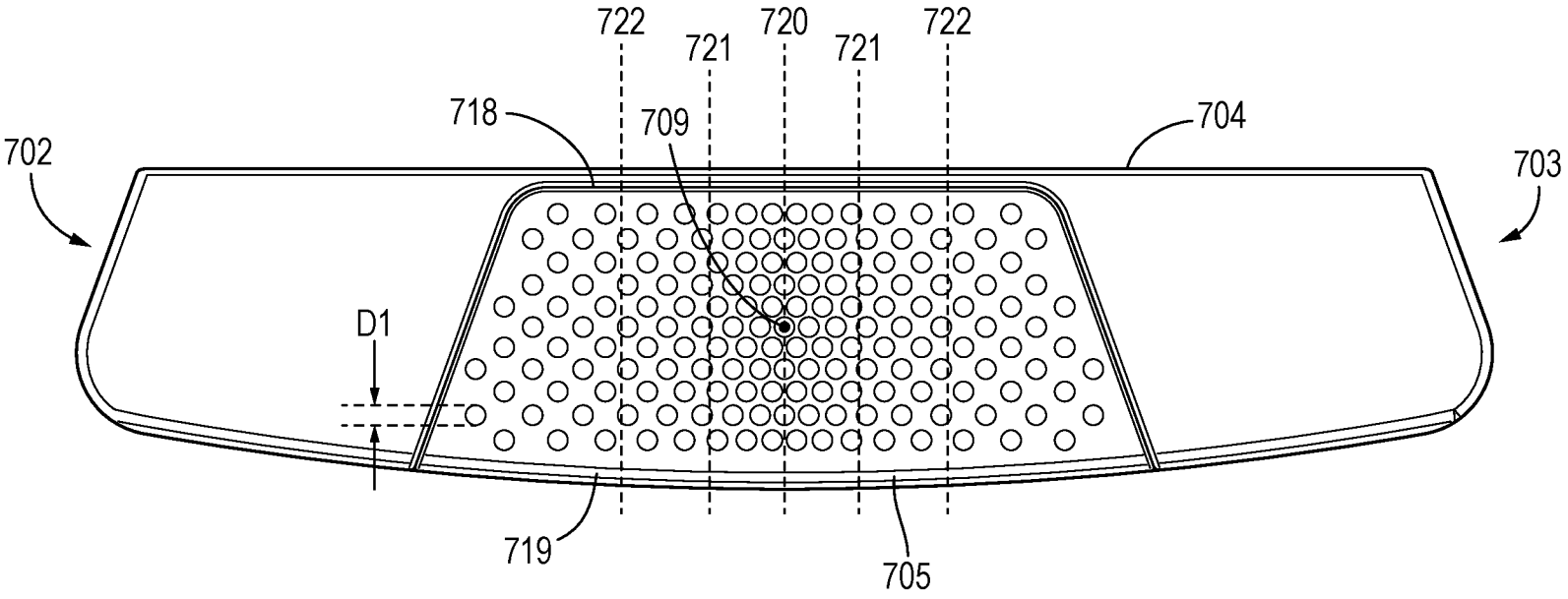
FIG. 29 shows a front view of the striking surface of FIG. 27
Figure 30:
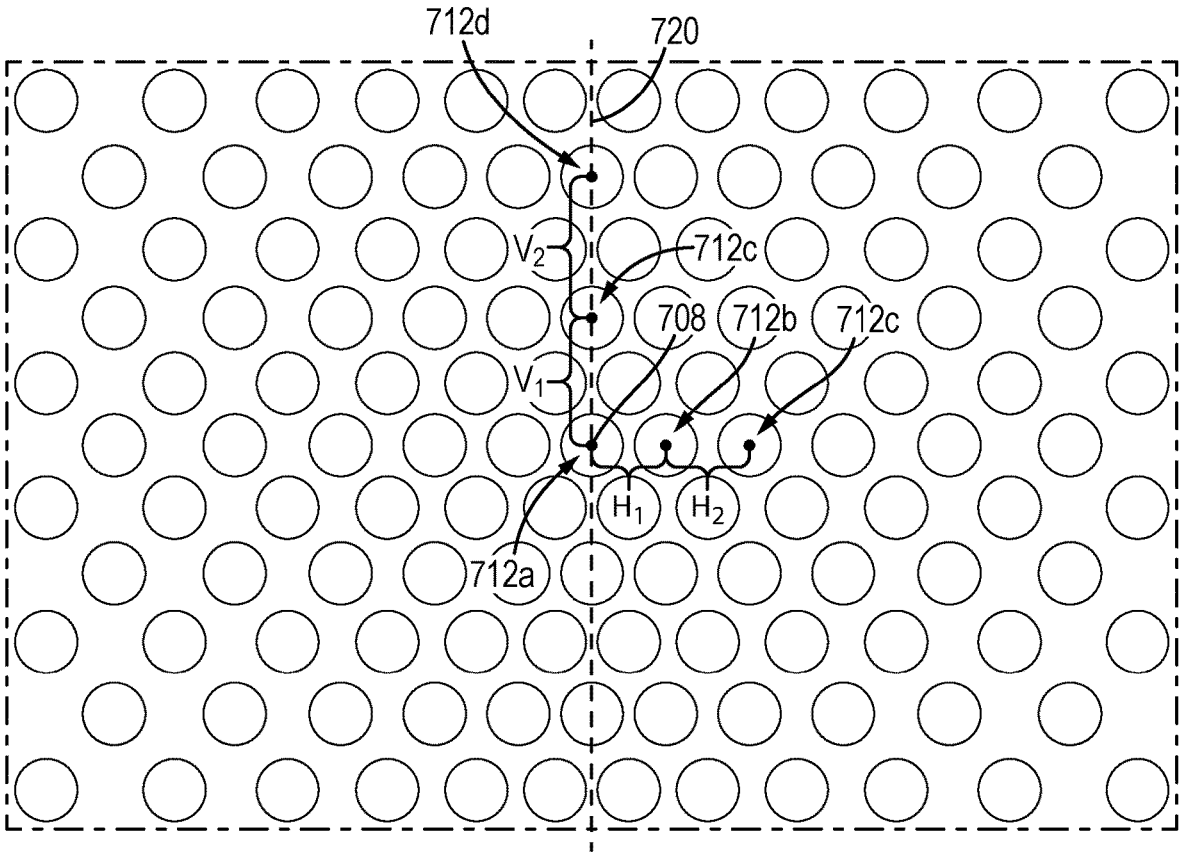
FIG. 30 shows a detailed view of the striking surface of FIG. 29.

Referencing FIG. 29, it can be seen that in any given row and/or column, the circular shaped voids 712 proximate the center region are spaced together closely, while the circular shaped voids 712 distal from the center region are spaced further apart. This arrangement creates a center region having a greater amount of first material land areas than second material land area. This creates a center region that is less responsive to ball impacts relative to regions surrounding the center. Therefore, as the spacing distance of the discrete circular voids 712 in a heel to toe direction and top to bottom direction increases away from the center region, the ratio between the first material and the second material varies too. Controlling the ratio between the first material 709 and second material 710 at different regions along the face allows ball speeds across the striking surface 707 to be consistent. The first material 709 will have a higher concentration near the geometric center 708 of the striking surface 707. Similarly, the second material 710 will have a higher concentration distal of the geometric center 708, and nearer to the toe portion 702 and heel portion 703. The higher concentration of first material 709 near the geometric center 708 normalizes ball speed across the face by reducing the ball speed of center impacts.

Moving away from the center region toward the heel 703 or toe 702 along a given row, the spacing distance between adjacent discrete circular shaped voids 712 increases. This arrangement creates more second material land areas, which aids in gradually creating a more responsive region away from the center region towards the heel 703 and toe 702 regions to consistently control ball speeds across the striking surface 707.

Similarly, moving away from the center region toward the top rail 704 or sole 705 along a given column, the spacing distance between adjacent discrete circular shaped voids 712 increases. This arrangement creates more second material land areas, which aids in gradually creating a more responsive region away from the center region towards the top rail 704 and sole 705 to consistently control ball speeds across the striking surface 707.

In other embodiments (not shown), the first material land area only varies in a heel 703 to toe 702 direction and not a top rail 704 to sole 705 direction. In such embodiments, the spacing distance between each of the of the first material land areas is substantially the same or constant in a top rail 704 to sole 705 direction.

In alternative embodiments (Not shown), the ratio between the first material 709 and the second material 710 throughout different regions of the insert 724 can be controlled by varying the size of the discrete circular voids 712 that are formed through the second material 710 and filled by the first material 709. Each of the discrete circular voids 712 can comprise a diameter D1. In any given row, the circular shaped voids 712 proximate the center region can be provided with substantially large diameters D1, while the circular shaped voids 712 distal from the center region can be provided with smaller diameters D1. Moving away from the center region toward the heel 703 or toe 702 along a given row, the diameter D1 of each discrete circular shaped void 712 can progressively decrease, creating more second material 710 land areas and less first material 709 land areas near the heel 703 and toe 702. This provides the same effect of consistently controlling ball speeds across the striking surface 707, as does progressively increasing the spacing distance of the discrete circular shaped voids 712. By progressively spacing the distance between adjacent circular shaped voids 712 away from the geometric center 708, progressively decreasing the diameter D1 of each circular shaped void 712 away from the geometric center 708, or a combination thereof provides increased energy transfer near the heel portion 703 and toe portion 702 relative to the center. The variation in energy transfer provides more consistent ball speeds across the face FIG. 28 illustrates an exploded view of the putter insert 724 comprising discrete circular shaped voids. The putter insert 724 can comprise a front surface 725 adapted for impact with a golf ball (not shown) and a rear surface 726 opposite the front surface 725. A putter insert thickness (i.e. depth) 727 can be defined as the maximum perpendicular distance between the front surface 725 and the rear surface 726 of the putter insert 724.

Further, in many embodiments, the first part 709 of the insert 724 comprises a retention layer 730 that forms at least a substantial portion of the insert rear surface 726. The retention layer 730 serves multiple purposes. Providing the insert 724 with the retention layer 730 helps facilitate the flow of the first material 709 during the co-molding process (described in further detail below). The retention layer 730 can serve as a high-volume reservoir that helps evenly distribute the first material 709 as the first material 709 is injected through one or more of the relatively low-volume discrete circular voids 712. The retention layer 730 can further provide stability to the first material 709 during use of the club head 700. The retention layer 730 retains the first material 709 in the insert 724 during impact with a golf ball and keeps bits of the first material 709 from falling out of the discrete circular shaped voids 712. Further, the retention layer 730 can enhance the sound and feel of the club head 700 at impact. The retention layer 730 provides a relatively soft first material 709 against the surface of the striking surface recess 723, wherein the first material 709 can damp undesirable vibrations.

In some embodiments, similar to the inserts of FIGS. 6-23, the first material 709 can entirely form the rear surface 726 of the insert 724. Forming the entire rear surface 726 with the first material 709 can maximize the damping effect of the insert 724. However, in many embodiments, such as the embodiment of FIG. 27-30, the first material 709 only covers a portion of the rear surface 726, such that the remaining portion of the rear surface 726 (in many embodiments the perimeter of the rear surface 726) is formed by the second material 710. Forming the insert rear surface 726 by both the first material 709 and the second material 710 can allow for stronger adhesion between the insert 724 and the putter body 701.

In many embodiments, the first material 709 further fills each of the discrete circular voids 712 (until flush with the front surface 725 of the insert) of the pluralities of discrete circular shaped voids 712. The second material 710 surrounds the first material 709, so that upon golf ball impact the first material 709 and the second material 710 can each engage to least a portion of the golf ball.

In many embodiments, as illustrated by FIG. 29, each discrete circular shaped void 712 can comprise the same diameter D1 (referred to as a "common diameter"). In other embodiments (not shown), the diameter D1 of each discrete circular shaped void 712 can vary in a heel-to-toe direction. In the illustrated embodiment, the diameter D1 of each discrete circular shaped void 712 is approximately 0.0625 inch. In other embodiments the diameter D1 of one or more discrete circular shaped void(s) 712 can range from approximately 0.01 inches to approximately 0.15 inches. In some embodiments, the diameter D1 of each discrete circular shaped void 712 can be between 0.01 and 0.03 inches, between 0.03 and 0.05 inches, between 0.05 and 0.07 inches, between 0.07 and 0.09 inches, between 0.09 and 0.11 inches, between 0.11 and 0.13 inches, or between 0.13 and 0.15 inches. In some embodiments, the diameter D1 of each discrete circular shaped void 712 can be approximately 0.01 inches, 0.02 inches, 0.03 inches, 0.04 inches, 0.05 inches, 0.06 inches, 0.07 inches, 0.08 inches, 0.09 inches, 0.10 inches, 0.11 inches, 0.12 inches, 0.13 inches, 0.14 inches, or 0.15 inches.

In many embodiments, the diameter D1 of each discrete circular void 712 can be substantially small. Smaller diameters D1 allows the discrete circular voids 712 near the center region to be more tightly packed and provide a greater potential ratio of first material land areas to second material land areas near the geometric center 708. In some embodiments, the diameter D1 of each discrete circular void 712 can be less than 0.10 inch, less than 0.095 inch, less than 0.090 inch, less than 0.085 inch, less than 0.080 inch, less than 0.075 inch, less than 0.070 inch, less than 0.065 inch, less than 0.060 inch, less than 0.055 inch, or less than 0.050 inch.

As illustrated by FIG. 29, the horizontal spacing distance between each discrete circular shaped void 712 can vary across the striking surface 707. The horizontal spacing distance between each discrete circular shaped void 712 can be measured as the center-to-center distance between adjacent circular shaped voids 712 within a given row. In the illustrated embodiment, the minimum horizontal void spacing H is approximately 0.073 inch and the maximum horizontal void spacing H is approximately 0.152 inch. In many embodiments, the horizontal spacing distance H between each discrete circular shaped void 712 can range between approximately 0.05 inches and approximately 0.20 inches. In many embodiments, the horizontal spacing distance H between a given pair of adjacent discrete circular shaped voids 712 can be between 0.05 and 0.075 inches, between 0.075 and 0.10 inches, between 0.10 and 0.125 inches, between 0.125 and 0.15 inches, between 0.15 and 0.175 inches, or between 0.175 and 0.20 inches. In many embodiments, the spacing distance between a given pair of adjacent discrete circular shaped voids 712 can be between 0.05 and 0.10 inches, between 0.075 and 0.125 inches, between 0.10 and 0.15 inches, between 0.125 and 0.175 inches, or between 0.15 and 0.20 inches.

In many embodiments, to achieve tight spacing of the circular shaped voids 712 near the geometric center 708, the minimum horizontal spacing distance H occurs near the striking surface imaginary vertical axis 720. In some embodiments, the minimum horizontal spacing distance H can be less than 0.15 inch, less than 0.14 inch, less than 0.13 inch, less than 0.12 inch, less than 0.11 inch, less than 0.10 inch, less than 0.09 inch, less than 0.08 inch, or less than 0.07 inch.

As illustrated by FIG. 29, the spacing distance between each discrete circular shaped void 712 can vary in a top-to-bottom direction. The spacing distance between each discrete circular shaped void 712 can be measured as the center-to-center distance V between adjacent circular shaped voids 712 in a vertical direction. In the illustrated embodiment, the minimum vertical spacing distance V is approximately 0.062 inch and the maximum vertical spacing distance V is approximately 0.0735 inch. In many embodiments, the vertical spacing distance V between each discrete circular shaped void 712 can range between approximately 0.04 inches and approximately 0.1 inches. In many embodiments, the vertical spacing distance V between a given pair of adjacent discrete circular shaped voids 712 can be between 0.08 and 0.20 inches, between 0.10 and 0.12 inches, between 0.12 and 0.14 inches, between 0.14 and 0.16 inches, between 0.16 and 0.18 inches, or between 0.18 and 0.20 inches.

In order to provide a tightly packed arrangement of discrete circular shaped voids 712, the minimum vertical spacing distance V must be large enough to stagger the rows and columns. In some embodiments, the minimum vertical spacing distance V can be greater than 0.10 inch, greater than 0.105 inch, greater than 0.11 inch, greater than 0.115 inch, greater than 0.12 inch, greater than 0.125 inch, greater than 0.13 inch, greater than 0.135 inch, greater than 0.14 inch, greater than 0.145 inch, or greater than 0.15 inch.

The ratio between first material 709 and second material 710 at different regions along the face is determined, in large part, by the spacing between adjacent discrete circular shaped voids 712 in both the heel-to-toe direction and the top rail-to-sole direction. In particular, the rate at which the spacing between adjacent circular shaped voids 712 increases away from the geometric center 708 is significant in providing the desired ratio between first material 709 and second material 710 at any given region of the striking surface 707.

The spacing of the discrete circular shaped voids 712 can be characterized by a horizontal center-to-center distance H between adjacent circular shaped voids 712 in a given row and a vertical center-to-center distance V between adjacent circular shaped voids 712 in a given column. It should be noted that adjacent circular shaped voids 712 in a given column are defined as the closest circular shaped voids 712 aligned in vertical direction. Due to the staggering of the rows and columns, the adjacent circular shaped voids 712 in a given column are separated by the adjacent circular shaped voids 712 in the staggered rows in between.

In many embodiments, the horizontal center-to-center distance between adjacent circular-shaped voids increases exponentially from the striking surface imaginary vertical axis 720 toward the heel portion 703 and the toe portion 702. In many embodiments, the horizontal center-to-center distance between adjacent circular-shaped voids 712 is governed by equation (1):

$$H_i = H_1 * B_H^{(i-1)}. \quad (1)$$

Referring to equation (1), $H_i$ is the horizontal center-to-center distance between a given pair of adjacent circular-shaped voids 712, and $B_H$ is a constant. $H_1$ represents the horizontal center-to-center distance H between a central circular-shaped void 712*a* and an adjacent circular-shaped void 712*b* located further away from the striking surface imaginary vertical axis 720. Similarly, $H_1$ represents the horizontal center-to-center distance H between circular-shaped void 712*b* and an adjacent circular-shaped void 712*c* located further away from the striking surface imaginary vertical axis 720. For the illustrated embodiment, wherein the spacing between adjacent circular-shaped voids 712 increases away from the striking surface imaginary vertical axis 720, $B_H$ is greater than 1.

In many embodiments, the vertical center-to-center distance V between adjacent circular-shaped voids 712 increases exponentially from the geometric center 708 toward the top rail 704 and the sole portion 705. In many embodiments, the vertical center-to-center distance V between adjacent circular-shaped voids 712 is governed by equation (1):

$$V_i = V_1 * B_V^{(i-1)} \quad (1)$$

Referring to equation (1), $V_i$ is the horizontal center-to-center distance between a given pair of adjacent circular-shaped voids 712, and $B_V$ is a constant. $V_1$ represents the vertical center-to-center distance V between a central circular-shaped void 712*a* and an adjacent circular-shaped void 712*d* located further away from the geometric center 708. Similarly, $V_2$ represents the vertical center-to-center distance V between circular-shaped void 712*d* and an adjacent circular-shaped void 712*e* located further away from the geometric center 708. For the illustrated embodiment, wherein the spacing between adjacent circular-shaped voids 712 increases away from the geometric center 708, $B_V$ is greater than 1.

The present embodiment is not limited by the circular shape of the plurality of discrete voids 712. In some embodiments, the plurality of discrete voids 712 can be pill shaped, elliptical, hexagonal, rectangular, ovular, triangular, octagonal, trapezoidal, or any other desired shape. In some embodiments, the plurality of discrete voids 712 can be any desired shape or can be shaped similarly to the plurality of discrete voids in any of the above embodiments.

In the same or other of discrete circular shaped void 712 embodiments, the plurality of discrete circular shaped voids 712 can be positioned in substantially horizontal rows and/or substantially vertical columns. In the illustrated embodiment, referring to FIG. 29, adjacent rows and adjacent columns of the discrete circular shaped voids 712 can be staggered. Staggering adjacent rows and columns allows for a tighter spacing of the discrete circular voids 712 near the center region. For example, in some embodiments (not shown) wherein the columns and rows are arranged in a grid-like pattern (i.e. not staggered), the second material land areas between adjacent circular shaped voids 712 would be greater than the staggered arrangement.

In the exemplary embodiment of FIG. 29, the plurality of discrete circular shaped voids 712 are arranged to form ten rows and thirty-five columns. In alternative embodiments, the plurality of discrete circular shaped voids 712 can be arranged to form two or more rows, three or more rows, four or more rows, five or more rows, six or more rows, seven or more rows, eight or more rows, nine or more rows, ten or more rows, eleven or more rows, twelve or more rows, thirteen or more rows, fourteen or more rows, fifteen or more rows, sixteen or more rows, seventeen or more rows, eighteen or more rows, nineteen or more rows, or twenty or more rows. In the same or alternative embodiments, the plurality of discrete circular shaped voids 712 can be arranged to form two or more columns, three or more columns, four or more columns, five or more columns, six or more columns, seven or more columns, eight or more columns, nine or more columns, ten or more columns, eleven or more columns, twelve or more columns, thirteen or more columns, fourteen or more columns, fifteen or more columns, sixteen or more columns, seventeen or more columns, eighteen or more columns, nineteen or more columns, twenty or more columns, twenty-one or more columns, twenty-two or more columns, twenty-three or more columns, twenty-four or more columns, twenty-five or more columns, twenty-six or more columns, twenty-seven or more columns, twenty-eight or more columns, twenty-nine or more columns, thirty or more columns, thirty-one or more columns, thirty-two or more columns, thirty-three or more columns, thirty-four or more columns, thirty-five or more columns, thirty-six or more columns, thirty-seven or more columns, thirty-eight or more columns, thirty-nine or more columns, or forty or more columns. As will be further described below, aligning the circular shaped voids 712 in rows and columns permits an appropriate ratio between the first material 709 and second material 710 along a vertical reference axis 720.

As can be seen in the exemplary embodiment of FIGS. 27-30, each of the plurality of discrete circular shaped voids 712 are spaced from one another in both a heel-to-toe direction and a top rail-to-sole direction. This is dissimilar from the continuous groove or recesses embodiments of FIGS. 1-9 which are continuously connected in the heel-to-toe direction. Each row or column can have two or more discrete circular shaped voids 712, three or more discrete circular shaped voids 712, four or more discrete circular shaped voids 712, five or more discrete circular shaped voids 712, six or more discrete circular shaped voids 712, seven or more discrete circular shaped voids 712, eight or more discrete circular shaped voids 712, nine or more discrete circular shaped voids 712, ten or more discrete circular shaped voids 712, eleven or more discrete circular shaped voids 712, twelve or more discrete circular shaped voids 712, thirteen or more discrete circular shaped voids 712, fourteen or more discrete circular shaped voids 712, fifteen or more discrete circular shaped voids 712, sixteen or more discrete circular shaped voids 712, seventeen or more discrete circular shaped voids 712, eighteen or more discrete circular shaped voids 712, nineteen or more discrete circular shaped voids 712, or twenty or more discrete circular shaped voids 712.

In the illustrated embodiment, the volume of the first material 709 that fills each discrete circular shaped void 712 is approximately 0.000565 $in^3$. In other embodiments, the volume of first material 709 that fills each discrete circular shaped void 712 can range from 0.00009 $in^3$ to 0.005 $in^3$. In other embodiments, the volume of first material 709 that fills each discrete circular shaped void 712 can vary in a heel-to-toe direction. In many embodiments, first material 709 can fill a volume between 0.0000803 $in^3$-0.004 $in^3$. In some embodiments, the first material 709 can fill a volume between 0.0000803 $in^3$-0.004 $in^3$, 0.000176 $in^3$-0.004 $in^3$, 0.000272 $in^3$-0.004 $in^3$, 0.000368 $in^3$-0.004 $in^3$, 0.000464 $in^3$-0.004 $in^3$, 0.00056 $in^3$-0.004 $in^3$, 0.00065 $in^3$-0.004 $in^3$, 0.0075 $in^3$-0.004 $in^3$, 0.000849 $in^3$-0.004 $in^3$, or 0.000945 $in^3$-0.004 $in^3$. In other embodiments, the first material 709 can fill a volume between 0.00035 $in^3$-0.00187 $in^3$. Having the first material 709 fill discrete voids of this size more accurately controls the adjustment resolution between the first material 709 and the second material 710 to create a consistent ball speed across the striking surface 707 and enhanced impact feel and sound.

In many of the discrete circular void embodiments, when the club head 700 is at an address position, the striking surface 707 comprises a striking surface imaginary vertical axis 720 that extends through a geometric center 708 of the striking surface 707 in a top rail-to-sole direction (as shown by FIG. 29). Further, offset from the striking surface imaginary vertical axis 720 in both a heel 703 and toe 702 direction at 0.25 inch and 0.50 inch are corresponding vertical reference axes 721, 722.

As further illustrated in FIG. 29, adjacent discrete circular shaped voids 712 are closer to one another (i.e. packed more closely, small (second material) land area between discrete voids) along the striking surface imaginary vertical axis 720 in a horizontal direction than at the vertical reference axis of 0.25 inch 721 and 0.5 inch 722. Similarly, adjacent discrete circular shaped voids 712 are closer to one another (i.e. packed more closely, smaller land (or second material) area in a horizontal direction between discrete circular shaped voids 712) at the vertical reference axis of 0.25 inch 721 than at the vertical reference axis of 0.5 inch 722. In alternative embodiments (not shown), adjacent discrete circular shaped voids 712 can be closer to one another in a vertical direction along the striking surface imaginary vertical axis 720 than at the vertical reference axes 721, 722 of 0.25 inch and 0.5 inch. Similarly, in such embodiments, adjacent discrete circular shaped voids 712 can be closer to one another in a vertical direction at the vertical reference axis 721 of 0.25 inch than at the vertical reference axis 722 of 0.5 inch. Closely packing the discrete circular shaped voids 712 near the imaginary vertical axis 720 as compared to the 0.25 inch and 0.5 inch vertical reference axes 721, 722 provides the striking surface 707 with a higher level of responsiveness near the heel 703 and toe 702. This arrangement helps normalize ball speeds across the striking surface 707 by counteracting a loss of ball speed associated with a heel or toe mis-hit.

In the illustrated embodiment, the percentage of the first material 709 along the 0.5 inch vertical reference axis 722 is approximately 36.79%. In many other of the discrete circular shaped void 712 embodiments, the percentage of the first material 709 along the 0.5-inch vertical reference axis 722 can between approximately 20% and 45%. For example, the percentage of the first material 709 along the 0.5 inch vertical reference axis 722 can be 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, or 45%. For further example, the percentage of the first material 709 along the 0.5 inch vertical reference axis 722 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 709 along the 0.5 inch vertical reference axis 722 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In the illustrated embodiment, the percentage of first material 709 along the 0.25 inch vertical reference axis 721 is approximately 49.85%. In many other of the discrete circular shaped void 712 embodiments, the percentage of the first material 709 (or first material land area) along the 0.25-inch vertical reference axis 721 can be between approximately 30% and 60%. For example, the percentage of the first material 709 along the 0.25 inch vertical reference axis 721 can be 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 709 along the 0.25 inch vertical reference axis 721 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 709 along the 0.25 inch vertical reference axis 721 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the discrete circular shaped void 712 embodiments, the percentage of the first material 709 (or first material land area) along the striking surface imaginary axis 720 can between approximately 55% and 75%. For example, the percentage of the first material 709 along the striking surface imaginary axis 720 can be 55%, 56%, 57%, 58%, 59%, 60%, 61%, 62%, 63%, 64%, 65%, 66%, 67%, 68%, 69%, 70%, 71%, 72%, 73%, 74%, or 75%. For further example, the percentage of the first material 709 along the striking surface imaginary axis 720 can be greater than 55%, greater than 56%, greater than 57%, greater than 58%, greater than 59%, greater than 60%, greater than 61%, greater than 62%, greater than 63%, greater than 64%, greater than 65%, greater than 66%, greater than 67%, greater than 68%, greater than 69%, or greater than 70%. In alternative embodiments, the percentage of the first material 709 along the striking surface imaginary axis 720 can be less than 55%, less than 56%, less than 57%, less than 58%, less than 59%, less than 60%, less than 61%, less than 62%, less than 63%, less than 64%, less than 65%, less than 66%, less than 67%, less than 68%, less than 69%, less than 70%, less than 71%, less than 72%, less than 73%, less than 74%, or less than 75%.

Further, in many embodiments, the average ratio defined as the surface area of the first material 709 land area percentage to the surface area of the second material 710 land area percentage (measured along a respective vertical reference axis) decreases from the striking surface imaginary vertical axis 720 to the 0.5-inch vertical reference axis 722. This type of arrangement of the first material 709 and the second material 710 aid in providing consistent ball speeds across the striking surface 707 as the average ratio along the striking surface imaginary vertical axis 720 is greater (i.e. softer) than the average ratio along the 0.5 inch vertical reference axis 722. This counteracts the loss of energy transfer on heel and toe mis-hits.

Additionally, in this exemplary embodiment variable thickness (or depth) discrete voids 712 are not needed to create consistent ball speeds across the striking surface. Consistent ball speeds are achieved as the discrete circular shaped voids 712 vary in diameter D1 and/or spacing distance, creating differing first material 709 and second material 710 ratios along a vertical direction.

Quadrants with Angled Voids

Figure 32:
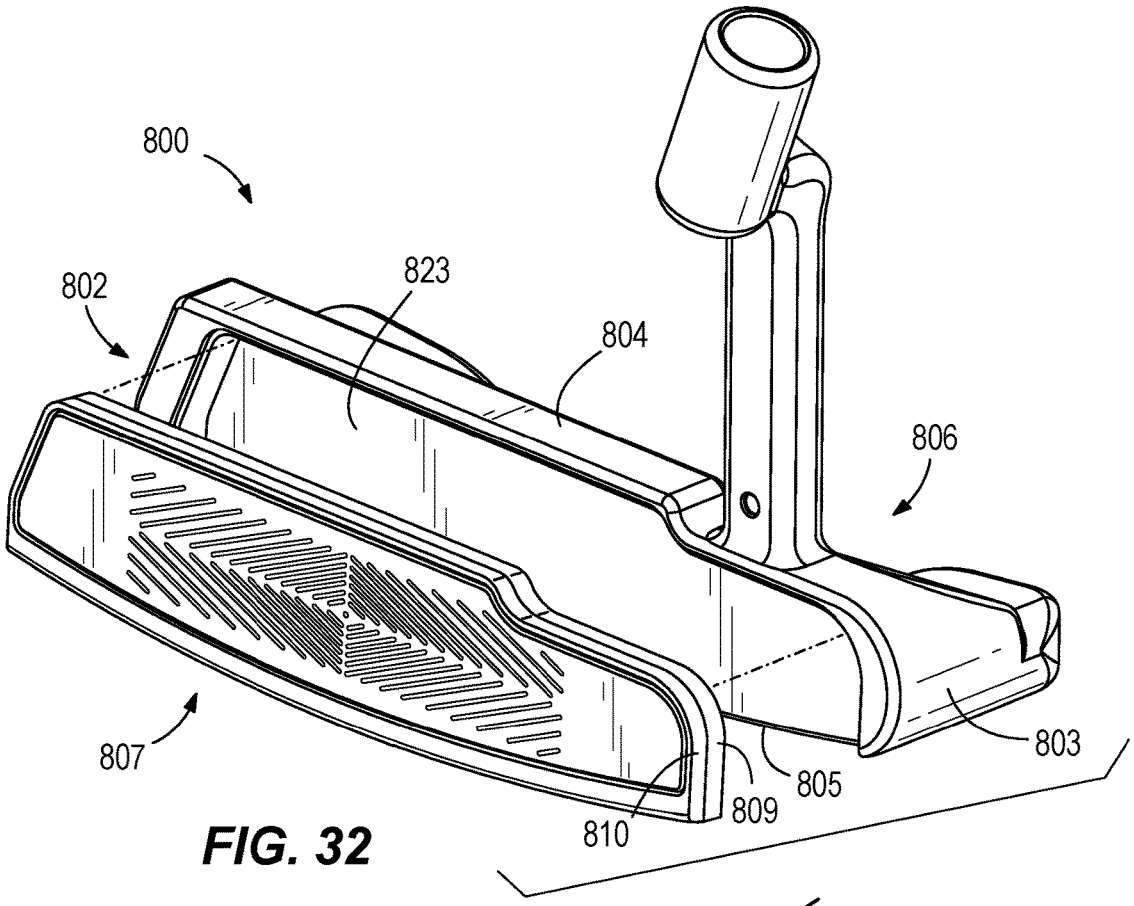
FIG. 32 shows a partially assembled view of a striking surface having angled voids arranged in quadrants according to one embodiment.
Figure 33:
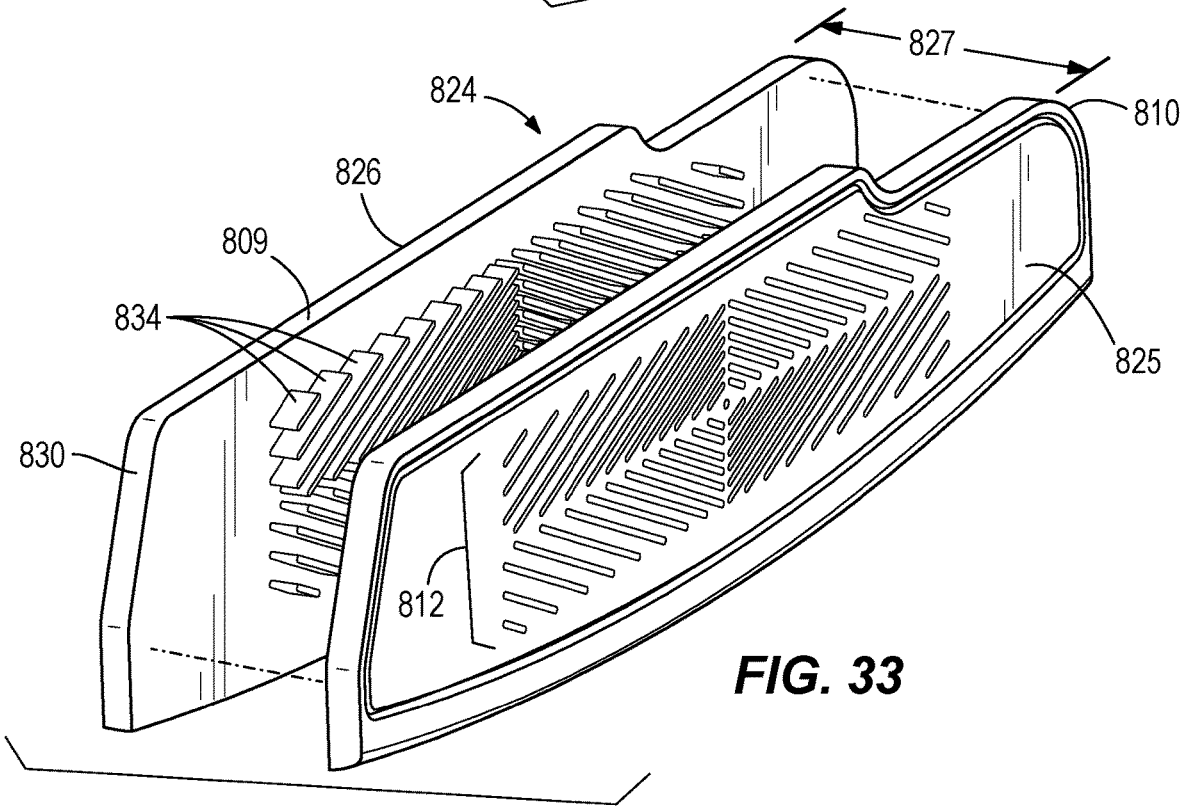
FIG. 33 shows an exploded view of the insert of FIG. 31.
Figure 34:
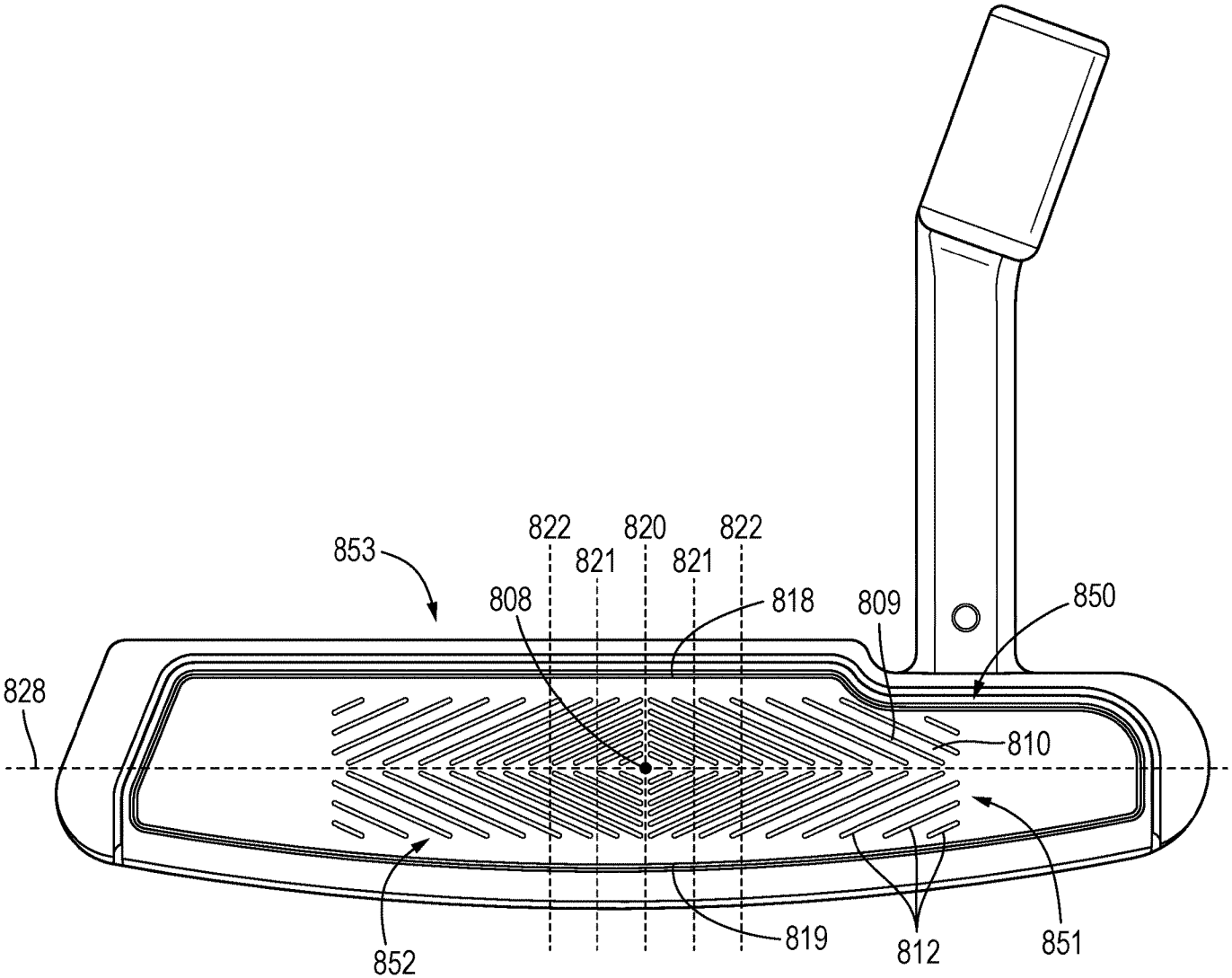
FIG. 34 shows a front view of the club head of FIG. 31.

FIGS. 32-34 illustrate another exemplary embodiment according to the invention described herein. More particularly, FIGS. 32-34 illustrate an example of a putter-type golf club head 800 comprising a dual-material striking surface 807 comprising a first material 809 and a second material 810. The first material 809 and second material 810 arranged in a manner that define four distinct quadrants. This arrangement normalizes ball speed across the striking surface 807. As mentioned above, the first material 809 is softer than the second material 810. The softer first material 809 will absorb more energy on impact, reducing the speed of the golf ball. By strategically varying the ratio of first material 709 to second material 810 across the striking surface 807, the responsiveness of the striking surface 807 at different locations can be controlled. Providing a varying ratio of first material 809 to second material 810 counteracts the variations in energy transfer caused by off-center strikes. The golf club head 800 of FIGS. 32-34 and the golf club head 300 of FIGS. 10-13 are similar in many respects, except for the differences described below.

FIG. 32 illustrates a putter-type golf club head 800 comprising a putter-body 801 having a toe portion 802, a heel portion 803 opposite the toe portion 802, a top rail portion 804, a sole portion 805 opposite the top rail portion 804, a portion of a striking surface 807, and a rear portion 806 opposite the striking surface portion 807. The striking surface portion 807 can further define a striking surface recess 823 defined by the heel portion 803, the toe portion 802, the top rail portion 804, the sole portion 805, and the rear portion 806 of the putter body 801. The striking surface recess 823 is configured to receive a face insert 824.

FIG. 32 illustrates a two-part putter insert 824 comprising four quadrants of angled voids 812. In many embodiments, the putter insert 824 can be received within the striking surface recess 823. The putter insert 824 can comprise a shape complementary to the shape of the striking surface recess 823. It should be noted that in alternative embodiments, the putter-type golf club head 800 need not be an insert style putter head. In such embodiments, the angled voids 812 can be formed directly into the striking surface 807.

FIGS. 32-34 illustrate the putter insert 824 comprising a first material 809 (also can be referred to as "first part") and a second material 810 (also can be referred to as "second part"). The first material 809 and second material 810 can be the same and/or similar to the first materials and second materials described in relation to previous embodiments. With specific reference to FIG. 33, the second part 810 forms (or defines) a plurality of angled voids 812 which are filled by the first material 809. The angled voids 812 can extend through the entire thickness of the second part 810. These angled voids 812 are arranged in four quadrants. The first material 809 has a hardness less than the second material 810. As mentioned above, this arrangement of voids in combination with the first material 809 and second material 810 provide a striking surface 807 with normalized ball speeds across the striking surface 807.

The four quadrants are defined by a horizontal axis 828 and a vertical axis 820. The horizontal axis 828 extends through the face center 808 in a heel-to-toe direction and is approximately parallel to the ground. The vertical axis 820 extends through the face center 808 and is perpendicular to the horizontal axis 828. As illustrated in FIG. 34, the horizontal axis 828 and vertical axis 820 divide the striking surface 807 into four quadrants; an upper heel quadrant 850, a lower heel quadrant 851, a lower toe quadrant 852, and an upper toe quadrant 853. As mentioned above, each quadrant comprises a set of angled voids 812 that are filled by the first material 809.

The angled voids 812 in each quadrant are arranged in a parallel manner such that each angled void 812 within a quadrant is parallel to the adjacent voids 812 in the same quadrant. The angled voids 812 in each quadrant extends from the horizontal axis 828 to the vertical axis 820 at an angle. The angled voids 812 can form an angle between the horizontal axis 828 or vertical axis 820 ranging from 20 to 70 degrees. In the illustrated embodiment, the angled voids 812 located in the upper heel quadrant 850 and in the lower toe quadrant 852 (i.e., quadrants that are diagonal of each other) are angled, or oriented, in the same direction such they are parallel. Similarly, the angled voids 812 in the upper toe quadrant 853 and lower heel 851 quadrant are angled, or oriented, in the same direction such they are parallel. In the illustrated embodiment, each angled void 812 in the upper heel quadrant 850 and the lower toe quadrant 852 extends diagonally in an upper toe 802 to lower heel 803 direction.

Near the geometric center 808 of the striking surface 807, the angled voids 812 of each quadrant converge with the angled voids 812 in the adjacent quadrants at the horizontal axis 828 and vertical axis 820. In some embodiments, the angled voids 812 intersect and connect with the angled voids 812 of the adjacent quadrant such that the angled voids 812 are continuous across adjacent quadrants. In other embodiments, the angled voids 812 near the geometric center 808 can terminate short of the horizontal axis 828 or vertical axis 820 such that there is a space between adjacent angled voids 812.

The second material 810 surrounds the angled voids 812 to form second material 810 land areas. The first part of the putter insert 824 comprises a retention layer 830 and a plurality of protrusions 834 that are complimentary to corresponding voids 812. Upon coupling the first part 809 and the second part 810 together, the plurality of protrusions 834 sit flush with second material 810 land areas. Thereby, the first material 809 forms first material 809 land areas substantially flush with the second material 810 land areas. The first material 809 land areas and the second material 810 land areas combine to form a single, continuous striking surface 807 and engage with at least a portion of the golf ball upon golf ball impact.

In many cases, providing a continuous, multi-material striking surface 807 wherein the first material 809 land areas and the second material 810 land areas are flush with one another can provide an advantage over a groove system configured to normalize ball speed across the striking surface. The flat, smooth striking surface 807 formed by the multi-material insert 824 minimizes any unpredictable launch conditions that may be caused by the ball striking a groove irregularly (for example, striking the edge or corner of a groove). Further, the continuous striking surface 807 eliminates the possibility of dirt or other debris becoming trapped in a groove and compromising the ball speed normalization effect of the multi-material insert 824.

This embodiment illustrates one possible arrangement where the angled voids 812 are arranged to form a denser, more packed center region creating more first material 809 land areas than second material 810 land areas. Referencing FIG. 34, it can be seen that in each quadrant, the angled voids 812 that are proximate to the center region are spaced closer together than the angled voids 812 that are distal the center region. This arrangement creates a center region having a greater amount of first material 809 land areas than second material 810 land area. This creates a center region that is less responsive to ball impacts relative to heel portion 803 or toe portion 802 and in top to bottom direction due to the angle and orientation of the voids 812. Controlling the ratio between the first material 809 and second material 810 at different regions along the striking surface 807 allows ball speeds across the striking surface 807 to be consistent.

Moving away from the center region along the horizontal axis 828 and/or vertical axis 820, the spacing distance between voids 812 in the same quadrant increases. This creates more second material 810 land areas, which aids in gradually creating a more responsive region away from the center region towards the heel portion 703 and toe portion 702 and in a top and bottom region to consistently control ball speeds across the entirety of the striking surface 807.

In alternative embodiments (Not shown), the ratio between the first material 809 and the second material 810 throughout different regions of the insert 824 can be controlled by varying the size of the voids 812. Each of the angled void 812 can comprise a width. In any given row, the voids 812 proximate the center region can be provided with substantially large widths, while the voids 812 distal from the center region can be provided with smaller widths. Moving away from the center along the horizontal axis 828 and/or vertical axis 820, the width of each void 812 can progressively decrease, creating more second material 810 land areas near the heel portion 703 and toe portion 702 and the top and the bottom. This provides the same effect of consistently controlling ball speeds across the striking surface 807, as does progressively increasing the spacing distance of the voids 812.

With continued reference to FIG. 33, FIG. 33, illustrates an exploded view of the putter insert 824 comprising angled voids 812. The insert 824 can comprise of a front surface 825 adapted for impact with a golf ball (not shown) and a rear surface 826 opposite the front surface 825. A putter insert thickness (i.e. depth) 827 can be defined as the maximum perpendicular distance between the front surface 825 and the rear surface 826. For example, FIGS. 32-34 illustrate the insert 824 having a plurality of voids 812 (defined by the second material) extending entirely through the second material 810 thickness (i.e. depth) 827.

Further, in many embodiments, the first part of the insert 824 comprises a retention layer 830 that forms at least a substantial portion of the insert rear surface 826. The retention layer 830 serves multiple purposes. Providing the insert 824 with the retention layer 830 helps facilitate the flow of the first material 809 during the co-molding process (described in further detail below. The retention layer 830 can serve as a high-volume reservoir that helps evenly distribute the first material 809 as the first material 809 is injected through one or more of the relatively low-volume angled voids 812. The retention layer 830 can further provide stability to the first material 809 during use of the club head 800. The retention layer 830 retains the first material 809 in the insert 824 during impact with a golf ball and keeps bits of the first material 809 from falling out of the angled voids 812.

In some embodiments, similar to the inserts of FIGS. 6-23, the first material 809 can entirely cover the rear surface 826. However, in many embodiments, such as the embodiment of FIG. 32, the first material 809 only covers a portion of the rear surface 826, such that the remaining portion of the rear surface 826 comprises the second material 810. Forming the insert rear surface 826 by both the first material 809 and the second material 810 can allow for stronger adhesion between the insert 824 and the rest of the club head 800.

In many embodiments, the first material 809 further fills each of the angled voids 812 (until flush with the front surface 825 of the insert). The second material 810 surrounds the first material 809, so that upon golf ball impact the first material 809 and the second material 810 can engage to least a portion of the golf ball.

The present embodiment is not limited by the shape of the plurality of angled voids 812. In some embodiments, the plurality of discrete voids 812 can be pill shaped, elliptical, hexagonal, rectangular, ovular, triangular, octagonal, trapezoidal, or any other desired shape. In some embodiments, the plurality of discrete voids 812 can be any desired shape or can be shaped similarly to the plurality of discrete voids in any of the above embodiments.

In the exemplary embodiment of FIGS. 32-34, each quadrant comprises 15 angled voids 812. In alternative embodiments, each quadrant can comprise 3, 4, 5, 6, 7, 8, 9, 10, 11, 12, 13, 14, 15, 16, 17, 18, 19, 20, 21, 22, 23, 24, 25, 26, 27, 28, 29, or 30 or more angled voids 812. In the same or alternative embodiments, each quadrant may comprise the same or different number of angled voids 812. For example, each quadrant can comprise 5 to 10 angled void, 10 to 15 angled void, 15 to 20 angled void, 20 to 25 angled void, or 25 to 30 angled voids.

In many of the angled void embodiments, when the club head 800 is at an address position the striking surface 807 comprises a striking surface imaginary vertical axis 820 that extends through a geometric center 808 of the striking surface 807 in a top rail-to-sole direction (as shown by FIG. 34). Further, offset from the striking surface imaginary vertical axis 820 in both a heel 803 and toe 802 direction at 0.25 inch and 0.50 inch are corresponding vertical reference axes 821, 822.

In many of the angled void embodiments, the percentage of the first material 809 along the 0.5-inch vertical reference axis 822 can between approximately 20% and 40%. For example, the percentage of the first material 809 along the 0.5 inch vertical reference axis 822 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material along the 0.5 inch vertical reference axis 822 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 809 along the 0.5 inch vertical reference axis 822 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the angled void embodiments, the percentage of the first material 809 (or first material land area) along the 0.25-inch vertical reference axis 821 can be between approximately 30% and 50%. For example, the percentage of the first material 809 along the 0.25 inch vertical reference axis 821 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material 809 along the 0.25 inch vertical reference axis 821 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 809 along the 0.25 inch vertical reference axis 821 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the angled void embodiments, the percentage of the first material 809 (or first material land area) along the striking surface imaginary axis 820 can between approximately 40% and 60%. For example, the percentage of the first material 809 along the striking surface imaginary axis 820 can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 809 along the striking surface imaginary axis 820 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material 809 along the striking surface imaginary axis 820 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%, Further, in many embodiments, the average ratio defined as the surface area of the first material 809 land area percentage 809 to the surface area of the second material 810 land area percentage (measured along a respective vertical reference axis) decreases from the striking surface imaginary vertical axis 820 to the 0.5-inch vertical reference axis 822. This type of arrangement of the first material 809 and the second material 810 aid in providing consistent ball speeds across the striking surface 807 as the average ratio along the striking surface imaginary vertical axis 820 is greater (i.e. softer) than the average ratio along the 0.5 inch vertical reference axis 822. This counteracts the loss of energy transfer on heel and toe mis-hits as well as top and bottom mis-hits.

Bowtie/Ribbon Embodiment

Figure 35:
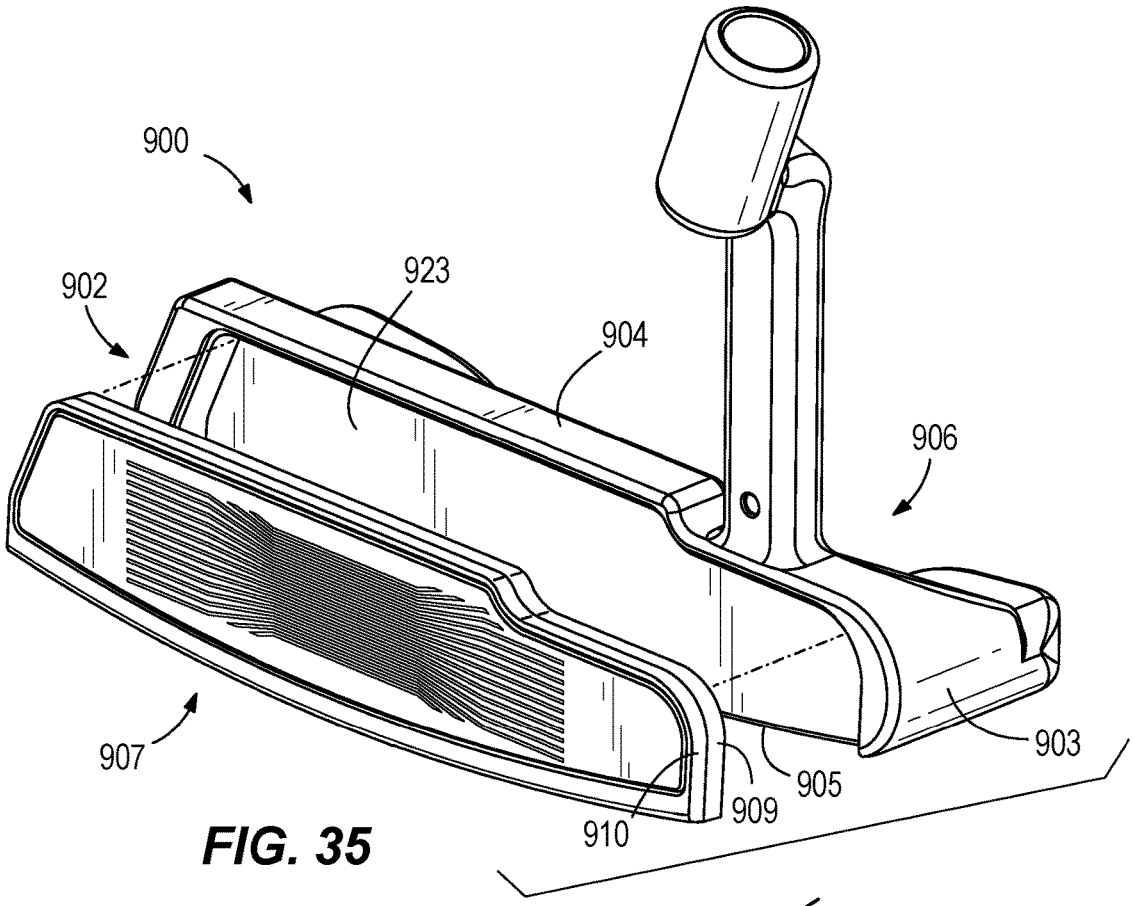
FIG. 35 shows a partially assembled view of a striking surface having voids arranged in a bowtie configuration according to one embodiment.
Figure 36:
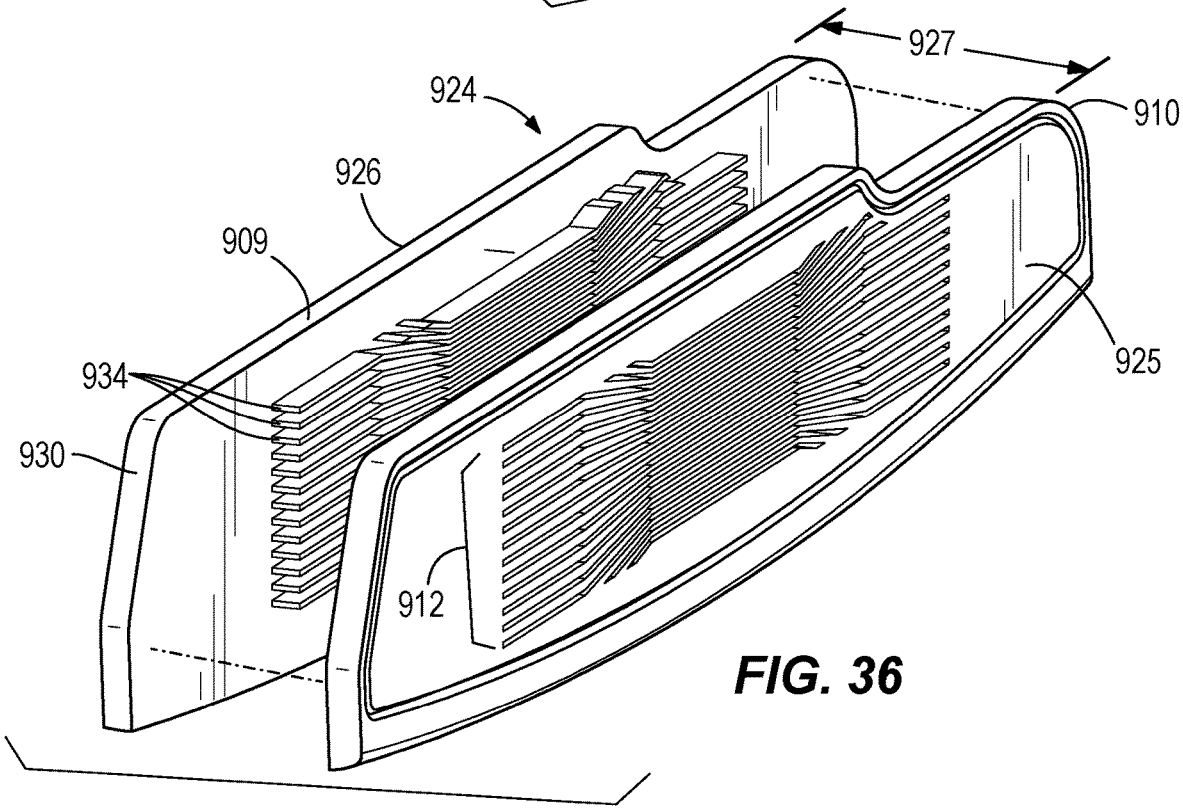
FIG. 36 shows an exploded view of the insert of FIG. 34.
Figure 37:
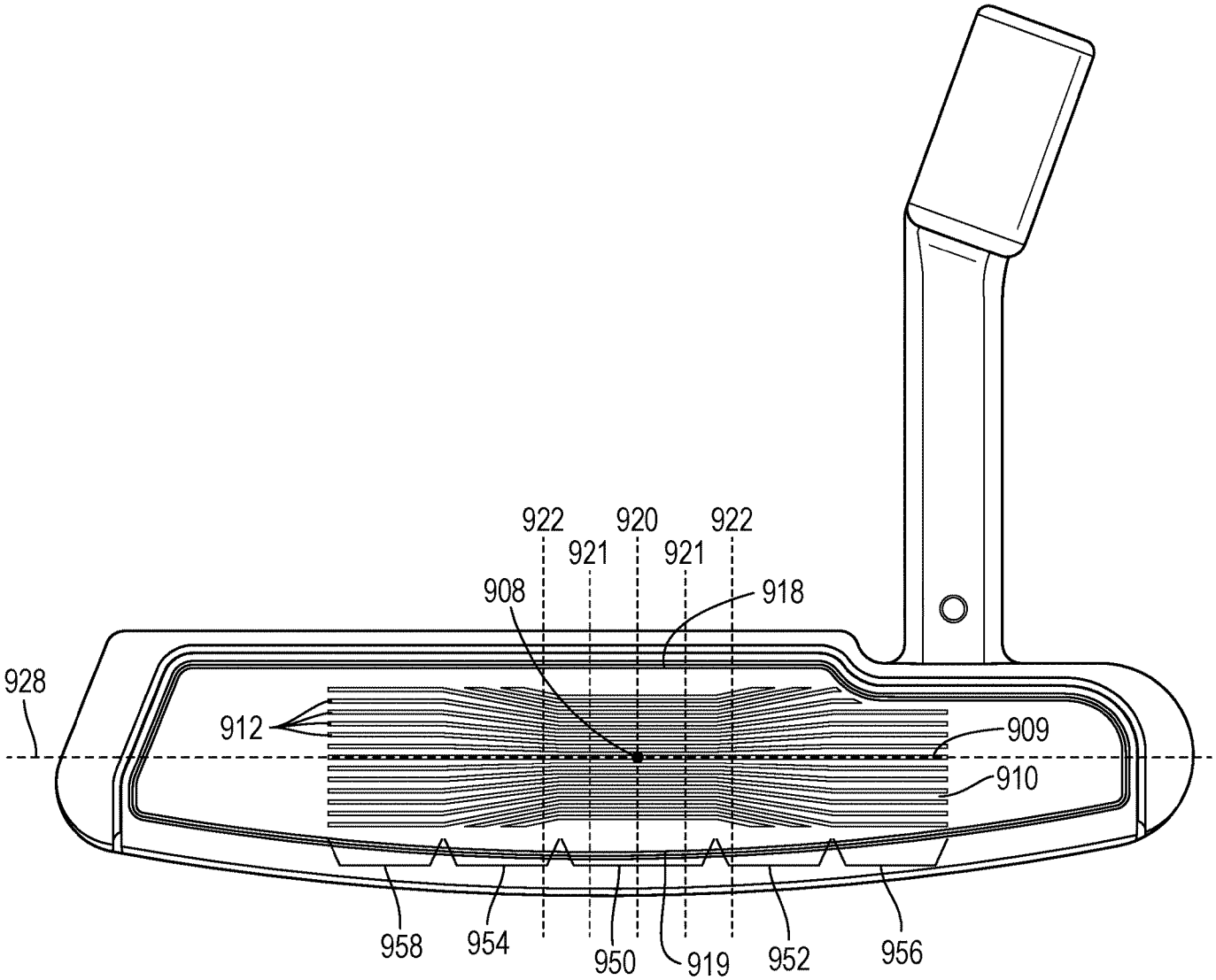
FIG. 37 shows a front view of the club head of FIG. 34.

FIGS. 35-37 illustrate another exemplary embodiment according to the invention described herein. More particularly, FIGS. 35-37 illustrate an example of a putter-type golf club head 900 comprising a dual-material striking surface 907 comprising a first material 909 and a second material 910 arranged in a bowtie configuration. This configuration normalizes ball speeds across the entire surface area of the striking surface 907. As mentioned above, the first material 909 is softer than the second material 910 thereby absorbing more energy on impact and reducing the speed of the golf ball. By strategically varying the ratio of the first material 909 to the second material 910 across the striking surface 907, the responsiveness of the striking surface 907 at different locations can be controlled. Providing a varying ratio of the first material 909 to second material 910 counteracts the variations in energy transfer caused by off-center strikes. The golf club head 900 of FIGS. 35-37 and the golf club head 300 of FIGS. 10-13 are similar in many respects, except for the differences described below.

FIG. 35 illustrates a putter-type golf club head 900 comprising a putter-body 901 having a toe portion 902, a heel portion 903 opposite the toe portion 902, a top rail portion 904, a sole portion 905 opposite the top rail portion 904, a portion of a striking surface 907, and a rear portion 906 opposite the striking surface portion 907. The striking surface portion 907 can further define a striking surface recess 923 defined by the heel portion 903, the toe portion 902, the top rail portion 904, the sole portion 905, and the rear portion 906 of the putter body 901.

FIG. 36 illustrates a two-part putter insert 924 comprising a bowtie configuration. In many embodiments, the putter insert 924 can be received within and complementary with the striking surface recess 923. However, it should be noted in alternative embodiments, the putter-type golf club head 900 need not to be an insert style putter.

FIGS. 35-37 illustrate the putter insert 924 comprising a first material 909 (also can be referred to as "first part") and a second material 910 (also can be referred to as "second part"). With specific reference to FIG. 35, the second part 910 forms (or defines) a plurality of voids 912 which are filled by the first material 909. These voids 912 are arranged in a bowtie configuration. The first material 909 has a hardness less than the second material 910. The combination of the bowtie configuration and first material 909 and second material 910 create a striking surface which normalizes ball speeds across the entire surface.

The bowtie configuration of voids 912 can be defined by five zones, a central zone 950, a toe side zone 958, a heel side zone 956, a toe side intermediate zone 954, and a heel side intermediate zone 952. Each void 912 in the plurality of voids extends continuously across all the zones in an approximately horizontal direction. As illustrated in FIG. 37, in the toe side zone 958, heel side zone 956, and central zone 950, are defined by where the voids are approximately horizontal (i.e., parallel to the ground plane). The toe side intermediate zone 954 and heel side intermediate zone 952 are defined by where the voids are angled relative to the adjacent zones. The toe side intermediate zone 954 and heel side intermediate zone 952 are located between the toe side zone 958 and the central zone 950 and heel side zone 956 and central zone 950 respectively. The angle of the voids 912 in the heel side intermediate zone 952 and toe side intermediate zone 954 are angled towards the center of the striking surface 908. Due to the angle of the voids in these zones, this creates a spacing of the voids that is more compact in the center zone and more spread out in the heel and toe zones. In other words, the horizontal voids in the heel zone 956, toe zone 958, and center zone 950, are connected to each other by angled voids 912 in the toe side intermediate zone 954 and heel side intermediate zone 952.

The second material 912 surrounds the voids 912 to form second material land areas. The first part of the putter insert 924 comprises a retention layer 930 and a plurality of protrusions 934 that are complimentary to corresponding voids 912. Upon coupling the first part 909 and the second part 910 together, the plurality of protrusions 934 sit flush with second material land areas. Thereby, the first material 909 forms first material land areas substantially flush with the second material land areas. The first material land areas and the second material land combine to form a single, continuous striking surface portion 907 and engage with at least a portion of the golf ball upon golf ball impact.

In many cases, providing a continuous, multi-material striking surface 907 wherein the first material 909 land areas and the second material 910 land areas are flush with one another can provide an advantage over a groove system configured to normalize ball speed across the striking surface. The flat, smooth striking surface 907 formed by the multi-material insert 924 minimizes any unpredictable launch conditions that may be caused by the ball striking a groove irregularly (for example, striking the edge or corner of a groove). Further, the continuous striking surface 907 eliminates the possibility of dirt or other debris becoming trapped in a groove and compromising the ball speed normalization effect of the multi-material insert 924.

This embodiment illustrates one possible arrangement where the voids 912 are arranged to form a denser, more packed center region creating more first material 909 land areas than second material 910 land areas. Referencing FIG. 37, it can be seen that the voids 912 in the center zone 950 are spaced closer together than the voids 912 in the toe side zone 958 and heel side zone 956. This arrangement creates a center region having a greater amount of first material 909 land areas than second material 910 land area. This creates a center region that is less responsive to ball impacts than the heel 903 and toe 902 ends. Controlling the ratio between the first material 909 and second material 910 at different regions along the striking surface 907 allows ball speeds across the striking surface 907 to be consistent.

Moving away from the center zone 950 towards the heel and the toe zones 958 956, the stance between the voids gradually increase, due to the angle of the voids. This creates more second material 910 land areas, which aids in gradually creating a more responsive region away from the center region towards the heel 903 and toe 902 regions and in a top and bottom region to consistently control ball speeds across the entirety of the striking surface 907.

In alternative embodiments (Not shown), the ratio between the first material 909 and the second material 910 throughout different regions of the insert 924 can be controlled by varying the size of the voids 912. Each of the voids 912 can comprise a width. In any given row, the voids 912 proximate the center region can be provided with substantially large widths, while the portion of the voids 912 distal from the center region can be provided with smaller widths. Moving away from the center along the horizontal axis 928 and/or vertical axis 920, the width of each void 912 can progressively decrease, creating more second material 910 land areas near the heel 903 and toe 902 and the top and the bottom. This provides the same effect of consistently controlling ball speeds across the striking surface 907, as does progressively increasing the spacing distance of the voids 909.

With continued reference to FIG. 36, FIG. 36, illustrates an exploded view of the putter insert 924 comprising voids 912. The insert 924 can comprise of a front surface 925 adapted for impact with a golf ball (not shown) and a rear surface 926 opposite the front surface 925. A putter insert thickness (i.e. depth) 927 can be defined as the maximum perpendicular distance between the front surface 925 and the rear surface 926. For example, FIG. 36 illustrates the insert 924 having a plurality of voids 912 (defined by the second material) extending entirely through the second material 910 thickness (i.e. depth).

Further, in many embodiments, the first part of the insert comprises a retention layer 930 that forms at least a substantial portion of the insert rear surface 926. The retention layer 930 serves multiple purposes. Providing the insert 924 with the retention layer 930 helps facilitate the flow of the first material 909 during the co-molding process (described in further detail below. The retention layer 930 can serve as a high-volume reservoir that helps evenly distribute the first material 909 as the first material 909 is injected through one or more of the relatively low-volume voids 912. The retention layer 930 can further provide stability to the first material 909 during use of the club head 900. The retention layer 930 retains the first material 909 in the insert 924 during impact with a golf ball and keeps bits of the first material 909 from falling out of the angled voids 912.

In some embodiments, similar to the inserts of FIGS. 6-23, the first material 909 can entirely cover the rear surface 926. However, in many embodiments, the first material 909 only covers a portion of the rear surface 926, such that the remaining portion of the rear surface 926 comprises the second material 910. Forming the insert rear surface 926 by both the first material 909 and the second material 910 can allow for stronger adhesion between the insert 924 and the rest of the golf club head 900.

In many embodiments, the first material 909 further fills each of the voids 912 (until flush with the front surface 925 of the insert). The second material 910 surrounds the first material 909, so that upon golf ball impact the first material 909 and the second material 910 can engage to least a portion of the golf ball.

As illustrated by FIGS. 35-37, the spacing distance between each void 912 can vary in each zone. For example, the spacing of the voids 912 in the heel zone 956 and toe zone 958 are greater than the spacing of the voids in the center zone 950. The spacing distance between each void 912 can be measured as the center-line to center-line distance between each adjacent void 912.

The present embodiment is not limited by the shape of the voids 912. In some embodiments, the plurality of discrete voids can be pill shaped, elliptical, hexagonal, rectangular, ovular, triangular, octagonal, trapezoidal, or any other desired shape. In some embodiments, the plurality of discrete voids can be any desired shape or can be shaped similarly to the plurality of discrete voids in any of the above embodiments.

In the exemplary embodiment of FIG. 37, the insert 924 comprises 17 voids. In alternative embodiments, the insert can comprise 3, 4, 5, 6, 7, 8, 9, 10, 11, 12, 13, 14, 15, 16, 17, 18, 19, 20, 21, 22, 23, 24, 25, 26, 27, 28, 29, or 30 or more voids.

In many of the bowtie configuration void 924 embodiments, when the club head 900 is at an address position the striking surface 907 comprises a striking surface imaginary vertical axis 920 that extends through a geometric center 908 of the striking surface 907 in a top rail-to-sole direction (as shown by FIG. 37). Further, offset from the striking surface imaginary vertical axis 920 in both a heel 903 and toe 902 direction at 0.25 inch and 0.50 inch are corresponding vertical reference axes 921, 922.

In many of the void embodiments, the percentage of the first material 909 along the 0.5-inch vertical reference axis 922 can between approximately 20% and 40%. For example, the percentage of the first material 909 along the 0.5 inch vertical reference axis 922 can be 20%, 21%, 22%, 23%, 24%, 25%, 26%, 27%, 28%, 29%, 30%, 31%, 32%, 33%, 34%, 35%, 36%, 37%, 38%, 39%, or 40%. For further example, the percentage of the first material 909 along the 0.5 inch vertical reference axis 922 can be greater than 20%, greater than 21%, greater than 22%, greater than 23%, greater than 24%, greater than 25%, greater than 26%, greater than 27%, greater than 28%, greater than 29%, greater than 30%, greater than 31%, greater than 32%, greater than 33%, greater than 34%, greater than 35%, greater than 36%, greater than 37%, greater than 38%, or greater than 39%. In alternative embodiments, the percentage of the first material 909 along the 0.5 inch vertical reference axis 922 can be less than 21%, less than 22%, less than 23%, less than 24%, less than 25%, less than 26%, less than 27%, less than 28%, less than 29%, less than 30%, less than 31%, less than 32%, less than 33%, less than 34%, less than 35%, less than 36%, less than 37%, less than 38%, less than 39%, or less than 40%, In many of the void embodiments, the percentage of the first material 909 (or first material land area) along the 0.25-inch vertical reference axis 921 can be between approximately 30% and 50%. For example, the percentage of the first material 909 along the 0.25 inch vertical reference axis 921 can be 30%, 31%, 32%, 33%, 34%, 35%, 36%, 37%, 38%, 39%, 40%, 41%, 42%, 43%, 44%, 45%, 46%, 47%, 48%, 49%, or 50%. For further example, the percentage of the first material 909 along the 0.25 inch vertical reference axis 921 can be greater than 30%, greater than 31%, greater than 32%, greater than 33%, greater than 34%, greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, or greater than 49%. In alternative embodiments, the percentage of the first material 909 along the 0.25 inch vertical reference axis 921 can be less than 31%, less than 32%, less than 33%, less than 34%, less than 35%, less than 36%, less than 37%, less than 38%, less than 39%, less than 40%, less than 41%, less than 42%, less than 43%, less than 44%, less than 45%, less than 46%, less than 47%, less than 48%, less than 49%, or less than 50%, In many of the void embodiments, the percentage of the first material 909 (or first material land area) along the striking surface imaginary axis 920 can between approximately 40% and 60%. For example, the percentage of the first material 909 along the striking surface imaginary axis can be 40%, 41%, 42%, 43%, 44%, 45%, 46%, 47%, 48%, 49%, 50%, 51%, 52%, 53%, 54%, 55%, 56%, 57%, 58%, 59%, or 60%. For further example, the percentage of the first material 909 along the striking surface imaginary axis 920 can be greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, greater than 55%, greater than 56%, greater than 57%, greater than 58%, or greater than 59%. In alternative embodiments, the percentage of the first material 909 along the striking surface imaginary axis 920 can be less than 41%, less than 42%, less than 43%, less than 44%, less than 45%, less than 46%, less than 47%, less than 48%, less than 49%, less than 50%, less than 51%, less than 52%, less than 53%, less than 54%, less than 55%, less than 56%, less than 57%, less than 58%, less than 59%, or less than 60%.

Further, in many embodiments, the average ratio defined as the surface area of the first material 909 land area percentage 909 to the surface area of the second material 910 land area percentage 910 (measured along a respective vertical reference axis) decreases from the striking surface imaginary vertical axis 920 to the 0.5-inch vertical reference axis 922. This type of arrangement of the first material 909 and the second material 910 aid in providing consistent ball speeds across the striking surface 907 as the average ratio along the striking surface imaginary vertical axis 920 is greater (i.e. softer) than the average ratio along the 0.5 inch vertical reference axis 922. This counteracts the loss of energy transfer on heel and toe mis-hits as well as top and bottom mis-hits.

Variable Vertical Voids

Figure 38:
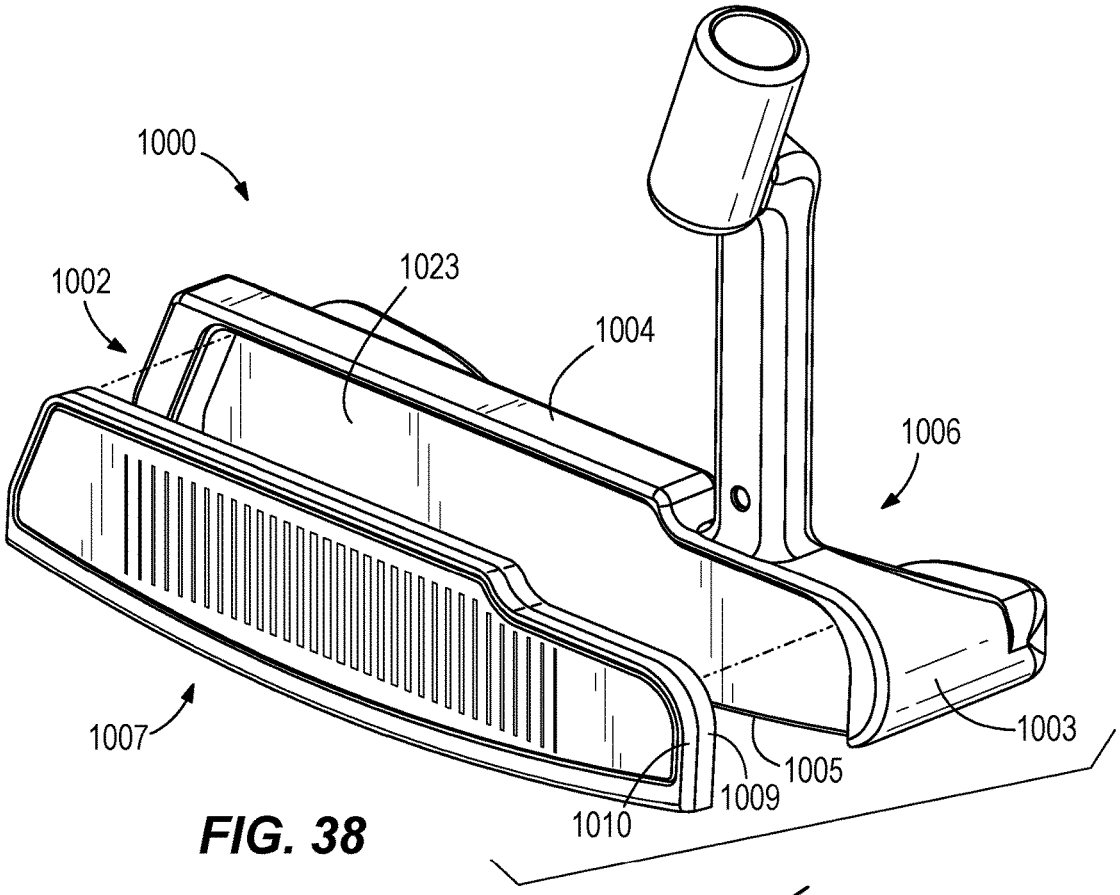
FIG. 38 shows a partially assembled view of a striking surface having variable vertical voids according to one embodiment.
Figure 39:
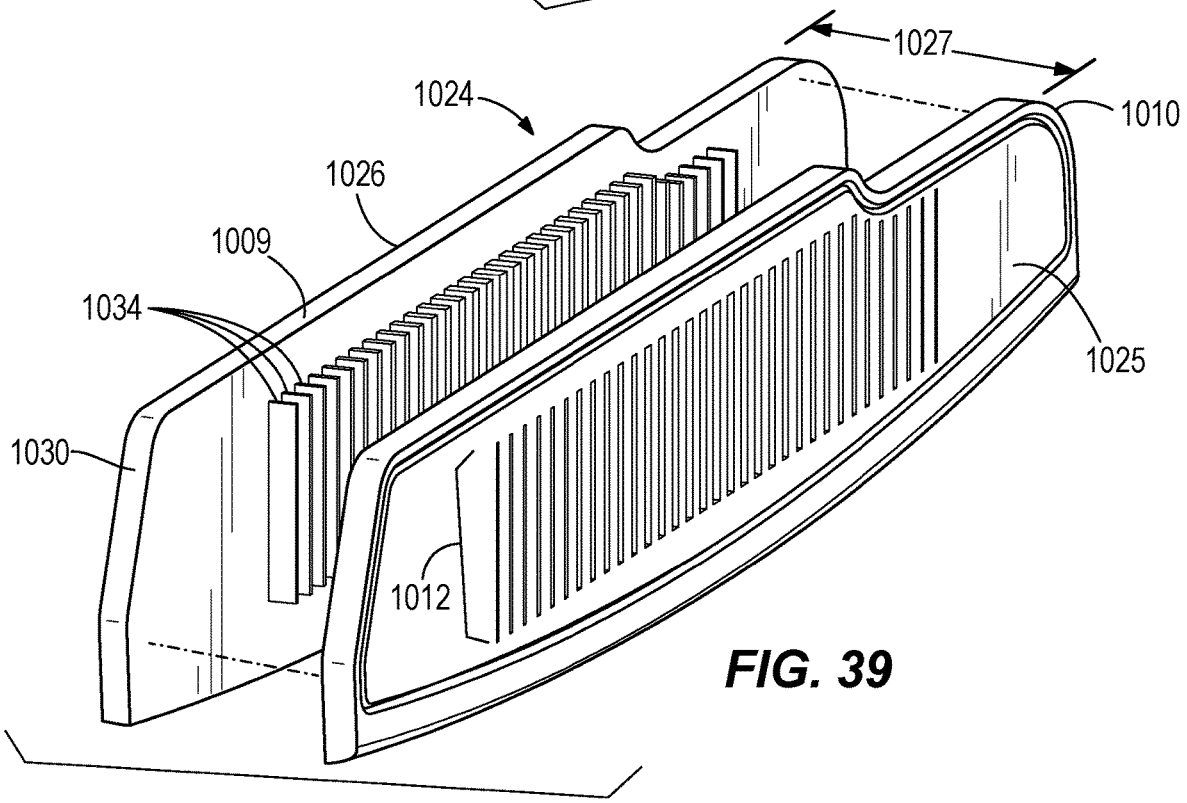
FIG. 39 shows an exploded view of the insert of FIG. 37.
Figure 40:
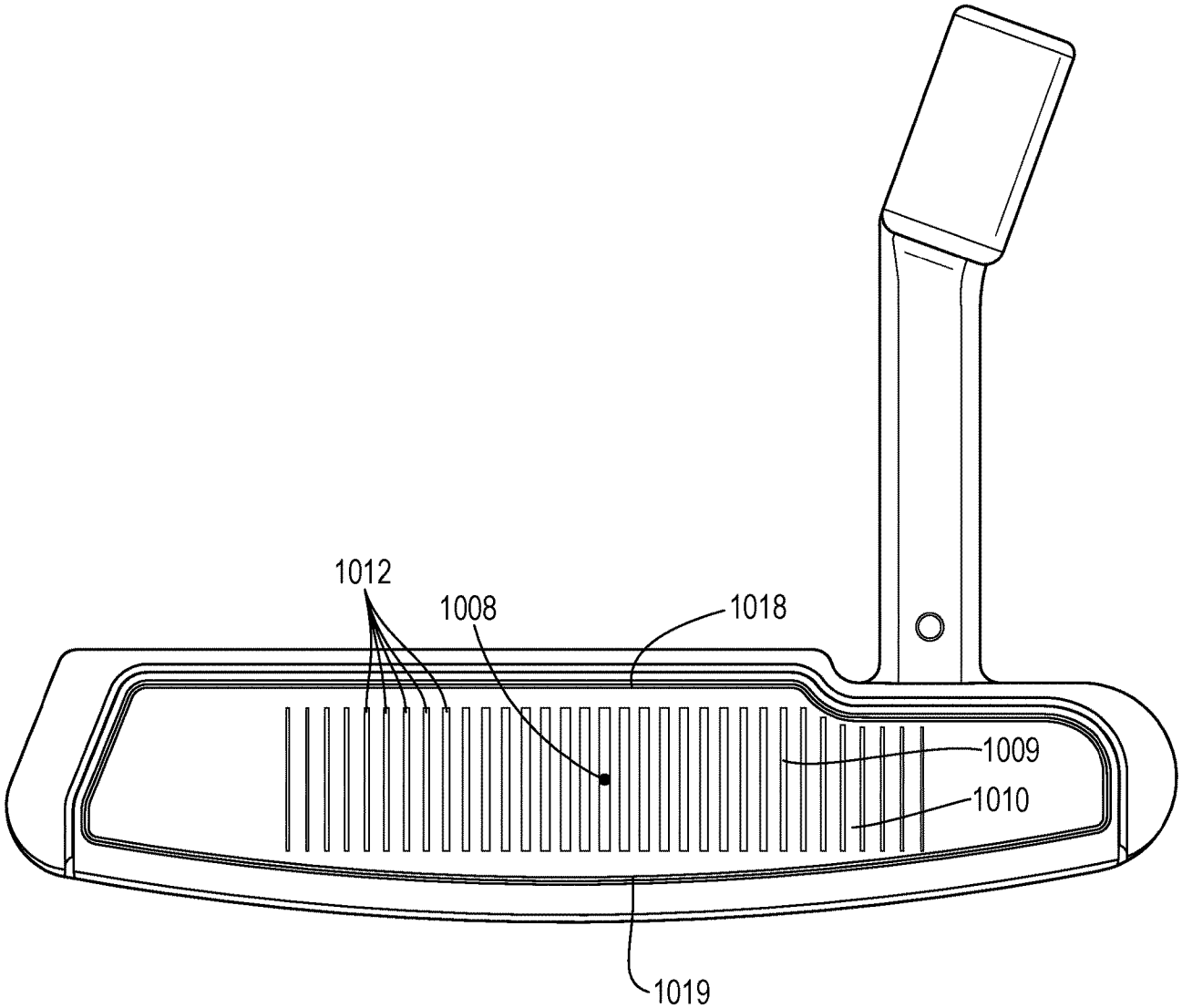
FIG. 40 shows a front view of the club head of FIG. 37.

FIGS. 38-40 illustrate another exemplary embodiment according to the invention described herein. More particularly, FIGS. 38-40 illustrate an example of a putter-type golf club head 1000 comprising a dual-material striking surface 1007 comprising a first material 1009 and a second material 1010 arranged in a vertical pattern that provides a consistent ball speed across the face. The golf club head 1000 of FIGS. 38-40 and the golf club head 300 of FIGS. 10-13 are similar in many respects, except for the differences described below.

FIG. 38 illustrates a putter-type golf club head 1000 comprising a putter-body 1001 having a toe portion 1002, a heel portion 1003 opposite the toe portion 1002, a top rail portion 1004, a sole portion 1005 opposite the top rail portion 1004, a portion of a striking surface 1007, and a rear portion 1006 opposite the striking surface portion 1007. The striking surface portion 1007 can further define a striking surface recess 1023 defined by the heel portion 1003, the toe portion 1002, the top rail portion 1004, the sole portion 1005, and the rear portion 1006 of the putter body 1001.

FIG. 39 illustrates a two-part putter insert 1024 comprising voids arranged in a vertical configuration. In many embodiments, the putter insert 1024 can be received within and complementary with the striking surface recess 1023. However, it should be noted in alternative embodiments, the putter-type golf club head 1000 need not to be an insert style putter.

FIGS. 38-40 illustrate the putter insert 1024 comprising a first material 1009 (also can be referred to as "first part") and a second material 1010 (also can be referred to as "second part"). With specific reference to FIG. 39, the second part forms (or defines) a plurality of voids 1012 which are filled by the first material 1009. These voids 1012 are arranged in a vertical configuration. The voids 1012 extend from the top rail portion 1004 to the sole portion 1005. Each void 1012 in the plurality of voids 1012 are approximately parallel to each adjacent void 1012. The first material 1009 has a hardness less than the second material 1010.

The second material 1010 surrounds the voids 1012 to form second material 1010 land areas. The first part 1009 of the putter insert 1024 comprises a retention layer 1030 and a plurality of protrusions 1034 that are complimentary to corresponding voids 1012. Upon coupling the first part 1009 and the second part 1010 together, the plurality of protrusions 1034 sit flush with second material 1010 land areas. Thereby, the first material 1009 forms first material 1009 land areas substantially flush with the second material 1010 land areas. The first material 1009 land areas and the second material 1010 land areas combine to form a single, continuous striking surface 1007 and engage with at least a portion of the golf ball upon golf ball impact.

In many cases, providing a continuous, multi-material striking surface 1007 wherein the first material 1009 land areas and the second material 1010 land areas are flush with one another can provide an advantage over a groove system configured to normalize ball speed across the striking surface. The flat, smooth striking surface 1007 formed by the multi-material insert 1024 minimizes any unpredictable launch conditions that may be caused by the ball striking a groove irregularly (for example, striking the edge or corner of a groove). Further, the continuous striking surface 1007 eliminates the possibility of dirt or other debris becoming trapped in a groove and compromising the ball speed normalization effect of the multi-material insert 1024.

This embodiment illustrates one possible arrangement where the voids 1012 are arranged to form a denser, more packed center region creating more first material 1009 land areas than second material 1010 land areas. Referencing FIG. 40, it can be seen that the voids 1012 in the center region are larger in size than the voids 1012 in the heel 1003 and toe 1002 portions. In other words, the ratio between the first material 1009 and the second material 1010 throughout different regions of the insert 1024 can be controlled by varying the size of the voids 1012. Each of the voids 1012 can comprise a width. In any given row, the voids 1012 proximate the center region can be provided with substantially large widths, while the portion of the voids 1012 distal from the center region can be provided with smaller widths. Moving away from the center towards the heel portion 1003 and toe portion 1002, the width of each void 1012 can progressively decrease, creating more second material 1010 land areas near the heel 1003 and toe 1002. This provides the same effect of consistently controlling ball speeds across the striking surface 1007, as does progressively increasing the spacing distance of the voids 1012.

In the illustrates embodiment, the voids 1012 are equally spaced apart across the striking surface 1007. In other embodiments, the voids 1012 may be spaced closer together in the center region and spaced further apart in the heel 1003 and toe 1002 regions. The spacing of the voids 1012 can be used to control the ratio of the first material 709 and second material 710.

With continued reference to FIG. 39, FIG. 39, illustrates an exploded view of the putter insert 1024 comprising vertical voids 1012. The insert 1024 can comprise of a front surface 1025 adapted for impact with a golf ball (not shown) and a rear surface 1026 opposite the front surface 1025. A putter insert thickness (i.e. depth) 1027 can be defined as the maximum perpendicular distance between the front surface 1025 and the rear surface 1026. For example, FIG. 39 illustrates the insert 1024 having a plurality of voids 1012 (defined by the second material) extending entirely through the second material 1010 thickness (i.e. depth).

Further, in many embodiments, the first part of the insert 1024 comprises a retention layer 1030 that forms at least a substantial portion of the insert rear surface 1026. The retention layer 1030 serves multiple purposes. Providing the insert 1024 with the retention layer 1030 helps facilitate the flow of the first material 1009 during the co-molding process (described in further detail below. The retention layer 1030 can serve as a high-volume reservoir that helps evenly distribute the first material 1009 as the first material 1009 is injected through one or more of the relatively low-volume voids 1012. The retention layer 1030 can further provide stability to the first material 1009 during use of the club head 1000. The retention layer 1030 retains the first material 1009 in the insert 1024 during impact with a golf ball and keeps bits of the first material 1009 from falling out of the vertical voids 1012.

In some embodiments, similar to the inserts of FIGS. 6-23, the first material 1012 can entirely cover the rear surface 1026. However, in many embodiments, the first material 1009 only covers a portion of the rear surface 1026, such that the remaining portion of the rear surface 1026 comprises the second material 1010. Forming the insert rear surface 1026 by both the first material 1009 and the second material 1010 can allow for stronger adhesion between the insert 1024 and the rest of the club head 1000.

In many embodiments, the first material 1009 further fills each of the variable vertical voids 1012 (until flush with the front surface 1025 of the insert) of the pluralities of variable vertical void 1012. The second material 1010 surrounds the first material 1009, so that upon golf ball impact the first material 1009 and the second material 1010 can engage to least a portion of the golf ball.

As illustrated by FIGS. 38-40, the size of the voids 1012 varies across the striking surface 1007 in a heel-to-toe direction. The voids 1012 that are proximate the center region comprise a width that is larger than adjacent voids 1012 that are more distal to the center region. The ratio of first material 1009 land areas to second material 1010 land areas can be controlled by varying the size of the voids 1012.

As illustrated by FIGS. 38-40, the voids 1012 are spaced apart by a constant distance. In other embodiments, the spacing between the voids 1012 can vary across the striking surface 1007. For example, the spacing of the voids 1012 can be smaller in the center region than the spacing of the voids 1012 in the heel 1003 and toe 1002 regions. The spacing distance between each void 1012 can be measured as the center-line to center-line distance between each adjacent void 1012. In many embodiments, the spacing distance between each void 1012 can range between approximately 0.05 inches and approximately 0.20 inches. In many embodiments, the spacing distance between a given pair of voids 1012 can be between 0.05 and 0.075 inches, between 0.075 and 0.10 inches, between 0.10 and 0.125 inches, between 0.125 and 0.15 inches, between 0.15 and 0.175 inches, or between 0.175 and 0.20 inches. In many embodiments, the spacing distance between a given pair of voids can be between 0.05 and 0.10 inches, between 0.075 and 0.125 inches, between 0.10 and 0.15 inches, between 0.125 and 0.175 inches, or between 0.15 and 0.20 inches.

In the exemplary embodiment of FIG. 38, the striking surface 1007 comprises 22 variable vertical voids 1012. In alternative embodiments, the striking surface 1007 can comprise 3, 4, 5, 6, 7, 8, 9, 10, 11, 12, 13, 14, 15, 16, 17, 18, 19, 20, 21, 22, 23, 24, 25, 26, 27, 28, 29, or 30 or more vertical voids 1012.

Methods of Manufacture

Figure 31:
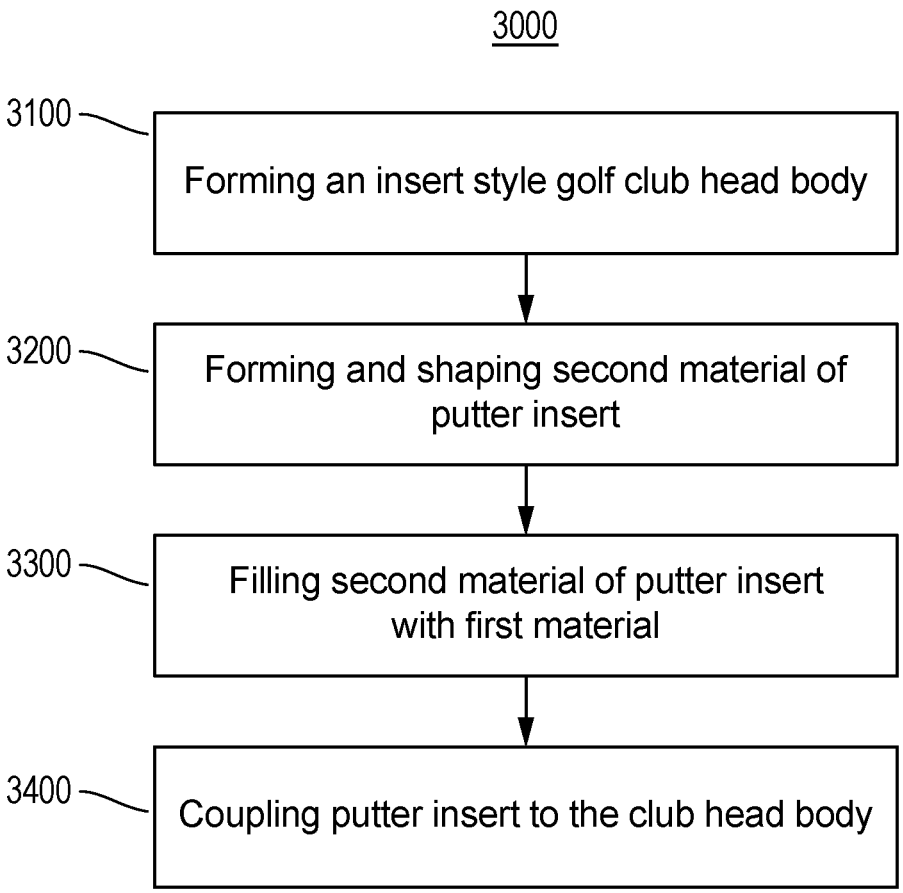
FIG. 31 shows a method of forming and attaching the insert to a club head body according to one embodiment.

FIG. 31 illustrates a method 3000 of providing a golf club head according to the present invention. Referring to block 3100, the method 3000 includes an activity of providing an insert style golf club head. For example, the insert style golf club head can be similar or identical to the golf club head 700 of FIGS. 27-30. For example, the golf club head body may be formed, for instance, by casting, forging, cutting, grinding, machining, welding, a combination thereof, or the like.

Referring to block 3200, the method 3000 continues with an activity of creating a putter insert. In some examples, the activity can include performing milling or laser cutting a block of a relatively hard material (i.e. the second material) to a desired shape to form the insert. The activity provides the insert with the necessary geometries and features (such as providing circular voids). For example, the activity can include drilling, milling, machining, or otherwise forming a plurality of distinct voids through the thickness of the insert.

Referring to block 3200, the method 3000 comprises filling the putter insert with a relatively soft material (i.e. the first material). The first material can be applied to the second material using a co-molding process. In various embodiments, the process may include a specialized mold to facilitate the flow of the material so that it adequately fills the voids of the second material. The specialized mold may utilize a vacuuming process to ensure that the first material forms a smooth striking surface with the second material by creating a negative pressure that pulls the first material into the voids. Furthermore, the specialized mold, when used in combination with the geometry of the face insert, allows the first material to flow from smaller volumes to larger volumes. For example, the material may flow through the holes of the front surface into the rear channel.

Referring to block 3400, the method 3000 continues with the activity of coupling the putter insert to the golf club head body, wherein the golf club head is configured to receive the face insert. In some examples, the face insert is coupled to the golf club head body with an adhesive. The face insert is coupled to the golf club head body to form the golf club head of FIGS. 27-30.

Example 1

Example 1 shows that to select a threshold or desired ball speed across the striking surface, that both the length of the putt and the vertical land area percentage are important factors to consider. This Example generally corresponds to the continuous groove embodiments of FIGS. 1-9.

Figure 4:
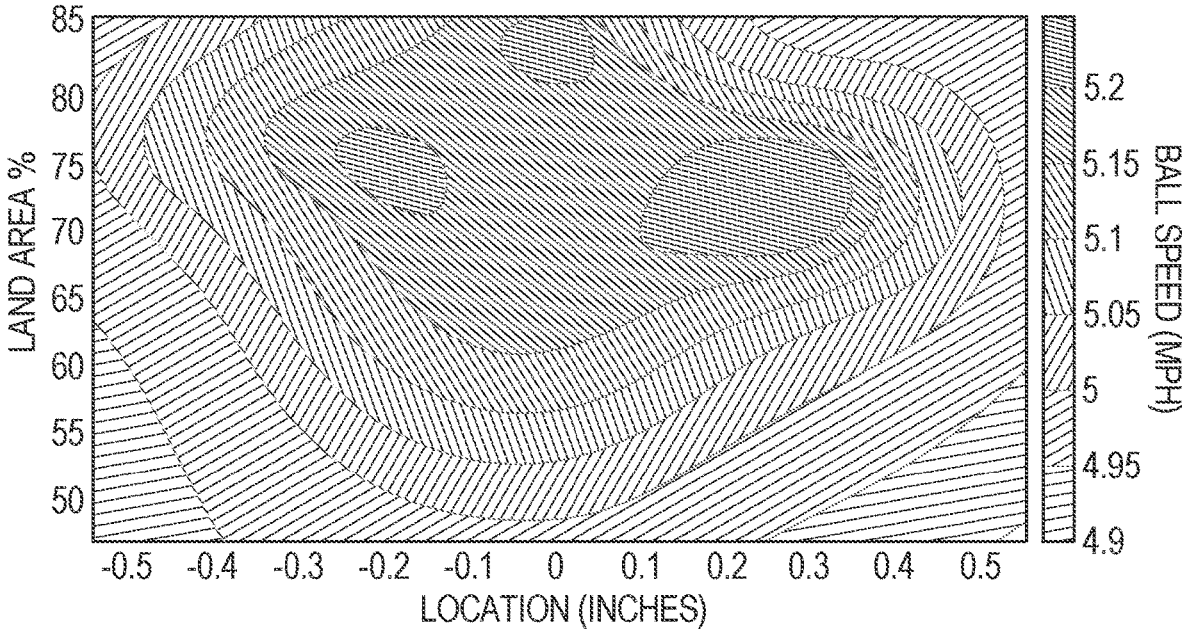
FIG. 4 shows a seven variable gradient map that compares ball speed, impact location, and the land area percentage for putts of 10 feet in length.

FIG. 4 illustrates a seven variable gradient map that details for various impact locations the vertical required land area percentage (or percentage of the second material) needed to achieve a consistent ball speed for putts of approximately 10 ft in length. For example, if a desired ball speed for a 10 ft putt of 5.15 mph is desired, the second material vertical land area percentage at the 0.5 inch vertical reference axis 122 offset from the striking surface imaginary vertical axis 120 is approximately 76%. The second material vertical land area percentage at the 0.25 inch vertical reference axis 121 offset from the striking surface imaginary vertical axis 122 is approximately 58%. The second material vertical land area percentage at the striking surface imaginary vertical axis 120 is approximately 53%.

If a desired ball speed for a 10 ft putt of 5.10 mph is desired, the second material vertical land area percentage at the 0.5 inch vertical reference axis 122 offset from the striking surface imaginary vertical axis 120 is approximately 73%. The second material vertical land area percentage at the 0.25 inch vertical reference axis 121 offset from the striking surface imaginary vertical axis 120 is approximately 55%. The second material vertical land area percentage at the striking surface imaginary vertical axis 120 is approximately 50%.

If a desired ball speed for a 10 ft putt of 5.05 mph is desired, the second material vertical land area percentage at the 0.5 inch vertical reference axis 122 offset from the striking surface imaginary vertical axis 120 is approximately 67%. The second material vertical land area percentage at the 0.25 inch vertical reference axis 121 offset from the striking surface imaginary vertical axis 120 is approximately 50%. The second material vertical land area percentage at the striking surface imaginary vertical axis 120 is approximately 46%.

Figure 5:
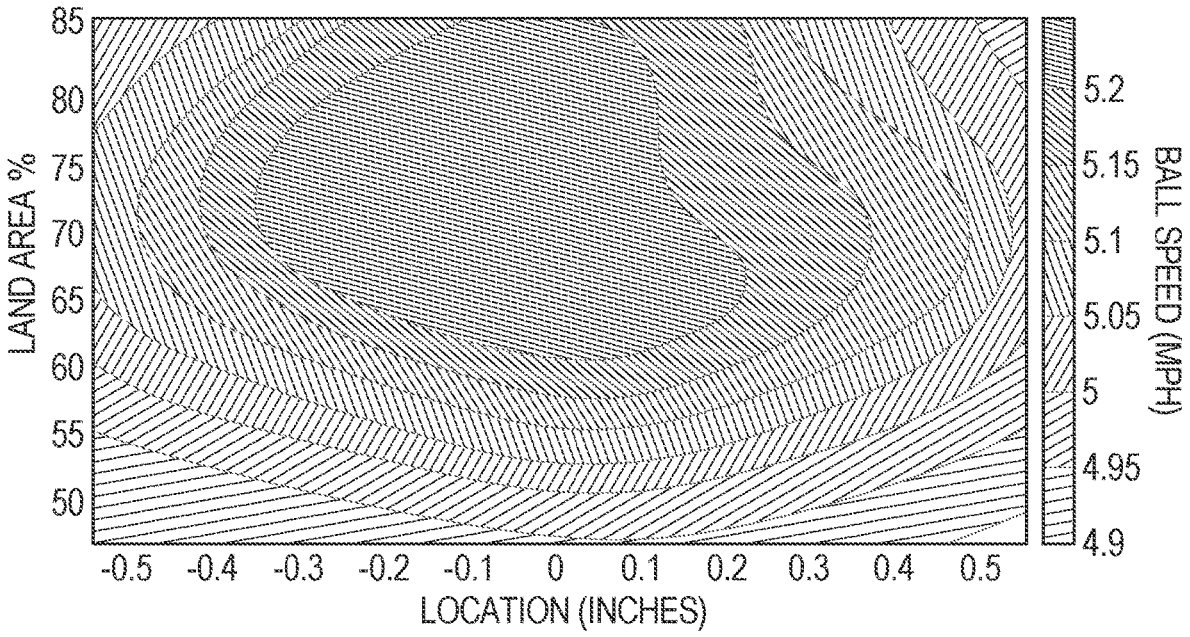
FIG. 5 shows a seven variable gradient map that compares ball speed, impact location, and the land area percentage for putts of 25 ft in length.

For further example, FIG. 5 illustrates another seven variable gradient map that details for various impact locations the required land area needed to achieve a consistent ball speed for putts of approximately 25 feet in length. If a desired ball speed for a 25 ft putt of 7.73 mph is desired, the second material vertical land area percentage at the 0.5 inch vertical reference axis 122 laterally offset from the striking surface imaginary vertical axis 120 is approximately 65%. The second material vertical land area percentage at the 0.25 inch vertical reference axis 121 laterally offset from the striking surface imaginary vertical axis 120 is approximately 58%. The second material vertical land area percentage at the striking surface imaginary vertical axis 120 is approximately 55%.

If a desired ball speed for a 25 ft putt of 7.68 mph is desired, the second material vertical land area percentage at the 0.5 inch vertical reference axis 122 laterally offset from the striking surface imaginary vertical axis 120 is approximately 60%. The second material vertical land area percentage at the 0.25 inch vertical reference axis 121 laterally offset from the striking surface imaginary vertical axis 120 is approximately 56%. The second material vertical land area percentage at the striking surface imaginary vertical axis 120 is 53%.

If a desired ball speed for a 25 ft putt of 7.60 mph is desired, the second material vertical land area percentage at the 0.5 inch vertical reference axis 122 laterally offset from the striking surface imaginary vertical axis 120 is approximately 55%. The second material vertical land area percentage at the 0.25 inch vertical reference axis 121 laterally offset from the striking surface imaginary vertical axis 120 is approximately 51%. The second material vertical land area percentage at the striking surface imaginary vertical axis 120 is approximately 48%.

The seven variable gradient map of FIG. 4 and FIG. 5 are based upon the second material being generally composed of metal, for example, 17-4 stainless steel and the first material being generally composed of air. The percentage or relationship between the first material and the second material will vary based upon the type of selected material but the application of controlling the ratio or relationship between the first material and the second material still applies to achieve consistent ball speed.

Example 2

For many of the above described embodiments, the first material hardness and first material land area percentage characteristics were altered to fully understand the effect that these variables have on ball speed. Specifically, a putter-pendulum test was conducted to measure the ball speed for ten putters. The below table illustrates the material characteristics of the exemplary striking surface tested. Ball speed data was captured at the striking surface imaginary vertical axis, at the heel vertical reference axis at 0.5 inches, and at the toe vertical reference axis at 0.5 inches.

Figure 24:
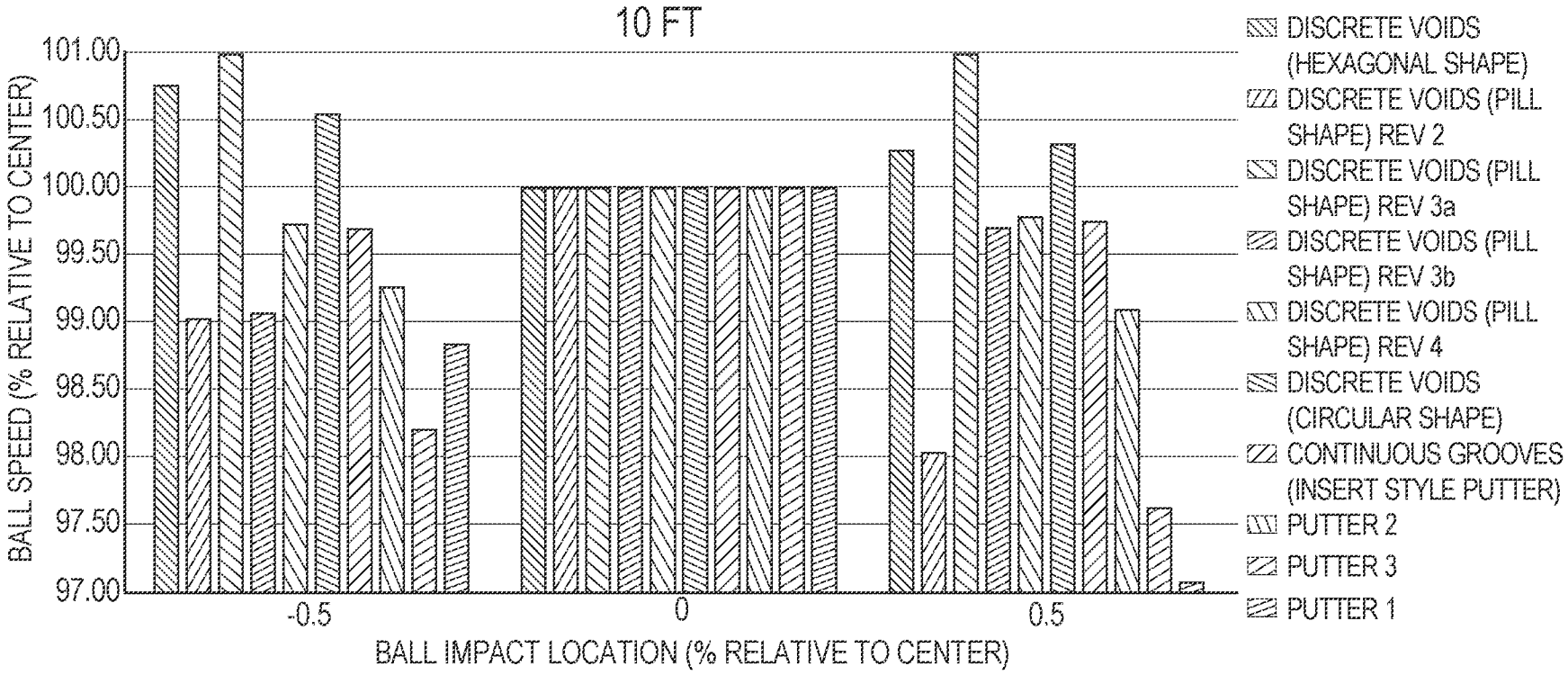
FIG. 24 shows a bar graph that compares the ball speed and ball impact location for various exemplary putter embodiments for putts of 10 feet in length.
Figure 25:
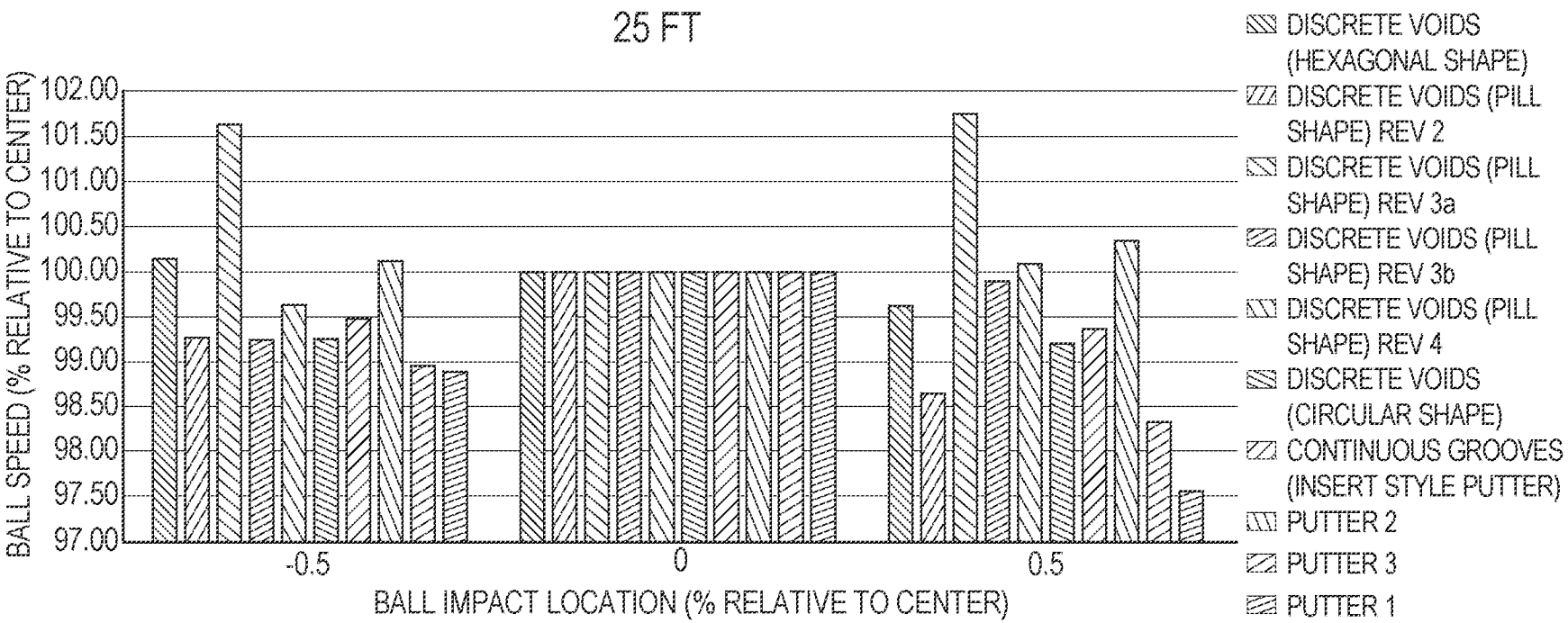
FIG. 25 shows a bar graph that compares the ball speed and ball impact location for various exemplary putter embodiments for putts of 25 feet in length.
Figure 26:
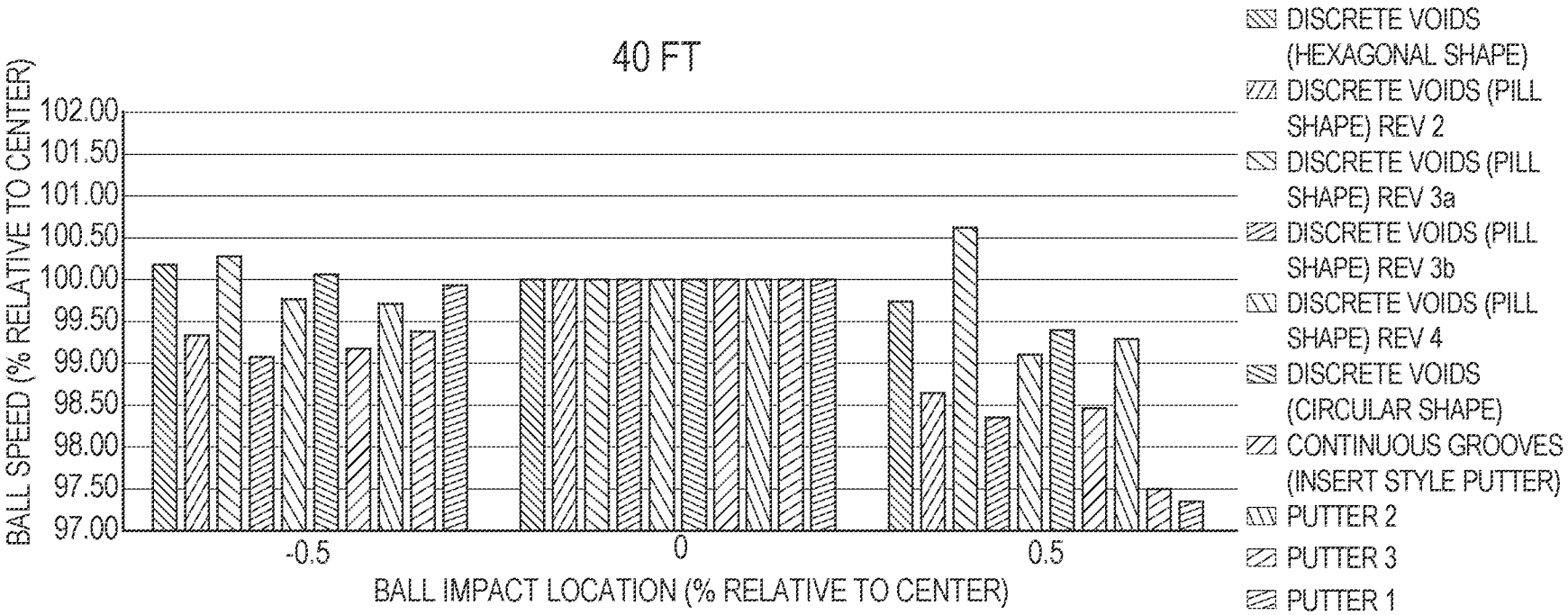
FIG. 26 shows a bar graph that compares the ball speed and ball impact location for various exemplary putter embodiments for putts of 25 feet in length.

The exemplary striking surfaces were further benchmarked against a first commercialized putter with polymer fill grooves but grooves not having less groove spacing in the center (Putter 1), a second commercialized putter having a groove concentration greater in the middle but devoid of a second material (Putter 2), and a third commercialized putter having a striking surface devoid of grooves (Putter 3). The results can be seen in FIGS. 24-26 and the data was plotted as a percentage of ball speed relative to its own center for 10 ft putts, 25 ft putts, and 40 ft putts.

TABLE 1

| Putter | Second Material Hardness | First Material Hardness | Percentage of First Material Land Area @ the heel vertical reference axis at 0.5 inch | Percentage of First Material Land Area @ the heel vertical reference axis at 0.25 inch | Percentage of First Material Land Area @ the striking surface imaginary vertical axis | Percentage of First Material Land Area @ the toe vertical reference axis at 0.25 inch | Percentage of First Material Land Area @ the toe vertical reference axis at 0.5 inch |
|---|---|---|---|---|---|---|---|
| Discrete Voids (Hexagonal Shape) | 85 D | 50 A | 31% | 47% | 55% | 47% | 31% |
| Discrete Voids (Pill Shape) Rev 2 | 85 D | 80 A | 32% | 36% | 42% | 36% | 32% |
| Discrete Voids (Pill Shape) Rev 3a | 85 D | 40 A | 30% | 44% | 53% | 44% | 30% |
| Discrete Voids (Pill Shape) Rev 3b | 85 D | 90-95 A | 30% | 44% | 53% | 44% | 30% |
| Discrete Voids (Pill Shape) Rev 4 | 85 D | 65 A | 30% | 41% | 49% | 41% | 30% |
| Discrete Voids (Circular Shape) | 85 D | 64 A | 32% | 41% | 49% | 41% | 32% |
| Continuous Grooves (Insert Style Putter) | 85 D | 63 A | 32% | 41% | 49% | 41% | 32% |

The results show that the first material hardness, the second material hardness, and the percentage of the first material along a vertical references axis at specified locations are important factors to consider when a uniform ball speed across a striking surface is desired. For example, when comparing the Discrete Voids (Pill Shaped) Rev 3A and the Discrete Voids (Pill Shaped) Rev 3B putter characteristics, it can be seen that the putters were built the same except for the first material hardness being different. In a 25 ft putt comparison, it can be seen that ball speed on heel and toe hits (relative to center impacts) on the Discrete Voids (Pill Shaped) Rev 3A putter varied approximately 1.6% more than the ball speed produced at the striking surface center. However, the Discrete Voids (Pill Shaped) Rev 3B putter varied no more than 0.8% than the ball speed produced at the center of the striking surface. This led to the conclusion that the relationship/difference between the first material and the second material hardness is an important factor to consider to effectively control ball speeds.

Additionally, this example led to the conclusion that the percentage of the first material along a vertical reference axis (at specified locations) matters. For example, when comparing the Discrete Voids (Pill Shaped) Rev 4 Putter and the Discrete Voids (Circular Shape) Putter, the first and second material hardness's were substantially the same, but the percentage of the first material along the striking surface varied. Upon off-center impacts, the Discrete Voids (Pill Shaped) Rev 4 Putter varied no more than 0.4% than the ball speed produced at the striking surface center. The Discrete Voids (Circular Shaped) varied approximately 0.8% upon off center strikes when compared to the ball speed produced at the striking surface center. Therefore, when controlling ball speed produced across the striking surface, the percentage of the first material along a vertical reference axis is another important variable to help create an even heel-to-toe hitting surface.

Example 3

In one example, the difference in ball speed between center strikes and off-center strikes were compared between a first and second club head according to the present embodiment (hereafter the "first exemplary club head" and the "second exemplary club head") and a control club head. The first and second exemplary club heads were similar to club head 700, comprising an insert with a metallic second material with a plurality of discrete circular shaped voids filled by a non-metallic first material. The first material of the first exemplary club head was thermoplastic polyurethane and the second material of the first exemplary club head was steel. The first material of the second exemplary club head was a PEBAX® elastomer, and the second material of the second exemplary club head was steel. Apart from the second material, the inserts of the first and second exemplary club heads were identical. The discrete circular voids of the first and second exemplary club heads varied in spacing in both a heel-to-toe direction and a top-rail-to-sole direction. The percentage of first material land area of the first and second exemplary club heads was 67.8% at the striking surface imaginary vertical axis, 50.8% at the 0.5 inch heel vertical axis, and 50.8% at the 0.5 inch toe vertical axis. The The control club head comprised a similar design, but lacking a multi-material face insert. Instead, the control club head comprised a single-material, uniform striking surface. The control club head comprised a smooth striking surface devoid of any grooves or voids and formed entirely of steel.

A putter-pendulum test was conducted to compare ball speed differences across the striking surface of each club head. The target length for each putt was 25 feet. For each club head, the ball speeds were compared between strikes occurring at the geometric center, 0.5 inch heel-ward of the geometric center, 0.5 inch toe-ward of the geometric center, 0.2 inch above the geometric center, and 0.2 inch below the geometric center. Further, the club head speed at impact of putt was recorded.

Table 2 below provides the results of the putter-pendulum test, including the average ball speed measured for each strike. Also displayed in Table 2 is the "smash factor" for each strike. The smash factor was calculated by dividing the ball speed by the club head speed. Smash factor factors out any variability in club head speed throughout the test and provides a clear measure of the responsiveness of the face at each location. The consistency of the responsiveness of the striking surface can be characterized by the percentage difference between the smash factor of off-center strikes relative to center strikes.

TABLE 2

| Club head | Impact Location | Club Head Speed (mph) | Ball Speed (mph) | Smash Factor | Smash Factor Difference (%) |
|---|---|---|---|---|---|
| Exemplary 1 | Center | 4.69 | 7.85 | 1.67 | |
| | 0.5 inch Heel | 4.69 | 7.83 | 1.67 | 0.3 |
| | 0.5 inch Toe | 4.71 | 7.84 | 1.66 | 0.5 |
| | 0.2 inch High | 4.68 | 7.89 | 1.69 | 0.8 |
| | 0.2 inch Low | 4.68 | 7.75 | 1.66 | 0.9 |
| Exemplary 2 | Center | 4.69 | 7.93 | 1.69 | |
| | 0.5 inch Heel | 4.69 | 7.88 | 1.68 | 0.7 |
| | 0.5 inch Toe | 4.71 | 7.84 | 1.66 | 1.4 |
| | 0.2 inch High | 4.68 | 7.93 | 1.69 | 0.6 |
| | 0.2 inch Low | 4.68 | 7.79 | 1.66 | 1.3 |
| Control | Center | 4.76 | 7.8 | 1.64 | |
| | 0.5 inch Heel | 4.76 | 7.71 | 1.62 | 1.2 |
| | 0.5 inch Toe | 4.76 | 7.61 | 1.60 | 2.5 |
| | 0.2 inch High | 4.75 | 7.75 | 1.63 | 0.4 |
| | 0.2 inch Low | 4.79 | 7.65 | 1.60 | 2.7 |

As evidenced by Table 2, the exemplary club head exhibited more consistent ball speed across the striking surface than the control club head. For strikes 0.5 inch heel-ward of the geometric center, the first exemplary club head only exhibited a difference in smash factor of 0.3% relative to the center strike and the second exemplary club head only exhibited a difference in smash factor of 0.7% relative to the center strike. In comparison, the control club head exhibited a difference in smash factor of 1.2% relative to the center strike.

For strikes 0.5 inch toe-ward of the geometric center, the first exemplary club head only exhibited a difference in smash factor of 0.5% relative to the center strike and the second exemplary club head only exhibited a difference in smash factor of 1.4% relative to the center strike. In comparison, the control club head exhibited a difference in smash factor of 2.5% relative to the center strike.

For strikes 0.2 inch above the geometric center, the first exemplary club head exhibited a difference in smash factor of 0.8% relative to the center strike and the second exemplary club head exhibited a difference in smash factor of 0.6%. In comparison, the control club head exhibited a difference in smash factor of 0.4% relative to the center strike.

For strikes 0.2 inch below the geometric center, the first exemplary club head only exhibited a difference in smash factor of 0.9% relative to the center strike and the second exemplary club head only exhibited a difference in smash factor of 1.3%. In comparison, the control club head exhibited a difference in smash factor of 2.7% relative to the center strike.

The present example illustrates that the exemplary club head comprising a multi-material strike face with varying percentages of first material land areas to second material land areas produces, in general, a more consistent ball striking surface with respect to ball speed and smash factor. Specifically, an increased percentage of first material land areas proximate the geometric center and a decreased percentage of first material land areas above, below, heel-ward, and toe-ward of the geometric center normalizes the responsiveness of off-center strikes in relation to center strikes. The consistency across the face exhibited by the exemplary club heads creates more predictable ball speeds, regardless of the strike location. The multi-material inserts of the present example therefore provide a more forgiving club head than a traditional putter head comprising a single-material strike face.

The invention claimed is:

1. A putter-type golf club head comprising:

a body comprising:

a heel portion;

a toe portion distal from the heel portion;

a top rail;

a sole portion distal from the top rail; and a striking surface forming a recess defined by the heel portion, the toe portion, the top rail, and the sole portion of the body;

a striking surface imaginary vertical axis that extends through a geometric center of the striking surface relative to the heel portion, the toe portion, the top rail, and the sole portion; and an insert configured to be received within and complimentary with the recess defined by the striking surface; wherein:

the insert comprises a first material and a second material forming at least one of a front surface adapted for impact with a golf ball, a rear surface opposite the front surface, and a second material thickness defined as a distance between the front surface and the rear surface;

the insert further defines a plurality of circular-shaped voids that extend through an entirety of the second material thickness;

wherein the plurality of circular-shaped voids are arranged in a plurality of rows extending in a heel-to-toe direction and a plurality of columns extending in a top rail-to-sole direction;

wherein a horizontal center-to-center distance between adjacent circular-shaped voids within a given row increases from the striking surface imaginary vertical axis toward the heel portion and the toe portion;

wherein the horizontal center-to-center distance between adjacent circular-shaped voids is governed by the equation:

$$H_i=H_1*B_H^{(i-1)}$$

wherein:

$H_i$ is the horizontal center-to-center distance between a give pair of adjacent circular-shaped voids; and $B_H$ is a constant greater than 1.

2. The putter-type golf club head of claim 1, wherein a minimum horizontal center-to-center distance between adjacent circular shaped voids within a given row is less than 0.1 inch.

3. The putter-type golf club head of claim 1, wherein the first material of the insert entirely covers the rear surface and fills each circular-shaped void of the plurality of circular-shaped voids.

4. The putter-type golf club head of claim 1, wherein the plurality of circular-shaped voids each comprise a common diameter.

5. The putter-type golf club head of claim 4, wherein the common diameter is less than 0.075 inch.

6. The putter-type golf club head of claim 1, wherein the first material has a hardness between Shore 30 A and Shore 95 A.

7. The putter-type golf club head of claim 1, wherein an average ratio defined as a surface area percentage of a first material land area percentage to a surface area percentage of the second material decreases from the striking surface imaginary vertical axis to a second imaginary vertical axis offset from the striking surface imaginary vertical axis.

8. The putter-type golf club head of claim 1, wherein an average ratio defined as a surface area percentage of a first material land area percentage to a surface area percentage of the second material is greater than 60% along the striking surface imaginary vertical axis.

9. The putter-type golf club head of claim 1, wherein the second material thickness is substantially constant.

10. A putter-type golf club head comprising:

a body comprising:

a heel portion;

a toe portion distal from the heel portion;

a top rail;

a sole portion distal from the top rail; and a striking surface forming a recess defined by the heel portion, the toe portion, the top rail, and the sole portion of the body;

a striking surface imaginary vertical axis that extends through a geometric center of the striking surface relative to the heel portion, the toe portion, the top rail, and the sole portion; and an insert configured to be received within and complimentary with the recess defined by the striking surface; wherein:

the insert comprises a first material and a second material forming at least one of a front surface adapted for impact with a golf ball, a rear surface opposite the front surface, and a second material thickness defined as a distance between the front surface and the rear surface;

the insert further defines a plurality of circular-shaped voids that extend through an entirety of the second material thickness;

wherein the plurality of circular-shaped voids are arranged in a plurality of rows extending in a heel-to-toe direction and a plurality of columns extending in a top rail-to-sole direction;

wherein a vertical center-to-center distance between adjacent circular-shaped voids within a given column increases from the geometric center toward the top rail and the sole portion;

wherein the vertical center-to-center distance between adjacent circular-shaped voids is governed by the equation:

$$V_i=V_1*B_V^{(i-1)}$$

wherein:

$V_i$ is the vertical center-to-center distance between a given pair of circular-shaped voids; and $B_V$ is a constant greater than 1.

11. The putter-type golf club head of claim 10, wherein a minimum vertical center-to-center distance between adjacent circular shaped voids within a given column is greater than 0.125 inch.

12. The putter-type golf club head of claim 10, wherein the plurality of circular-shaped voids each comprise a common diameter.

13. The putter-type golf club head of claim 12, wherein the common diameter is less than 0.075 inch.

14. The putter-type golf club head of claim 10, wherein an average ratio defined as a surface area percentage of a first material land area percentage to a surface area percentage of the second material decreases from the striking surface imaginary vertical axis to a second imaginary vertical axis offset from the striking surface imaginary vertical axis.

15. The putter-type golf club head of claim 10, wherein an average ratio defined as a surface area percentage of a first material land area percentage to a surface area percentage of the second material is greater than 60% along the striking surface imaginary vertical axis.

16. A putter-type golf club head comprising:

a body comprising:

a heel portion;

a toe portion distal from the heel portion;

a top rail;

a sole portion distal from the top rail; and a striking surface forming a recess defined by the heel portion, the toe portion, the top rail, and the sole portion of the body;

a striking surface imaginary vertical axis that extends through a geometric center of the striking surface relative to the heel portion, the toe portion, the top rail, and the sole portion; and an insert configured to be received within and complimentary with the recess defined by the striking surface;

wherein:

the insert comprises a first material and a second material forming at least one of a front surface adapted for impact with a golf ball, a rear surface opposite the front surface, and a second material thickness defined as a distance between the front surface and the rear surface;

the insert further defines a plurality of circular-shaped voids that extend through an entirety of the second material thickness;

wherein the plurality of circular-shaped voids are arranged in a plurality of rows extending in a heel-to-toe direction and a plurality of columns extending in a top rail-to-sole direction;

wherein a horizontal center-to-center distance between adjacent circular-shaped voids within a given column increases exponentially from the striking surface imaginary vertical axis toward the heel portion and the toe portion; and wherein the plurality of circular-shaped voids each comprise a common diameter.

17. The putter-type golf club head of claim 16, wherein a minimum horizontal center-to-center distance between adjacent circular shaped voids within a given row is less than 0.1 inch.

18. The putter-type golf club head of claim 16, wherein the common diameter is less than 0.075 inch.

19. The putter-type golf club head of claim 16, wherein an average ratio defined as a surface area percentage of a first material land area percentage to a surface area percentage of the second material decreases from the striking surface imaginary vertical axis to a second imaginary vertical axis offset from the striking surface imaginary vertical axis.

20. The putter-type golf club head of claim 16, wherein an average ratio defined as a surface area percentage of a first material land area percentage to a surface area percentage of the second material is greater than 60% along the striking surface imaginary vertical axis.

* * * * *